US008094112B2

(12) United States Patent
Furuhashi et al.

(10) Patent No.: US 8,094,112 B2
(45) Date of Patent: Jan. 10, 2012

(54) LIQUID CRYSTAL DISPLAY DRIVING METHOD/DRIVING CIRCUIT CAPABLE OF BEING DRIVEN WITH EQUAL VOLTAGES

(75) Inventors: Tsutomu Furuhashi, Yokohama (JP); Makiko Ikeda, Yokohama (JP); Naruhiko Kasai, Fujisawa (JP); Toshio Futami, Mobara (JP); Tetsuya Suzuki, Fujisawa (JP)

(73) Assignees: Hitachi, Ltd., Tokyo (JP); Hitachi Video & Information System, Inc., Kanagawa-ken (JP)

( * ) Notice: Subject to any disclaimer, the term of this patent is extended or adjusted under 35 U.S.C. 154(b) by 1407 days.

(21) Appl. No.: 11/348,401

(22) Filed: Feb. 7, 2006

(65) Prior Publication Data

US 2006/0125764 A1 Jun. 15, 2006

Related U.S. Application Data

(63) Continuation of application No. 10/139,266, filed on May 7, 2002, now Pat. No. 7,038,649, which is a continuation of application No. 09/669,446, filed on Sep. 25, 2000, now Pat. No. 6,384,807, which is a continuation of application No. 08/948,032, filed on Oct. 9, 1997, now Pat. No. 6,127,995, which is a continuation of application No. 08/135,357, filed on Oct. 13, 1993, now Pat. No. 5,731,796.

(30) Foreign Application Priority Data

Oct. 15, 1992 (JP) ..... 2004-276976

(51) Int. Cl.
*G09G 3/36* (2006.01)

(52) U.S. Cl. ..... 345/98; 345/87

(58) Field of Classification Search ..... 345/87–104, 345/204

See application file for complete search history.

(56) References Cited

U.S. PATENT DOCUMENTS

| | | | | |
|---|---|---|---|---|
| 4,196,432 | A | 4/1980 | Chihara | |
| 4,556,880 | A * | 12/1985 | Hamada | 345/213 |
| 4,775,891 | A | 10/1988 | Aoki et al. | |
| 4,955,696 | A | 9/1990 | Taniguchi et al. | |
| 5,041,823 | A * | 8/1991 | Johnson et al. | 345/94 |
| 5,093,655 | A * | 3/1992 | Tanioka et al. | 345/96 |

(Continued)

FOREIGN PATENT DOCUMENTS

JP 57-49995 3/1982

(Continued)

*Primary Examiner* — Richard Hjerpe
*Assistant Examiner* — Nelson Lam
(74) *Attorney, Agent, or Firm* — Antonelli, Terry, Stout & Kraus, LLP.

(57) ABSTRACT

A display apparatus comprising a plurality of pixel portions arranged in a matrix, a signal driver circuit which generates apply voltages corresponding to display data, and applies the apply voltages to the pixel portions, a scan driver circuit which applies a selecting voltage to selected ones of the pixel portions, and a level shifter circuit which converts a voltage level of the display data into a drive voltage level of the signal driver circuit, thereby producing level-shifted display data. The signal driver circuit generates the apply voltages based on the level-shifted display data.

6 Claims, 45 Drawing Sheets

U.S. PATENT DOCUMENTS

| | | | | | |
|---|---|---|---|---|---|
| 5,107,353 | A | | 4/1992 | Okumura | |
| 5,266,936 | A | | 11/1993 | Saitoh | |
| 5,317,334 | A | | 5/1994 | Sano | |
| 5,414,443 | A | * | 5/1995 | Kanatani et al. | 345/95 |
| 5,438,342 | A | * | 8/1995 | Yamaguchi | 345/58 |
| 5,541,619 | A | | 7/1996 | Hayashi et al. | |
| 5,598,180 | A | | 1/1997 | Suzuki et al. | |
| 5,731,796 | A | * | 3/1998 | Furuhashi et al. | 345/96 |
| 6,127,995 | A | * | 10/2000 | Furuhashi et al. | 345/96 |
| 6,680,722 | B1 | * | 1/2004 | Hiraki et al. | 345/96 |
| 2005/0162372 | A1 | * | 7/2005 | Hashimoto | 345/99 |

FOREIGN PATENT DOCUMENTS

| | | |
|---|---|---|
| JP | 63-318525 | 12/1988 |
| JP | 2-130586 | 5/1990 |
| JP | 2-262192 | 10/1990 |
| JP | 3-51887 | 3/1991 |
| JP | 3-217892 | 9/1991 |
| JP | 4-51290 | 2/1992 |
| JP | 4-237091 | 8/1992 |
| JP | 6-12035 | 1/1994 |

* cited by examiner

LIQUID CRYSTAL DISPLAY DRIVING METHOD/DRIVING CIRCUIT CAPABLE OF BEING DRIVEN WITH EQUAL VOLTAGES

CROSS-REFERENCE TO RELATED APPLICATIONS

This appln. is a cont. of application Ser. No. 10/139,266, filed May 7, 2002 now U.S. Pat. No. 7,038,649, which is a cont. of application Ser. No. 09/669,446, filed on Sep. 25, 2000 (now U.S. Pat. No. 6,384,807), which is a cont. of application Ser. No. 08/948,032 filed on Oct. 9, 1997 (now U.S. Pat. No. 6,127,995), which is a cont. of application Ser. No. 08/135,357, filed on Oct. 13, 1993 (now U.S. Pat. No. 5,731,796). The entire contents of which are incorporated herein by reference in their entirety.

BACKGROUND OF THE INVENTION

The present invention generally relates to a driving method and a driving circuit of a liquid crystal display employed in an information processing apparatus such as a personal computer. More specifically, the present invention is directed to LCD (liquid crystal display) driving method/circuit capable of applying equal drive voltages to pixel elements on a horizontal line.

Conventionally, various LCD structures and LCD 10 driving methods/circuits have been proposed. For instance, as to the structure/driving method of the TFT (thin-film transistor) liquid crystal panel, Flat Panel Display 1991 "Multi-Color Technique for TFT Color Liquid Crystal Display, from 4096 colors to 260 thousands or 15 more colors" published by Nikkei BP publisher, Nov. 26, 1990, pages 173 to 180 describes the LCD driving method with employment of the high withstanding voltage drain driver. Also, JP-A-57-49995 (1982) describes the method for converting common electrode voltages into AC voltages with employment of the low withstanding voltage drain driver. A high withstanding voltage drain driver implies a drain driver with such a withstanding voltage capable of producing voltages to obtain maximum luminance and minimum luminance having a positive polarity and a negative polarity with regard to one electrode voltage of a liquid crystal display. A low withstanding voltage drain driver implies a drain driver with one withstanding voltage capable of obtaining maximum luminance and minimum luminance having either a positive polarity or a negative polarity (namely, "a single polarity"), and also with the other withstanding voltage not capable of obtaining maximum luminance and minimum luminance having both positive/negative polarities.

The above-explained two typical conventional driving methods will now be described more in detail.

First, the LCD driving method with employment of the high withstanding voltage drain driver will now be explained with reference to FIG. 5 and FIGS. 24 to 27.

FIG. 24 schematically represents a system structural diagram of the conventional liquid crystal display apparatus with employment of the high with standing voltage drain driver.

In FIG. 24, reference numeral 101 is a system bus for transferring digital display data and a synchronization (sync) signal. In this example, it should be noted that both the display data and the sync signal transferred in the system bus 101 are such line sequential scanning signals similar to the display data and the sync signal transferred to be displayed on the CRT (cathode-ray tube) display apparatus. Reference numeral 102 denotes a liquid crystal controller for converting the digital display data and the sync signal transferred by the system bus 101 into digital LCD data and a timing signal for driving the liquid crystal display apparatus. Reference numerals 103, 104, 105 represent reference voltages in which 103 is a digital-low drive voltage $V_{EE}$, 104 is a digital-high drive voltage $V_{CC}$, and 105 is DC voltages having various LCD drive voltages. Reference numerals 106 and 107 denote signal drive circuit control buses for transferring both of the digital LCD data and the timing signal which have been converted for the signal drive circuit under control of the LCD controller 102. Reference numeral 108 is a scanning drive circuit control bus used to transfer a timing signal for a scanning drive circuit. Reference numeral 109 shows an LCD alternating signal which becomes a timing signal for alternating a polarity of a voltage applied to a liquid crystal display. Reference numerals 2401 and 2402 represent signal drive circuits for acquiring the digital LCD display data transferred via the respective signal drive circuit control buses in response to the timing signal and for converting the display data into LCD voltages corresponding to the LCD display data. Reference numerals 116 and 117 show signal lines for transferring the LCD apply voltages VDC, VDL produced in the respective signal drive circuits 2401 and 2402. Reference numeral 118 is a scanning drive circuit and reference numeral 119 is a scanning line. The scanning drive circuit 118 sequentially causes the scanning line 118 to be active in response to the timing signal transferred via the scanning drive circuit control bus 108. Reference numeral 120 is a liquid crystal display panel. Reference numeral 2403 is a reference DC voltage producing circuit for producing various DC reference voltages used to operate this LCD apparatus. Reference numeral 122 shows a DC voltage line used to the scanning drive circuit, for applying a DC voltage to the scanning drive circuit 118. Reference numeral 123 denotes a common (opposing) electrode line for transferring a DC common voltage VCOM. Reference numeral 2402 denotes a reference voltage line for transferring a high-level reference voltage VCC for driving signal drive circuits 2401 and 2402, reference numeral 2405 is similarly a reference voltage line for transferring a low-level reference voltage VEE, and reference numeral 2406 denotes a reference voltage line of a LCD drive nit, for transferring a LCD drive voltage VCCD used to drive the LCD drive circuit unit among the signal drive circuits 2401 and 2402. Any of the reference voltages transferred via the reference voltage lines 2404, 2405, 2406 are DC voltages. Reference numeral 125 shows a DC LCD apply voltage for the signal drive circuit. Reference numeral 131 denotes an AC circuit. Reference numeral is an LCD drive voltage line used to transfer the AC LCD drive voltage employed in the upper-sided signal drive circuit 2401, whereas reference numeral 133 is an LCO drive voltage line used to transfer the AC LCD drive voltage employed in the lower-sided signal drive circuit 2402.

FIG. 25 is a schematic block diagram for showing an example of the signal drive circuit 2401 of FIG. 24. It should be noted that the signal drive circuit 2402 for the lower side of the LCD panel 120 has a similar arrangement to that of this signal drive circuit 2401.

In FIG. 25, reference numerals 2501-1, 2501-2, - - - denotes drain drivers, and the signal drive circuit 2401 is arranged by a plurality of drain drivers 2501. The drain driver 2501 is so arranged that the digital LCD display data is inputted and converted into a LCD apply voltage which will then be outputted. Among the signal drive circuit control bus 106, reference numeral 2502 is a shift clock, reference numeral 2503 is a latch clock, and reference numeral 2504 is an LCD display data bus. The shift clock 2502 is synchronized with the digital LCD display data transferred via the LCD display data bus 2504, whereas the latch clock 2503 becomes active after the digital LCD display data for 1 line has been transferred to the signal drive circuits 2401 and 2402. Reference numeral 2505 is a shift register and reference numeral 2506 is a latch signal. The shift register 2505 accepts the shift clock 2502 to perform the shift operation. The latch signal 2506 sequentially becomes active in response to this latch operation. Reference numeral 2507 shows a latch circuit for successively latches the digital LCD display data transferred via the LCD display data bus 2504. Reference numeral 2508 denotes a data bus for transferring data latched by a latch circuit 2507. Reference numeral 2509 represents a latch circuit for latching data transferred via the data bus 2508. Reference numeral 2510 is a data bus for transferring the data latched by the latch circuit 2509. Reference numeral 2511 is a level sifter for converting a voltage amplitude level of digital data transferred via the data bus 2510. Reference numeral 2513 is a digital-to-analog converting circuit for converting the digital data via the data bus 2512 into a liquid crystal apply voltage based on the AC voltage transferred via the AC LCD drive voltage line 132. Reference numeral 116 is a signal line for transferring the LCD apply voltage produced by the digital-to-analog converting circuit 2513. Reference numeral 2514 shows an enable signal corresponding to such a control signal that causes the shift register 2505 of the drain driver 2501 provided at the post stage when the latch circuit 2507 has latched the digital LCD display data, namely when the shift operation of the shift register 2505 has been accomplished, and that commences the acquisition operation of the digital LCD display data by the latch circuit 2507 of the drain driver 2501 provided at the post stage. In the drain driver 2501, the shift register 2505, the latch circuit 2507, and the digital 2509 are driven by the high-level reference voltage transferred via the reference voltage line 2404 and the low-level reference voltage transferred via the reference voltage line 2405. The level sifter 2511 and the analog circuit unit of the digital-to-analog converting circuit 2513 are driven by the LCD drive voltage transferred via the reference voltage line 2406.

FIG. 5 is an equivalent circuit diagram of a liquid crystal display panel 120 shown in FIG. 1.

In FIG. 5, symbols DU(m), DU(m+1), DL(m) and DL(m+1) represent signal lines corresponding to pixel units for constituting signal lines 116 and 117. Symbols G(n−1), G(n), G(n+1) denote scanning lines corresponding to the respective pixel units for constituting a scanning line 119. Reference 501 shows a pixel unit. In the pixel unit 501, reference numeral 502 is a thin-film transistor (abbreviated as "TFT"), reference numeral 503 is a liquid crystal display, and reference numeral 504 is an added capacitance. A drain electrode of the TFT 502 is connected to the signal line 116, and a gate electrode thereof is connected to the scanning line 119. The drain electrodes of the TFTs 502 employed within the respective pixel units 501 arranged along the vertical direction commonly use the signal line, for instance, DU(m). The gate electrodes of the TFTs 502 employed in the respective pixel units 502 arranged along the horizontal direction commonly use the scanning line, for example, G(n). Furthermore, the source electrodes of the TFTs 502 are connected to one electrode of each of the liquid crystal display 503 and the added capacitance 504. The other electrode of the liquid crystal display 503 is connected to a common electrode line 123, and all pixels thereof commonly utilize the common electrode line 123. One electrode of the added capacitance 504 is connected to the scanning line provided at the pre stage. For example, in case of the added capacitance 504 connected to the TFT 502 under control of the scanning line G(n), the electrode is connected to the scanning line G(n−1).

As described above, this LCD panel 120 is constructed of a matrix structure having a plurality of pixel units 501 along the horizontal direction and the vertical direction. For instance, when a screen with 640 pixels in horizontal resolution and 480 lines in vertical resolution is displayed, the horizontal resolution of 640 pixels can be realized by arranging 1920 pixels along the horizontal direction, and attaching red, green, blue color filters to three adjacent pixels to constitute 1 pixel. Furthermore, the 480 pixel arrangements as explained with regard to the horizontal direction are prepared for the vertical direction, thereby obtaining the vertical resolution of 480 lines.

FIG. 26 represents voltage waveforms appearing when the conventional LCD display apparatus of FIG. 24 is driven. It should be noted that the voltage waveforms represent a line AC drive for alternately changing the polarity of voltage applied to the LCD for every line.

In FIG. 26, symbol VG(n) shows a voltage waveform of the scanning line G(n) shown in FIG. 5, and symbol VG(n+1) represents a voltage waveform of the scanning line G(n+1). Symbol VGH denotes a selective voltage level and VGL represents a non-selective voltage level. Symbol VCOM is a voltage value of a common electrode 123. A voltage level of the reference voltage line 2406 is VLCD, whereas a voltage level of the reference voltage line 2405 is VEE. Symbols VDU and VDL show drive waveforms of LCD apply voltages outputted from the respective signal lines 116 and 117 in this prior art.

FIG. 27 is a graphic representation of a relationship between luminance and a voltage of the liquid crystal display employed in this prior art.

In FIG. 27, an ordinate indicates luminance and an abscissa shows an LCD apply voltage reference numeral 901 shows a luminance-voltage characteristic when a positive LCD voltage is applied, and reference numeral 902 shows a voltage-luminance characteristic when a negative LCD voltage is applied. As apparent from this drawing, the liquid crystal display owns such a characteristic that even when any of voltages having a positive polarity and a negative polarity with respect to the common electrode voltage VCOM are applied, if absolute values of these voltages are equal to each other, then similar luminance representations are realized. In this prior art, when the value of the LCD apply voltage is small, namely when the LCD apply voltage is approximated to the voltage value of the opposite electrode 123 (for instance, voltage +VDW and voltage −VDW), there is such a characteristic that luminance is high, and this luminance may be lowered every time any of the positive apply voltage and the negative apply voltage are increased. It should be noted that the voltage $V_{EE}$ corresponds to the low-level reference voltage of the drain driver 2501 shown in FIG. 25 and the voltage VLCD corresponds to the reference voltage of the LCD drive unit.

Again with reference to FIGS. 5 and 24 to 27, operation of the conventional LCD apparatus will now be described.

In FIG. 24, the digital LCD data transferred via the system bus 101 is converted through the LCD controller 102 and the signal drive circuits 2401, 2402 into the LCD apply voltage. The LCD apply voltage is outputted to the LCD panel 120 for display purposes. In the LCD controller 102, the digital display data inputted via the system bus 101 is converted into the sync signal in order to be fitted to the input interfaces of the signal drive circuits 2401 and 2402 and the pixel arrangement of the LCD panel 120, and then the sync signal is outputted via the signal drive circuit control buses 106 and 107. Both of the digital LCD display data and the timing signal supplied via the signal drive circuit control buses 106 and 107 are entered into the signal drive circuits 114 and 115 so as to be converted into the LCD apply voltages. The above-described operations will now be explained with reference to FIG. 25.

In FIG. 25, in response to the shift clock 2502, the shift register 2505-1 starts its operation and sequentially enables the latch signal 2506-1 in the drain driver 2501-1. The storage circuit in the latch circuit 2507-1, corresponding to the enable latch signal 2506-1, sequentially latches the digital LCD display data transferred via the display data bus 2504. The latches data are outputted to the data bus 2508-1. When the data acquisition operation by the storage circuit within the latch circuit 2507-1 is accomplished, namely when the shift operation of the shift register 2505-1 is completed, the shift register 2505-1 brings the enable signal 2514-1 into an active (enable) condition. When the enable signal 2514-1 become active, the shift operation of the shift register 2505-2 employed in the drain driver 2501-2 provided at the subsequent stage is commenced. Then, the latch circuit 2507-2 sequentially latches the data which have been latched by the latch circuit 2507-1 in the drain driver 2501-1. Furthermore, upon completion of the data acquisition operation by the storage circuit in the latch circuit 2507-2, the enable signal 2514-2 becomes active, and the drain driver 2501 at the next stage performs a similar operation to that of the drain driver 2501-1. Since the above operation are carried out by the respective drain drivers 2501 employed in the signal drive circuits 2401 and 2402, the LCD display data used for 1 horizontal line can be acquired.

After the LCD display data for 1 horizontal line have been acquired by the latch circuit 2507 in the respective drain drivers 2501, the latch clock 2503 becomes enabled, the data which are transferred via the data bus 2508 of the respective drain drivers 2501 and are stored in the latch circuit 2508, are latched for 1 horizontal line by the latch circuit 2509 at the same time. After the data have been stored by the latch circuit 2509, the shift register 2505 and the latch circuit 2507 of the respective drain drivers 2501 commence operations similar to the above-described operations in order to fetch the data for the subsequent line. It should be noted that the drive voltage of the drain driver 2501 described in this prior art is different from the drive voltages for the shift register 2505, the latch circuit 2507, the digital circuit unit of the latch circuit 2509, and the digital-to-analog converting circuit 2513. The digital circuit unit is operated by the low-level reference voltage transferred via the reference voltage line 2405 and the high-level reference voltage transferred via the reference voltage line 2404. However, the digital-to-analog converting circuit 2513 is operated by the LCD drive voltage transferred via the reference voltage line 2406. Necessity of the LCD drive voltage transferred via the reference voltage line 2408 in the digital-to-analog converting circuit 2513 will now be explained with reference to FIG. 26 and FIG. 27.

In the voltage-luminance characteristic diagram shown in FIG. 27, the liquid crystal display owns similar luminance displays to each other even when a positive-porality voltage and a negative-porality voltage are applied thereto with respect to the common electrode voltage VCOM, if absolute values thereof are equal to each other.

Furthermore, there is a problem that when a DC voltage is applied to the liquid crystal display, deterioration thereof may occur. Therefore, the DC voltage applied to the liquid crystal display must be alternately changed in a certain period. In addition, to display a structure of 1 frame, image deterioration caused by a flicker phenomenon is prevented by setting that the luminance display of the LCD driven by the DC voltage having the positive polarity is equal to the luminance display of the LCD driven by the DC voltage having the negative polarity. As a consequence, when the voltage having the negative polarity with respect to the common voltage is applied, the voltage of −VDW is applied to the liquid crystal display so as to achieved a high luminance display, whereas the voltage of −VDB is applied to it in order to achieve a low luminance display. Furthermore, when the voltage having the negative polarity with respect to the common voltage, the voltage of +VDW is applied to the liquid crystal display so as to achieve a high luminance display, whereas the voltage of +VDB is applied thereto in order to achieve a low luminance display.

Thus, since the digital-to-analog converting circuit 2513 of the prior art LCD can be so constructed as to produce the LCD apply voltages having the positive polarity and the negative polarity, the drive voltages thereof have such a relationship (VLCD−VEE)<(+VDB−(−VDB). Although it depends upon luminance characteristics of liquid crystal display, since the drive voltage for the digital-to-analog converting circuit 2513 is different from the drive voltage for the digital circuit unit within the drain driver 2501, the level sifter 2511 for perform the voltage conversion is required between the digital circuit unit and the digital-to-analog converting circuit 2513.

The data stored in the latch circuit 2509 is processed via the data bus 2510 in the level sifter 2511 for the voltage conversion, and then the voltage-converted data is transferred via the data bus 2512 to the digital-to-analog converting circuit 2513. In the digital-to-analog converting circuit 2513, the LCD apply voltage corresponding to the digital data is generated in response to the LCD drive voltage transferred via the LCD drive voltage line 132, and then outputted via the signal line 116. Since the digital-to-analog converting circuit 2513 is driven by the LCD drive unit reference voltage VLCD, and the low-level reference voltage VEE, the LCD apply voltage transferred via the signal line 116 is present within the operation range of the voltage-luminance characteristic shown in FIG. 27, and thus this LCD apply voltage becomes a voltage required to a luminance display.

Moreover, conditions under which a voltage is applied to the liquid crystal display panel 120 of FIG. 24 will now be explained.

The display data transferred via the system bus 101 is converted into the LCD apply voltages by the signal drive circuits 2401, 2402 and the AC circuit 131 of FIG. 24 to obtain the LCD apply voltages VDU and VDL represented in FIG. 26, which are outputted to the LCD panel 120. At this time, in the scanning drive circuit 118, the shift operation is carried out by the scanning drive circuit control bus 108. The scanning line 119 connected to the horizontal line for applying the LCD apply voltages derived from the signal drive circuits 114 and 115, becomes active.

The voltage VDU shown in the drive waveform chart of FIG. 26 is applied from the signal drive circuit 2401 to the signal line 116. The voltage VDL shown in the drive waveform chart of FIG. 26 is applied from the signal drive circuit 2402 to the signal line 117. The scanning line G(n) is operated in such a manner that the selective voltage VGH becomes active during 1 line period, and thereafter the non-selective voltage VGL becomes active during 1 frame period. When the selective voltage VGH of the scanning line G(n) becomes active, the TFT 502 of the pixel unit 501 connected to the scanning line G(n) shown in FIG. 5 is brought into an ON state, and the voltages appearing on the signal lines 116 and 117 are stored via the TFT 502 into the liquid crystal display 503 and the load capacitance 504.

The drive voltages of the liquid crystal 503 must be converted into AC voltage with a certain time period so as to prevent deterioration. Also, as shown in FIG. 27, luminance may be varied, depending on the voltage accumulated in the liquid crystal 503. When the positive potential voltage with regard to the common electrode 123 is applied to the liquid crystal 503, this liquid crystal 503 owns the characteristic of the luminance-voltage curve 901, whereas when the negative potential voltage with respect to the common electrode 123 is applied to the liquid crystal 503, this liquid crystal 503 owns the characteristic of the luminance-voltage curve 902. As a result, since luminance of the liquid crystal can be controlled by the effective value of the applied voltage, irrelevant to the polarity of the applied voltage, the polarities of the apply voltage are alternately changed with respect to the common electrode voltage VCOM for each frame in order to prevent deterioration of the liquid crystal. Based on this alternating apply voltage, the crystal liquid display is performed.

Then, another conventional liquid crystal display apparatus with employment of the low-withstanding voltage drain driver will now be described with reference to FIGS. 28 to 32.

In FIG. 28, reference numeral 2801 and 2802 denote signal drive circuits which fetch digital LCD data transferred via the respective signal drive circuit control buses 106 and 107 in response to a timing signal, and converts the fetched data into the LCD apply voltages corresponding to the LCD display data. Reference numerals 116 and 117 are signal lines used to transfer the LCD apply voltages generated in the respective signal drive circuits 114 and 115. Reference numeral 2803 denotes a reference DC voltage generating circuit for generating various sorts of DC voltages functioning as reference voltages to drive the LCD apparatus. Reference numeral 2804 denotes a DC voltage line. Reference numeral 2805 indicates a signal drive circuit DC voltage line. Reference numeral 2806 denotes an AC circuit. Reference numeral 2807 shows a reference voltage line for transferring an alternating non-selective voltage outputted from the scanning circuit 118. Reference numeral 123 indicates a common electrode line for transferring an alternating common electrode voltage. Further, reference numeral 2808 shows an AC circuit for producing alternating LCD drive voltages to be applied to the signal drive circuit 2801. Reference numeral 2809 denotes an LCD apply voltage line for transferring the alternating LCD apply voltage used in the upper-sided signal drive circuit 2802, and reference numeral 2010 shows an LCD apply voltage line for transferring the alternating LCD apply voltage employed in the lower-sided signal drive circuit 115.

FIG. 29 is a schematic block diagram for showing the signal drive circuit 2801 of FIG. 28.

In FIG. 29, reference numerals 2901-1, 2901-2, - - - , indicate drain drivers, and a signal drive circuit 2801 is arranged by a plurality of drain drivers 2901. The drain drivers receive the digital LCD display data to be converted into LCD apply voltages, and outputs the LCD apply voltages to the LCD panel 120. Among the signal drive circuit control bus 106, reference numeral 2904 is an LCD display data bus, reference numeral 2902 denotes a shift clock, and reference numeral 2903 is a latch clock. The shift clock 2902 is synchronized with the digital LCD display data transferred via the LCD display data bus 2904, and the latch clock 2903 becomes active after the digital LCD display data for 1 horizontal line have been transferred to the signal drive circuits 2801 and 2802. Reference numeral 2905 shows a digital-to-analog converting circuit for converting the digital data transferred via the data bus 2510 based on the LCD drive voltage transferred via the LCD-drive voltage line 2809 into the LCD apply voltages. Reference numeral 116 denotes a signal line for transferring the LCD apply voltages produced by the digital-to-analog converting circuit 409. The drain driver 2901 has such a different point from the drain driver 2501 shown in FIG. 25 that any of the shift register 403, the latch circuit 405, the digital circuit unit of the latch circuit 407, and the digital-to-analog converting circuit 2905 are driven by the high-level reference voltage transferred via the reference voltage line 2404 and the low-level reference voltage transferred via the reference voltage line 2405.

FIG. 30 represents voltage waveforms produced when the LCD apparatus of FIG. 29 is driven. It should be noted that the present voltage waveforms show line AC drives in which the polarity of the voltages applied to the liquid crystal are alternately switched for every line.

In FIG. 30, symbol VG(n) is a voltage waveform of the scanning line G(n) shown in FIG. 5, and symbol VG(n+1) is a voltage waveform of the scanning line G(n+1) indicated in FIG. 5. Symbol VGH denotes a selective voltage level of the scanning line 119, and symbols VGLH and VGLL are non-selective voltage levels. Symbol VCOMH shows a high-level common electrode voltage value of the common electrode 123, and symbol VCOML represents a low-level common electrode voltage value of the common electrode 123.

FIG. 31 explanatorily shows such conditions that either a positive potential voltage, or a negative potential voltage is applied to the respective pixel units when the LCD display panel is driven at the timings of FIG. 29, and also directions of currents produced in the pixel units at this time.

In FIG. 31, symbol "+" represents an application of a voltage having a positive polarity with respect to the voltage of the common electrode 123, and symbol "–" show an application of a voltage having a negative polarity with regard to the voltage of the common electrode 123.

FIG. 32 is a graphic representation for indicating a relationship between a voltage and luminance of the liquid crystal display.

In FIG. 32, an abscissa indicates luminance, and an ordinate represents an LCD apply voltage. Reference numeral 901 denotes a luminance-voltage characteristic when the positive voltage is applied, and reference numeral 902 shows a luminance-voltage characteristic when the negative voltage is applied.

In this conventional LCD display apparatus, this LCD display apparatus owns such a characteristic that, when no voltage is applied to the liquid crystal signal, namely the apply voltage is 0V, the highest luminance is obtained, and the luminance is lowered when either the positive apply voltage, or the negative apply voltage is increased. As previously explained in the above-described prior art, since the liquid crystal represents the same luminance irrelevant to the polarities of the apply voltages if the absolute voltage values thereof with respect to the voltage of the common electrode 123, if two different common electrode voltages VCOMH and VCOML are provided, then the resultant voltage-luminance characteristic as shown in FIG. 32 is obtained.

Referring again to FIGS. 28 to 32, operations of this liquid crystal display apparatus will be described.

In FIG. 28, the digital display data transferred via the system bus 101 is converted through the LCD controller 102 and the signal drive circuits, 2801, 2802 into the LCD apply voltage, and this LCD apply voltage is outputted to the LCD panel 120 for display purposes. The LCD controller 102 converts the digital display data entered into the system bus 101 into the sync signal in conformity to the input interfaces of the signal drive circuits 2801, 2802 and the pixel arrangements of the LCD panel 120, and the sync signal is outputted via the signal drive circuit control buses 106 and 107.

Although the operation of the drain driver 2901 shown in FIG. 29 is similar to that of the drain driver 2501 of FIG. 25, there is a different point that the digital-to-analog converting circuit 2908 is operated under a low voltage equal to the drive voltages for the respective digital circuit units of the shift register 2505, the latch circuit 2507, and the latch circuit 2509. Thus, in contradiction to the first-mentioned prior art LCD display apparatus shown in FIG. 24, since the withstanding voltage of the LCD drive circuit unit is low, various efforts are made of establishing the drive method for applying the proper voltage to the LCD panel in order to obtain necessary display luminance.

As illustrated in the voltage-luminance characteristic diagram of FIG. 32, two common voltages of VCOML and VCOMH are produced. In case that the voltage applied to the liquid crystal is a positive polarity voltage, the voltage-luminance characteristic curve 901 is utilized. The common electrode voltage VCOML is used, and the voltage applied to the liquid crystal is higher than the common electrode voltage VCOML. For instance, in case of high luminance representation, the voltage VDWH is applied to the liquid crystal, whereas in case of low luminance representation, the voltage VDBH is applied to the liquid crystal. Furthermore, when the voltage applied to the liquid crystal corresponds to the negative polarity voltage, the voltage-luminance characteristic curve 902 is employed. The common electrode voltage VCOMH is used and the voltage applied to the liquid crystal is a voltage lower than the common electrode voltage VCOMH. For example, in case of high luminance representation, the voltage VDWL is applied to the liquid crystal, whereas in case of low luminance representation, the voltage VDBL is applied to the liquid crystal. Since these LCD apply voltages VDWH, VDBH, VDWL and VDBL can be produced within the voltage range of the reference voltage VCC-VEE which is being applied to the digital-to-analog converting circuit 2908 employed in the drain driver 2901 shown in FIG. 29, the display operation is available. As shown in the drive waveforms of FIG. 30, the common electrode voltage VCOM of the common electrode line 123 is required to be produced as an AC voltage for each line in synchronism with the LCD alternating signal. As a result, the LCD apply voltages produced in the signal drive circuits 2801 and 2802 become the waveform of "VD", and if a potential difference between the LCD apply voltages and the common electrode voltage VCOM is small, the luminance of the LCD is increased in accordance with the voltage-luminance characteristic shown in FIG. 31. If a potential difference between then is large, the luminance of the LCD is lowered in accordance with the voltage-luminance characteristic shown in FIG. 31.

In addition, in the even frames and the odd frames, since the polarities of the voltages applied to the LCD are alternately changed, it is possible to prevent deterioration of the liquid crystal.

Now, a problem may be caused by the pixel arrangement of the LCD panel 120.

In this prior art, it is assumed that a capacitance of the liquid crystal 503 for constituting the respective pixel units 501 is C1*c* and a capacitance of the added capacitance 504 is Cadd. When the liquid crystal 503 is held under the common electrode voltage VCOML and the voltage Vc1 with the positive polarity, if this common electrode voltage is changed into VCOMH, such a voltage variation Cadd/(C1*c*+Cadd)×(VCOMH−VCOML) happens to occur in the holding voltage of the liquid crystal 503. This is because one electrode of the added capacitance Cadd is constructed of the scanning line 119 provided at the prestage, and the voltage at this electrode is constant, though the common electrode voltage VCOM is changed. This implies that the LCD apply voltage is varied during the holding period by alternately changing the common electrode voltage VCOM, and display luminance of the liquid crystal 503 is also varied. To prevent the voltage variation in the LCD apply voltage during the holding period, the voltage appearing on the scanning line 119 at the prestage must be alternately changed only by the AC voltage value of the common electrode voltage VCOM. It should be noted that since the common electrode 123 functions as a common electrode at the respective pixel units 501 within the LCD panel 120, the voltage of the scanning line 119 at the prestage is alternately changed in phase with that of the common electrode voltage.

Accordingly, it is determined that when the common electrode voltage is VCOML, the non-selective voltage level of the scanning line 119 is VGLL, whereas when the common electrode voltage VCOMH, the non-selective voltage level of the scanning line 119 is VGLH. It should be understood that when the following condition is statisfied (VGLH−VGLL)=(VCOMH−VCOML), the voltages applied to the liquid crystal are not varied.

In this prior art, the non-selective voltage VGL is alternately changed by an AC circuit 2806 shown in FIG. 28.

In FIG. 32, there is shown polarities of the voltages applied to the pixel unit 501. As previous mentioned, since the common electrode 123 is commonly used to the liquid crystal 503 within all pixel units 501, when the common electrode voltage is VCOMH, all voltages applicable to the liquid crystal are voltages having negative polarities, whereas when the common electrode voltage is VCOML, all voltages applicable to the liquid crystal are voltages having positive polarities. Therefore, the polarities of the apply voltages become identical to each other in 1 horizontal line, and the polarities are reversed for every line.

In the pixel unit 501 to which the voltage with the positive polarity is being applied, a current is flown through the liquid crystal 503 into the common electrode line 123, and then flown via the added capacitance 504 into the scanning line 119 at the prestage. In the pixel unit 501 to which the voltage with the negative polarity is being applied, a current is flown from the common electrode line 123 through the liquid crystal 503, and then flown via the added capacitance 504 from the scanning line 119 at the prestage. Under the above described controls, the LCD display can be done with employment of the low-withstanding-voltage drain driver.

With respect to the prior art LCD display apparatus shown in FIG. 24, there is another problem that the signal drive circuits 2401 and 2402 cannot be manufactured at low cost. Since the drive voltage of the digital-to-analog converting circuit 2513 in the drain driver 2501 for constituting the signal drive circuits 2401, 2402 is high, a high withstanding voltage process for LSI must be employed. The minimum dimension of the element for constituting the LSI manufactured under the high withstanding voltage process is 3 times to 5 times greater than a minimum dimension of an element for an LSI manufactured under the low withstanding voltage process, used in a digital circuit and the like. Accordingly, when the circuits having the same functions and characteristics except for the output voltage are arranged by the withstanding voltage process and the low withstanding voltage process, since the circuit area thereof becomes approximately the squared minimum dimension, a ratio of the circuit area constructed by the high withstanding voltage process to that by the low withstanding voltage process is selected to be approximately 10 times to 20 times. Since the price of LSI depends upon the chip size, cost of the drain driver 2501 constructed by the high withstanding voltage process become expensive, as compared with that by the low withstanding voltage process.

Moreover, there is a trend that a quantity of display colors will be increased in order to manufacture an LCD display apparatus with high performance. To increase the quantity of display colors of the LCD display apparatus, since the circuit scale of the drain driver 2501 becomes large, such a high cost problem with the high withstanding voltage process will become more serious.

Then, it may be conceived use of the low withstanding voltage process for manufacturing the drain driver 2901 in order to manufacture the signal drive circuit at low cost.

In accordance with this prior art drain driver 2901, low cost of the signal drive circuits 2801 and 2802 may be realized. Then, the conventional LCD display apparatuses have be manufactured as represented in FIG. 28. As in the conventional LCD display apparatus of FIG. 28, the polarities of the voltages applied to the respective pixel units 501 of the LCD panel 120 are illustrated in FIG. 31 in accordance with such a drive method for alternately changing the common electrode voltage transferred by the common electrode 123. As a result, the current flown into/from the scanning line 119 at the prestage and the common electrode line 123 is directed only one direction for each scanning line 109. For instance, as to the scanning line G(n−1), since the voltages applied to the pixel units 501-U(m)-(n), 501-L(m)-(n), 501-U(M+1)-(n) are positive polarities, the currents flowing via the added capacitances 504 of the respective pixel units 501 are concentrated and flown into the scanning line G(n−1). As to the scanning line G(n), since the voltages applied to the pixel units 501-U(m)-(n+1), 501-L(m)-(n+1), 501-U(m+1)-(n+1) are negative polarities, the currents flowing via the added capacitances 504 of the respective pixel units 501 are concentrated and flown from the scanning line G(n). Since the scanning line 109 has a wiring resistance, voltages are produced on this scanning line 109 by the flowing in/out currents and the wiring resistance. In particular, when such LCD display apparatuses as in workstations and the like require high definition and a large number of pixels, the currents are increased, so that the resultant voltages are increased. Due to this voltage variation, the voltage values applied to the added capacitances 504 are also varied. In addition, voltage variations happen to occur also in the common electrode line 123 due to adverse influences caused by the concentrated currents. In response to the voltage variations, the apply voltage values to the liquid crystal 504 are also changed. If the voltage variations happen to occur in the liquid crystal 503 and the added capacitance 504, the normal luminance representation for the display data cannot be achieved, resulting in deterioration of image quality.

A primary object of the present invention is to control with employment of a low withstanding voltage drain driver that both of a positive-polarity voltage and a negative-polarity voltage are applied to each of pixel units for a 1 horizontal line are applied, whereby a high image quality representation can be realized.

A secondary object of the present invention is to control that even when a plurality of drain drivers are provided at either an upper side, or a low side, a positive-polarity voltage and a negative-polarity voltage are equally applied to each of pixel units for 1 horizontal line, whereby a high image quality representation can be realized.

A third object of the present invention is to control with employment of a low withstanding voltage drain driver into which analog display data is entered, that both of a positive-polarity voltage and a negative-polarity voltage are applied to each of pixel units for 1 horizontal line.

A fourth object of the present invention is to reduce fluctuation in output voltages of a drain driver in order to realize a high image quality representation.

A fifth object of the present invention is to arrange an information processing apparatus by employing a liquid crystal display apparatus capable of a high image quality representation, while being driven by a low withstanding voltage drain driver.

SUMMARY OF THE INVENTION

To achieve the primary object, in accordance with the present invention, a liquid crystal panel is arranged by a plurality of matrix-formed pixel units; the pixel unit is arranged by either liquid crystal and a switching transistor, or liquid crystal, a switching transistor, and an added capacitance; one electrode of the liquid crystal is a DC common electrode voltage, the liquid crystal is so arranged as to control a light transmission amount by an apply voltage value with respect to the common electrode voltage, thereby perform a luminance representation; signal lines used to transfer voltages which are applied to the liquid crystal of the respective pixel units, are drawn from both of an upper side and a lower side of the liquid crystal panel, and are driven by signal drive circuits constructed of plural drain drivers; both of a reference voltage level and a liquid crystal drive voltage for the upper-sided signal drive circuit and the lower-sided signal drive circuit own phases opposite to a phase of the common electrode voltage in a certain time period; display data and a synchronization signal, which are transferred via a system bus, are converted into data suitable for the arrangements of the signal drive circuits and the liquid crystal display panel; the converted liquid crystal display data and a voltage level of a timing signal are shifted so as to be fitted to drive voltage levels of each of the upper-sided and lower-sided signal drive circuits; and both of the liquid crystal display data and the timing signal, whose voltage levels have been shifted, are inputted to the signal drive circuits.

To achieve the secondary object, in accordance with the present invention, a liquid crystal panel is arranged by a plurality of matrix-formed pixel units; the pixel unit is arranged by either liquid crystal and a switching transistor, or liquid crystal, a switching transistor, and an added capacitance; one electrode of the liquid crystal is a DC common electrode voltage, the liquid crystal is so arranged as to control a light transmission amount by an apply voltage value with respect to the common electrode voltage, thereby perform a luminance representation; signal lines used to transfer voltages which are applied to the liquid crystal of the respective pixel units, are drawn from both of an upper side and a "lower side of the liquid crystal panel, and are driven by signal drive circuits constructed of plural drain drivers; both of a reference voltage level and a liquid crystal drive voltage owns phases opposite to a phase of the common electrode voltage in a certain time period within the drain driver of the signal drive circuit; display data and a synchronization signal, which are transferred via a system bus, are converted into data suitable for the arrangements of the signal drive circuits and the liquid crystal display panel; the converted liquid crystal display data and a voltage level of a timing signal are shifted so as to be fitted to a drive voltage levels of each of the upper-sided and lower-sided signal drive circuits; and both of the liquid crystal display data and the timing signal, whose voltage levels have been shifted, are inputted to the signal drive circuits.

To achieve the third object, in accordance with the present invention, a liquid crystal panel is arranged by a plurality of matrix-formed pixel units; the pixel unit is arranged by either liquid crystal and a switching transistor, or liquid crystal, a switching transistor, and an added capacitance; one electrode of the liquid crystal is a DC common electrode voltage, the liquid crystal is so arranged as to control a light transmission amount by an apply voltage value with respect to the common electrode voltage, thereby perform a luminance representation; signal lines used to transfer voltages which are applied to the liquid crystal of the respective pixel units, are drawn from both of an upper side and a lower side of the liquid crystal panel, and are driven by signal drive circuits constructed of plural drain drivers; a reference voltage level owns a phase opposite to a phase of the common electrode voltage in a certain time period in the drain driver of the signal drive circuit; both of analog display data and a synchronization signal, which are transferred via a system bus, are converted into data suitable for the arrangements of the signal drive circuits and the liquid crystal panel; a polarity of the analog liquid crystal display data suitably converted for the upper-sided signal drive circuit is opposite to a polarity of the analog liquid crystal display data suitably converted for the lower-sided signal drive circuit; the phase-shifted liquid crystal display data and a voltage level of a timing signal are shifted so as to be fitted to drive voltage levels of each of the upper-sided and lower-sided signal drive circuits; and both of the liquid crystal display data and the timing signal, whose voltage levels have been shifted, are inputted to the signal drive circuits.

To achieve the fourth object, in accordance with the present invention, a drain driver for producing a liquid crystal apply voltage is so arranged that a plurality of liquid crystal drive voltages are inputted from an external power supply circuit, a voltage corresponding to an upper bit of display data is selected, and the selected two-level voltages are subdivided, a voltage corresponding to a lower bit of the display data is selected from the subdivided voltage which will then be outputted. For a constant time period after the voltage selection, this drain driver outputs the voltage selected by the upper bit, and thereafter for another constant time period, outputs a liquid crystal apply voltage corresponding to the display data selected by the upper bit and the lower bit.

To achieve the fifth object, in accordance with the present invention, an information processing apparatus is arranged by a central processing unit, a system memory, a display memory for strong display data, a display controller for controlling the display data to be written into/read from the display memory, and a liquid crystal display apparatus for displaying the display data read from the display memory.

In the means for achieving the primary object, even if the drain driver does not have a drive withstanding voltage function capable of simultaneously driving the positive-polarity voltage and the negative-polarity voltage with regard to the common electrode voltage of the liquid crystal, the upper-sided and lower-sided signal drive circuits can produce both of the liquid crystal apply voltages having the positive polarity and the negative polarity in a certain time period with regard to the common electrode voltage of the liquid crystal by alternately changing the reference voltage level and the liquid crystal drive voltage level with regard to the common electrode voltage, and also by shifting the voltage levels of the liquid crystal display data and the timing signal to the drive voltage levels of the signal drive circuits. Furthermore, the upper-sided and lower-sided signal drive circuits are driver in the opposite phase with regard to the phase of the common electrode voltage, so that the voltage having the positive polarity and the voltage having the negative polarity can be equally applied to the respective pixel units on 1 horizontal line.

In the means for achieving the secondary object, even if the drain driver does not have a drive withstanding voltage function capable of simultaneously driving the positive-polarity voltage and the negative-polarity voltage with regard to the common electrode voltage of the liquid crystal, the upper-sided or lower-sided signal drive circuit can produce both of the liquid crystal apply voltages having the positive polarity and the negative polarity in a certain time period with regard to the common electrode voltage of the liquid crystal by alternately changing the reference voltage level and the liquid crystal drive voltage level with regard to the common electrode voltage, and also by shifting the voltage levels of the liquid crystal display data and the timing signal to the drive voltage levels of the signal drive circuit. Furthermore, when some of the drain drivers employed in the signal drive circuit are driven by the voltage having the positive polarity with respect to that of the common electrode voltage, since the remaining drain drivers are driven by the drive voltage having the negative polarity with regard to that of the common electrode voltage, the positive-polarity voltage and the negative polarity voltage can be equally applied to the respective pixel units on 1 horizontal line.

In the means for achieving the third object, even if the drain driver does not have a drive withstanding voltage function capable of simultaneously driving the positive-polarity voltage and the negative-polarity voltage with regard to the common electrode voltage of the liquid crystal, the upper-sided and lower-sided signal drive circuits can produce both of the liquid crystal apply voltages having the positive polarity and the negative polarity in a certain time period with regard to the common electrode voltage of the liquid crystal by alternately changing the reference voltage level, reversing the polarity of the analog liquid crystal display data, and also shifting the analog liquid crystal display data and the timing signal to the drive voltage levels of the signal drive circuits. Furthermore, the upper-sided and lower-sided signal drive circuits are driver in the opposite phase with regard to the phase of the common electrode voltage, so that the voltage having the positive polarity and the voltage having the negative polarity can be equally applied to the respective pixel units on 1 horizontal line.

In the means for achieving the fourth object, since the liquid crystal apply voltages produced by the drain drivers are produced from a plural levels of liquid crystal drive voltages inputted from the external power source circuit, the stable liquid crystal apply voltages can be obtained. Furthermore, for a constant time period, the liquid crystal apply voltages do not pass through the voltage dividing circuit, so that the current drivability may be increased, and the time during which the voltages are stored in the pixel units can be shortened.

In the means for achieving the fifth object, the contents of the display memory for storing the display content may be readily updated by the main memory for storing the program, the central processing unit, and the display controller, and the display content stored in the display memory may be easily displayed on the liquid crystal display apparatus by the display controller.

DESCRIPTION OF THE PREFERRED EMBODIMENTS

Referring to FIGS. 1 to 13 and a table 1, a liquid crystal display apparatus, according to an embodiment of the present invention, arranged by employing signal drive circuits at an upper side of a liquid crystal panel and a lower side thereof. The signal drive circuits convert input digital display data into a liquid crystal apply voltage and supply the liquid crystal panel for representation purposes.

Figure 1:
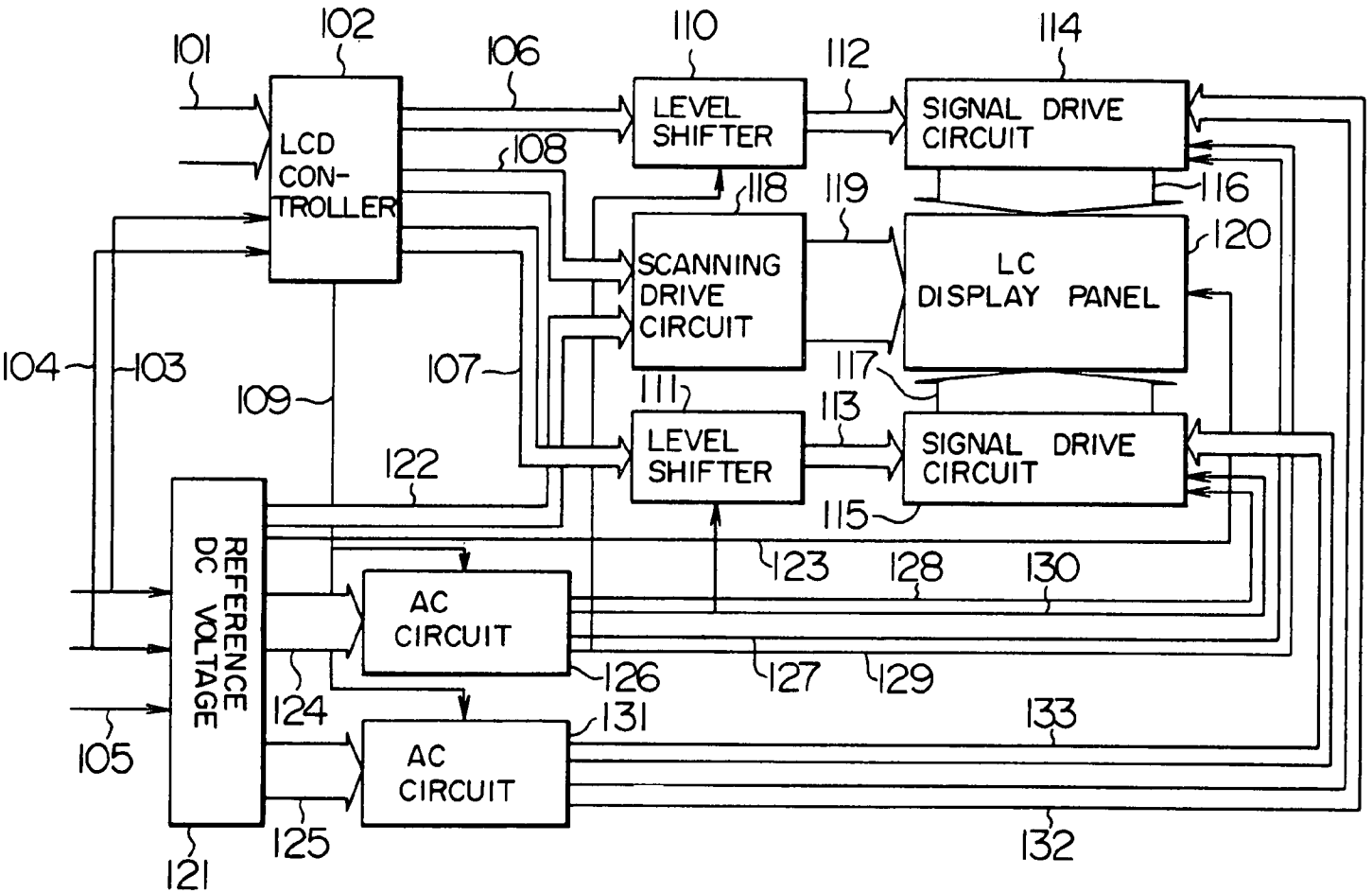
FIG. 1 schematically shows a system arrangement of a liquid crystal display apparatus according to an embodiment of the present invention.

FIG. 1 schematically shows a system arrangement of the liquid crystal display apparatus according to this embodiment of the present invention.

In FIG. 1, reference numeral 101 is a system bus for transferring digital image data and a synchronization (sync) signal. In this embodiment, it should be noted that both the image data and the sync signal transferred via the system bus 101 are such line sequential scanning signals similar to the image data and the sync signal transferred to be displayed on the CRT (cathode-ray tube) display apparatus. Reference numeral 102 denotes a liquid crystal controller for converting the digital image data and the sync signal transferred via the system bus 101 into digital LCD image data and a timing signal for driving the liquid crystal display apparatus. Reference numerals 103, 104, 105 indicate reference voltage lines for transferring reference voltages, in which 103 is a digital drive voltage $V_{EE}$, 104 is a digital-high drive voltage $V_{CC}$, and 105 is DC voltages having various voltage levels of the LCD drive voltage VLCD1. Reference numerals 106 and 107 denote signal drive circuit control buses for transferring both of the digital ICD image data and the timing signal which have been converted for the signal drive circuit under control of the LCD controller 102. Reference numeral 108 is a scanning drive circuit control bus used to transfer a timing signal for a scanning drive circuit. Reference numeral 109 shows an LCD alternating signal which becomes a timing signal for alternating a polarity of a voltage applied to a liquid crystal display, and a drive voltage of the signal drive circuit. Reference numerals 110 and 111 are level sifters for converting voltage levels of the digital LCD image data and the timing signal which are transferred via the respective signal drive circuit control buses 106, 107, into drive voltage levels of the signal drive circuits. Reference numerals 112 and 113 are signal drive circuit control buses for transferring the digital LCD image data and the timing signal whose voltage levels have been shifted by the level sifters 110 and 111. Reference numerals 114 and 115 denote signal drive circuits which fetch the digital LCD image data transferred via the respective signal drive circuit control buses 112, 113 in response to the timing signal, and convert the fetched image data into LCD apply voltages corresponding to the digital LCD image data. Then, the LCD apply voltages are applied to the LCD panel.

Reference numerals 116 and 117 show signal line for transferring the LCD apply voltages produced in the respective signal drive circuits 114 and 115. Reference numeral 118 is a scanning drive circuit and reference numeral 119 is a scanning line. The scanning drive circuit 118 sequentially causes the scanning line 118 to be active in response to the timing signal transferred via the scanning drive circuit control bus 108. Reference numeral 120 is a liquid crystal display panel. Reference numeral 121 is a reference DC voltage producing circuit for producing various DC reference voltages used to operate this LCD apparatus. Reference numeral 122 shows a DC voltage line used to the scanning drive circuit, for applying the DC voltages to the scanning drive circuit 118. Reference numeral 123 denotes a common (opposing) electrode line for transferring a DC common voltage. Reference numeral 124 is a reference DC voltage line for signal drive circuit, and reference numeral 125 is another reference DC voltage line for signal drive circuit. Reference numeral 126 shows an AC circuit. Reference numeral 127 indicates a reference voltage line for transferring a high-level reference voltage used to drive the upper-sided signal drive circuit 114, and similarly reference numeral 128 is a reference voltage line for transferring a high-level reference voltage used to drive the lower-sided signal drive circuit 115. Reference numeral 129 shows a reference voltage line for transferring a low-level reference voltage used to drive the upper-sided signal drive circuit 114, and similarly reference numeral 130 indicates a reference voltage line for transferring a low-level reference voltage used to drive the lower-sided signal drive circuit 115. It should be understood that any of the reference voltages transferred via the reference voltage lines 129 and 130 become reference voltages for the level sifters 110 and 111. Reference numeral 131 denotes an AC circuit. Reference numeral 132 is an LCD drive voltage line used to transfer the AC LCD drive voltage employed in the upper-sided signal drive circuit 114, whereas reference numeral 133 is an LCD drive voltage line used to transfer the AC LCD drive voltage employed in the lower-sided signal drive circuit.

Figure 2:
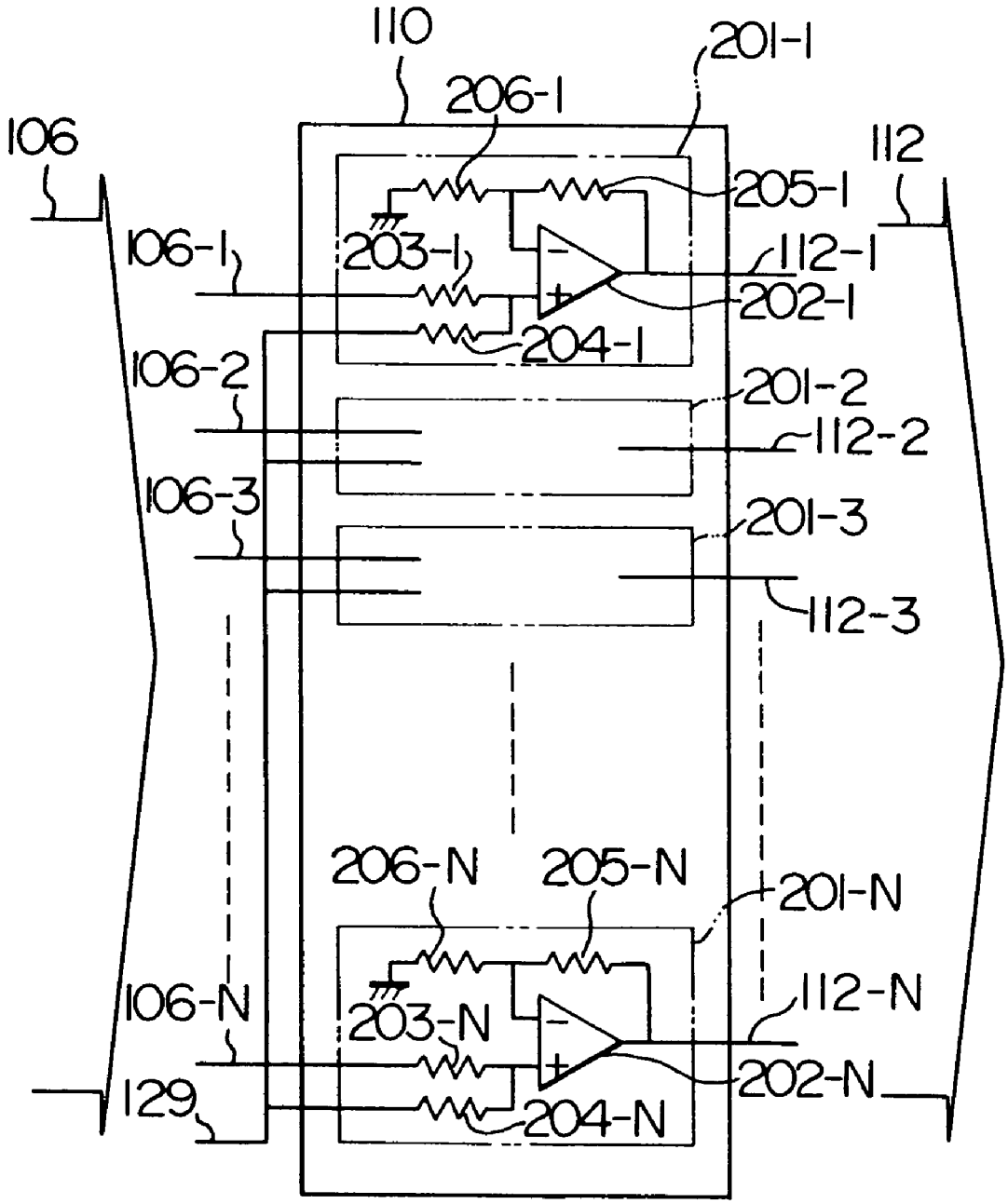
FIG. 2 schematically indicates an internal arrangement of a level sifter according to the present invention.

FIG. 2 is a schematic block diagram of the level sifter 110 shown in FIG. 1, according to an embodiment of the present invention.

In FIG. 2, reference numerals 201-1 to 201-N indicate adder circuits for constituting the level sifter 110. The level sifter 110 owns the adder circuits 201-1 to 201-N, the number of which is equal to that of the signal lines for the signal drive circuit control bus 106. In this embodiment, two adder circuits 201-1 to 201-2 are prepared for the sync signals, and (N−2) adder circuits 201-3 to 201-N are prepared for the digital LCD image data. It should be noted that the level sifter 111 has a similar circuit arrangement to that of this level sifter 110. Reference numeral 202-1 indicates an amplifier and reference numerals 203-1, 204-1, 205-1, 206-1 show resistors. Among the signal drive circuit control bus 106, the control bus 106-1 is to transfer the shift clock, the control bus 106-2 is to transfer the latch clock, and reference numerals 106-3 to 106-N are LCD image data buses transferring the digital LCD image data. A bus 112-1 is to transfer a latch clock after being level-shifted, a bus 112-2 is to transfer a latch clock after being level-shifted, and reference numerals 112-3 to 112-N indicate LCD image data buses for transferring the digital LCD image data after being level-shifted. The voltage levels of the signals outputted from the adder circuits 201-1 to 201-N are equal to voltage values obtained by adding the reference voltage transferred via the reference voltage line 129 to the voltage levels of the input signals. As a result, the amplitudes of the voltage values of the signals representative of "1" and "0", outputted from the adder circuits 201-1 to 201-N are equal to those of the voltage values of the signals indicative of "1" and "0" inputted to the adder circuits 201-1 to 201-N.

Figure 3:
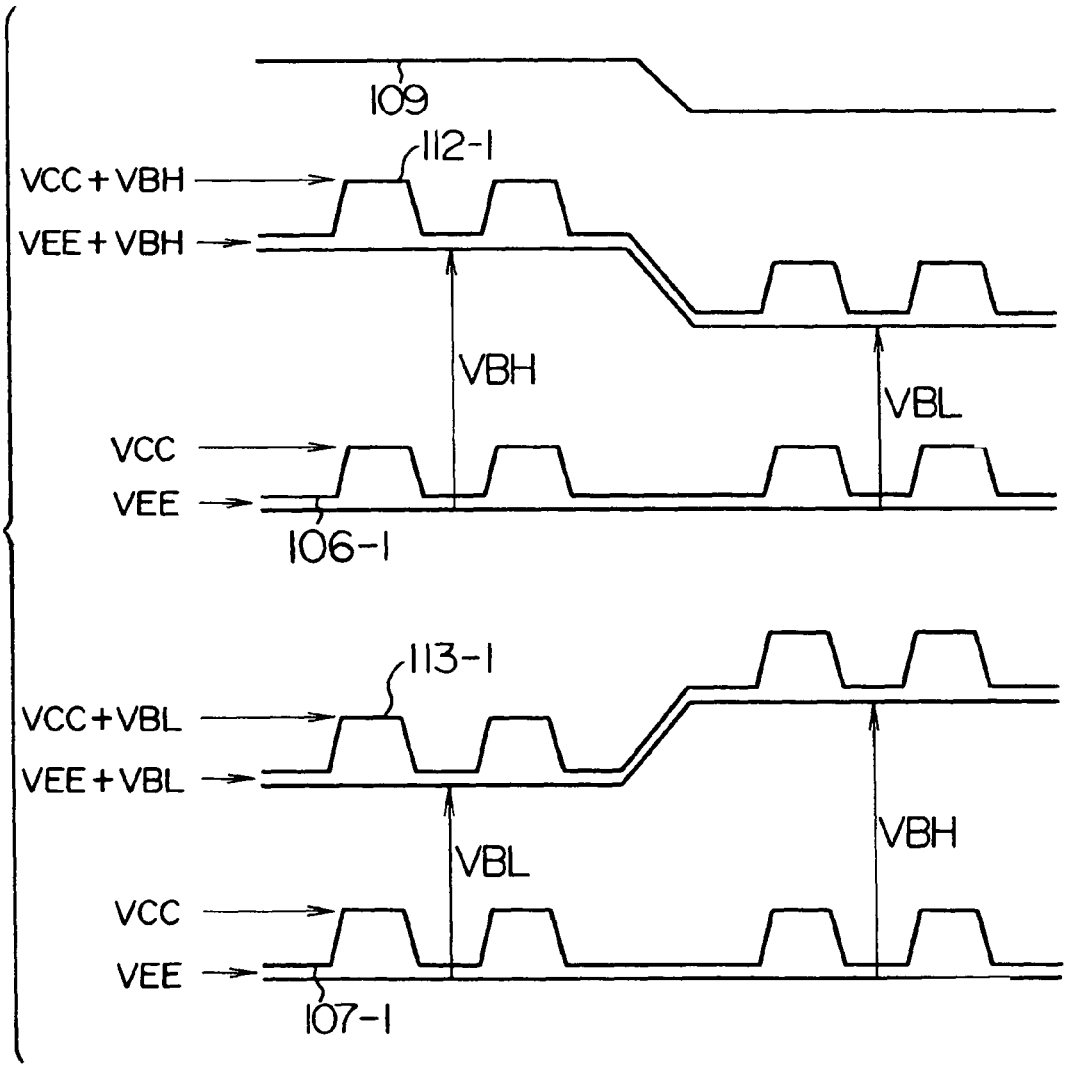
FIG. 3 is a timing circuit for indicating operation of the level sifter according to the present invention.

In FIG. 3, there is shown such a condition that the voltage levels are converted by the level sifters 110 and 111. It is assumed that voltage values indicative of "1" of the latch clocks 106-1 and 107-1 are "VCC", and voltage values representative of "0" thereof are "VEE". In other words, a low-level voltage transferred via the reference voltage line 103 is VEE, and a digital high level transferred via the reference voltage 104, namely a voltage of a digital drive level is VCC. Also, high-potential voltage values of the reference voltage lines 129 and 130 are VBH with respect to VEE, and low-potential voltage values thereof are VBL with regard to VEE.

Figure 4:
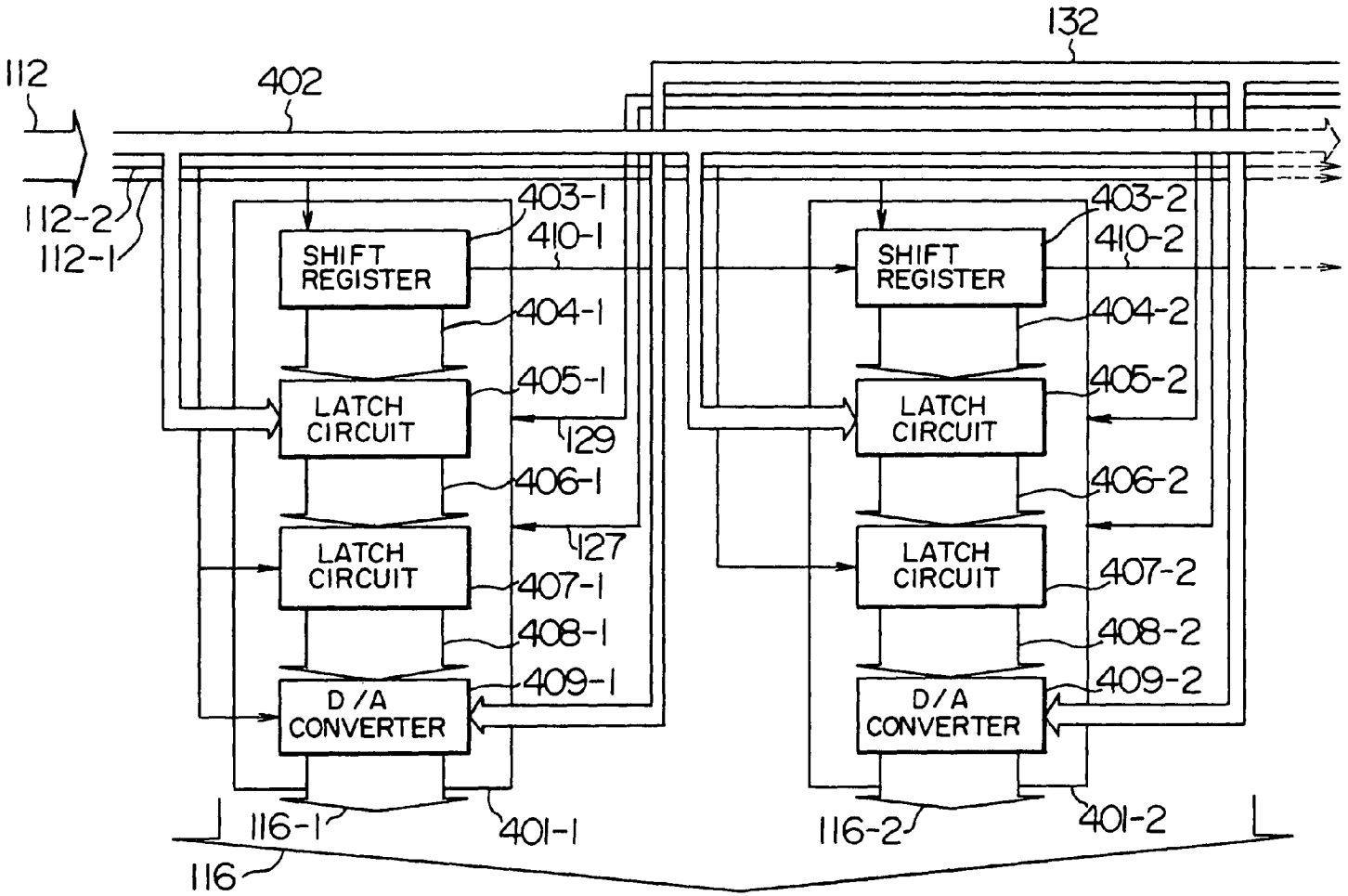
FIG. 4 is a schematic block diagram for showing a signal drive circuit according to an embodiment of the present invention.

FIG. 4 is a schematic block diagram for showing an internal circuit arrangement of the signal drive circuit 114 of FIG. 1 according to one embodiment of the present invention. It should be understood that the signal drive circuit 115 provided at the low side of the LCD panel 120 has a similar circuit arrangement to that of this signal drive circuit 114.

In FIG. 4, reference numerals 401-1, 401-2, - - - , denote drain drivers, and the signal drive circuit 114 is constructed of a plurality of drain drivers 401. It should also be noted that the signal drive circuit 115 provided at the lower side of the LCD panel 120 shown in FIG. 1 is similarly arranged by a plurality of drain drivers. The drain driver 401 has a function such that the digital LCD image data is inputted and converted into the LCD apply voltage which will then be outputted to the LCD panel 120. In the signal drive circuit control bus 112, reference numeral 402 is an LCD image data bus, and a generic name for representing the LCD image data buses 201-2 to 201-N shown in FIG. 2. Furthermore, reference numeral 112-1 is a shift clock, and reference numeral 112-2 is a latch clock. The shift clock 112-1 is synchronized with the digital LCD image data transferred via the LCD image data bus 402. The latch clock 112-2 becomes active after the digital LCD image data for 1 horizontal line have been transferred to the signal drive circuits 114 and 115. Reference numeral 403 indicates a shift register, and reference numeral 404 represents a latch signal. In response to the shift clock 112-1, the shift register 403 performs the shift operation. In accordance with this shift operation, the latch signals 404 are sequentially valid. Reference numeral 405 is a latch circuit which sequentially latches the digital LCD image data transferred via the LCD image data bus 402 in response to the latch signal 404. Reference numeral 406 is a data bus for transferring the data latched by the latch circuit 405. Reference numeral 407 is a latch circuit for latching the data transferred via the data 406 in response to the latch clock 112-2. Reference numeral 408 is a data bus for transferring the data latched by the latch circuit 407. Reference 409 denotes a digital-to-analog converting circuit for converting the digital data transferred via the data bus 408 into the LCD apply voltage based on the LCD drive voltage transferred via the LCD drive voltage line 132. Reference numeral 116 is a signal line used to transfer the LCD apply voltage produced by the D/A converting circuit 409. Reference numeral 410 is an enable signal which corresponds to such a control signal that when the fetching operation of the digital LCD image data by the latch circuit 403 has been accomplished, namely when the shift operation by the shift register 403 has been completed, the shift register 403 of the drain driver 401 at the subsequent stage is operated so as to commence the fetching operation of the digital LCD image data by the latch circuit 405 of the drain driver 401 at the subsequent stage.

In the drain driver 401, any of the digital circuit units for the shift register 403, the latch circuit 405 and the latch circuit 407, and also the D/A converting circuit 409 are driven under the high-level reference voltage transferred via the reference voltage line 127 and the low-level reference voltage transferred via the reference voltage line 129.

Figure 5:
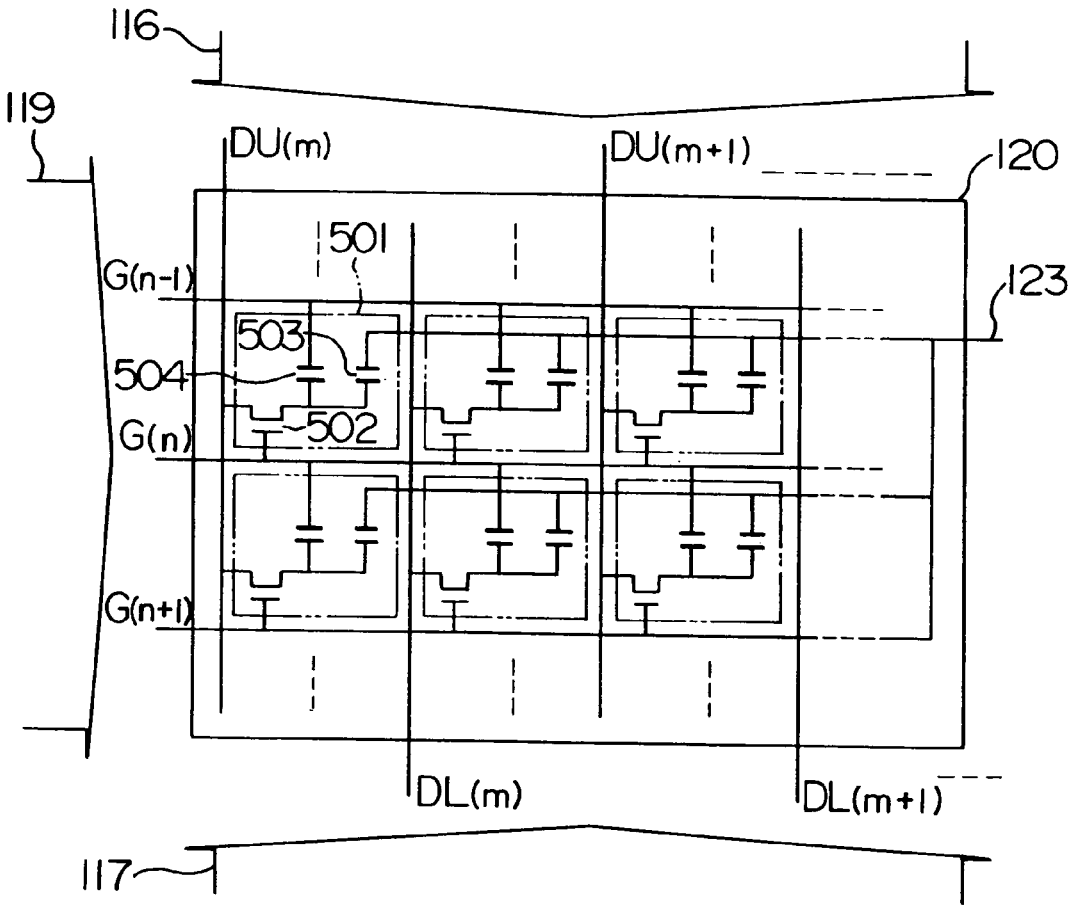
FIG. 5 shows an equivalent circuit of a liquid crystal display panel according to one embodiment of the present invention.

FIG. 5 shows an equivalent circuit diagram of the liquid crystal display panel 120 shown in FIG. 1.

In FIG. 5, symbols DU(m), DU(m+1), DL(m) and DL(m+1) represent signal lines corresponding to pixel units for constituting signal lines 116 and 117. Symbols G(n−1), G(n), G(n+1) denote scanning lines corresponding to the respective pixel units for constituting a scanning line 119. Reference 501 shows a pixel unit. In the pixel unit 501, reference numeral 502 is a thin-film transistor (abbreviated as "TFT"), reference numeral 503 is a liquid crystal display, and reference numeral 504 is an added capacitance. A drain electrode of the TFT 502 is connected to the signal line 116, and a gate electrode thereof is connected to the scanning line 119. The drain electrodes of the TFTs 502 employed within the respective pixel units 501 arranged along the vertical direction commonly use the signal line, for instance, DU(m). The gate electrodes of the TFTs 502 employed in the respective pixel units 502 arranged along the horizontal direction commonly use the scanning line, for example, G(n). Furthermore, the source electrodes of the TFTs 502 are connected to one electrode of each of the liquid crystal display 503 and the added capacitance 504. The other electrode of the liquid crystal display 503 is connected to a common electrode line 123, and all pixels thereof commonly utilize the common electrode line 123. One electrode of the added capacitance 504 is connected to the scanning line provided at the pre stage. For example, in case of the added capacitance 504 connected to the TFT 502 under control of the scanning line G(n), the electrode is connected to the scanning line G(n−1).

Even if another electrode of the added capacitance 504 is connected to a newly employed electrode line (not shown in this embodiment), other circuits and the drive conditions shown in FIG. 1 are the same as those above except that a voltage applied to the newly provided electrode line is selected to be equal to the common electrode voltage applied to the common electrode line 123. Furthermore, even when no added capacitance 504 is provided in the pixel unit 501, other circuits and the drive conditions shown in FIG. 1 are the same as those above.

As described above, this LCD panel 120 is constructed of a matrix structure having a plurality of pixel units 501 along the horizontal direction and the vertical direction. For instance, when a screen with 640 pixels in horizontal resolution and 480 lines in vertical resolution is displayed, the horizontal resolution of 640 pixels can be realized by arranging 1920 pixels along the horizontal direction, and attaching red, green, blue color filters to three adjacent pixels to constitute 1 pixel. Furthermore, the 480 pixel arrangements as explained with regard to the horizontal direction are prepared for the vertical direction, thereby obtaining the vertical resolution of 480 lines. In this embodiment, the LCD panel 120 is so arranged that the signal lines of the adjacent pixel units 501 are alternately drawn as a signal line 116 and a signal line 117. It should be noted that even when the signal line 116 and the signal line 117 are alternately drawn in a pixel alternating form, the LCD controller 102 shown in FIG. 1 merely performs the data conversion in conformity to this pixel alternating form, but other circuit arrangements and the drive conditions are similar to those of this embodiment.

Figure 6:
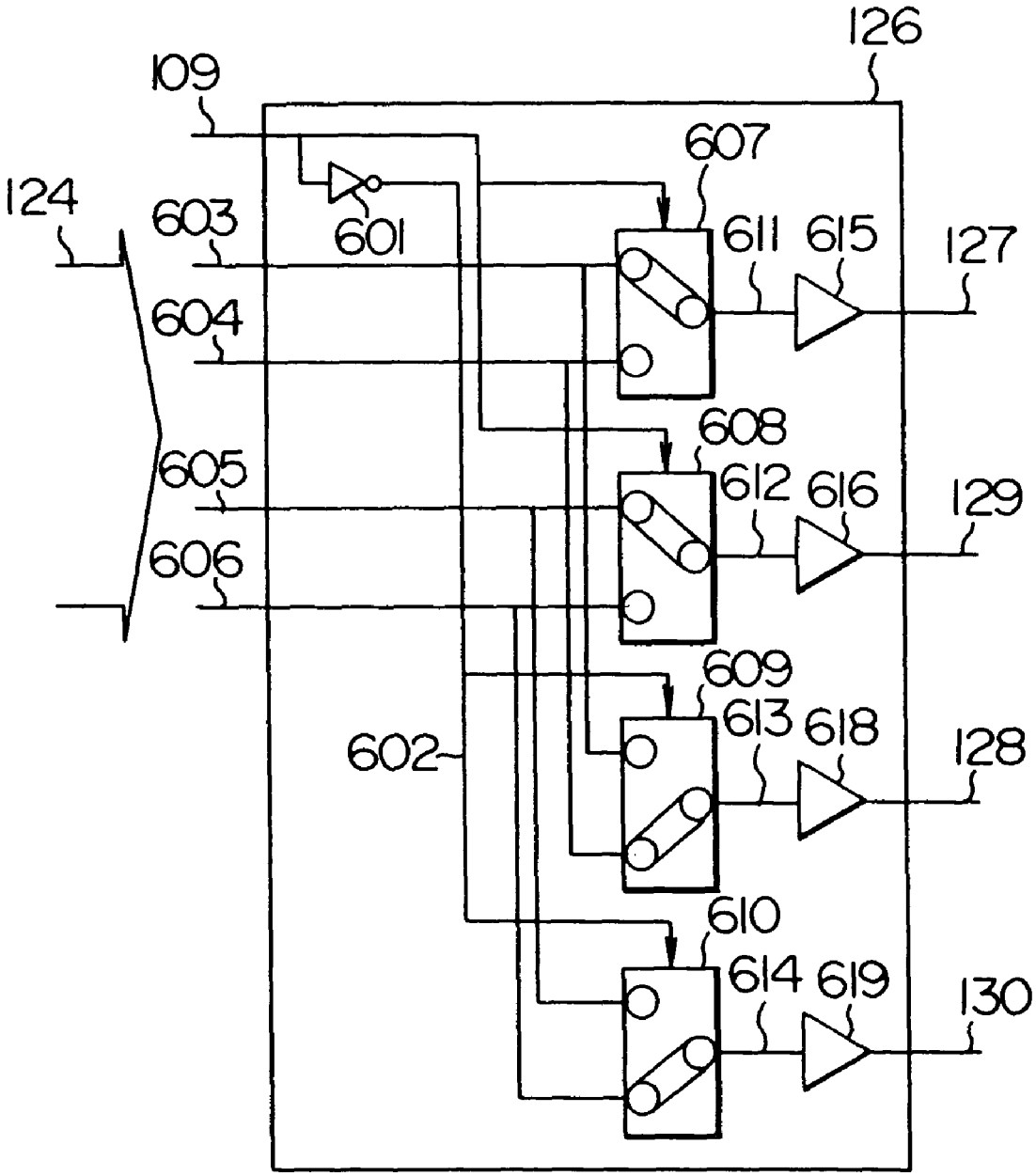
FIG. 6 is a schematic block diagram of an AC circuit according to one embodiment of the present invention.

FIG. 6 is a schematic block diagram for showing an internal circuit of the AC circuit 126 shown in FIG. 1, according to one embodiment of the present invention.

In FIG. 6, reference numeral 601 is an inverter circuit for inverting the polarity of the LCD alternating signal 109. Reference numeral 602 denotes an inverted LCD alternating signal. Reference numerals 603, 604, 605, 606 denote DC voltage lines employed in the signal drive circuit DC reference voltage line 124. In this embodiment, the DC voltage line 603 transfers a voltage VDBHH, the DC voltage line 604 transfers a voltage VDBLH, the DC voltage line 605 transfers a voltage VDBHL, and the DC voltage line 606 transfers a voltage VDBLL.

Reference numerals 607, 608, 609, 610 show voltage selectors for alternately changing the inputted DC voltage to an AC voltage. Reference numerals 611, 612, 613, 614 denote voltage lines for transferring the AC voltages outputted from the respective voltage selectors 607, 608, 609, 610. Reference numerals 615, 616, 617, 618 are amplifier circuits having role to emphasize the drive capabilities of the AC voltages outputted from the respective voltage selectors 607, 608, 609, 610.

Figure 7:
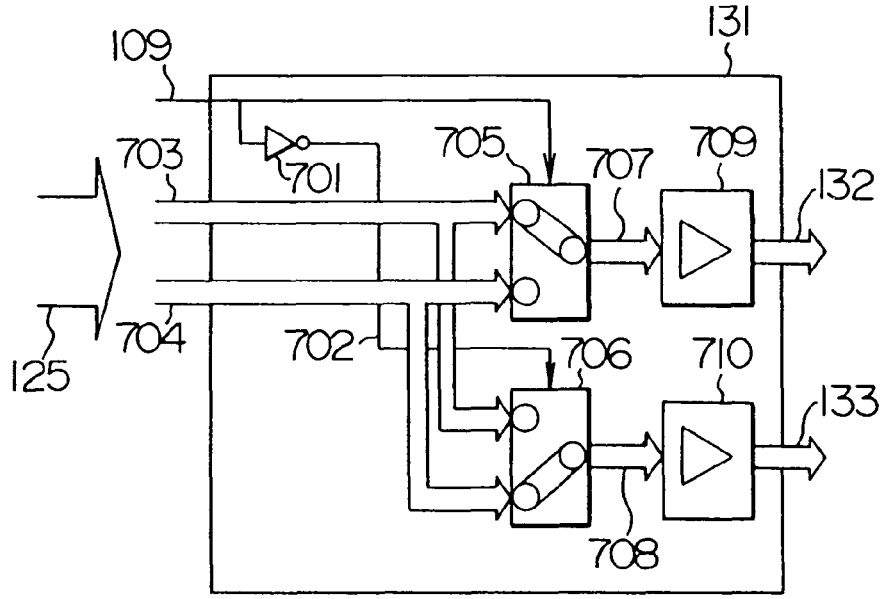
FIG. 7 is a schematic block diagram of an AC circuit according to an embodiment of the present invention.

FIG. 7 is a schematic block diagram for showing an internal circuit arrangement of the AC circuit 131 shown in FIG. 1, according to an embodiment of the present invention.

In FIG. 7, reference numeral 701 denotes an inverting circuit for inverting the polarity of the LCD alternating signal 109. Reference numeral 702 shows an inverted LCD alternating signal. Reference numeral 703 shows a signal-drive-circuit DC LCD drive voltage line for transferring a voltage with a positive polarity with respect to the common electrode voltage appearing on the common electrode line 123 shown in FIG. 1, and similarity reference numeral 704 denotes a signal-drive-circuit DC LCD drive voltage line for transferring a voltage with a negative polarity. Reference numeral 705 is a voltage selector for the signal drive circuit 114, and reference numeral 706 is a voltage selector for the signal drive circuit 115. Reference numerals 707 and 708 show voltage lines for transferring the alternating LCD drive voltages for the signal drive circuit, which are produced by the selecting operations of the respective voltage selectors 705 and 706. Reference numerals 709, 710 are amplifier circuits having role to emphasize the drive capabilities of the LCD drive voltages for the signal drive circuits 114, 115, which are produced by the voltage selectors 705 and 706.

Figure 8:
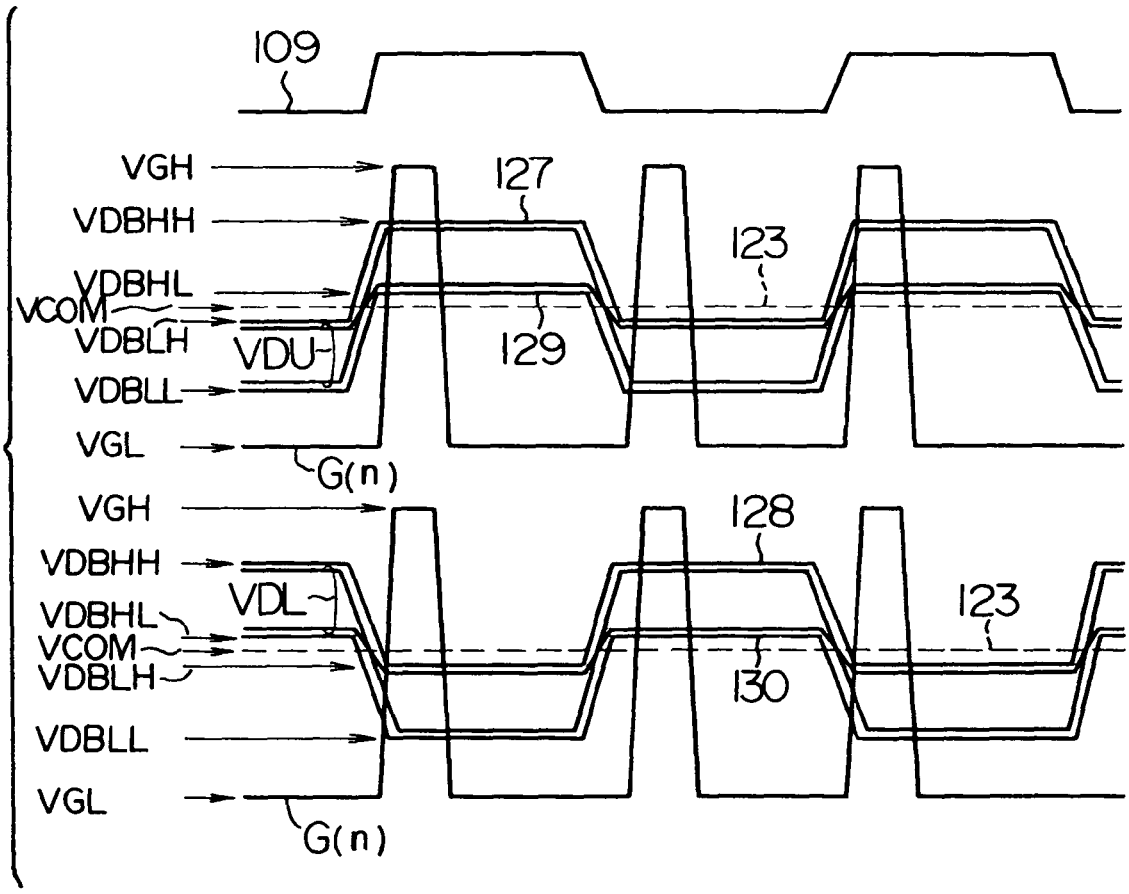
FIG. 8 shows drive waveforms (frame AC) of the liquid crystal display apparatus according to the present invention.

FIG. 8 represents voltage waveforms produced when the LCD display apparatus shown in FIG. 1 is driven. It should be noted that this voltage waveform indicates the frame AC drive in which the polarity of the voltage applied to the LCD is changed for 1 frame.

In FIG. 8, symbol VG(n) denotes a voltage waveform of the scanning line G(n) shown in FIG. 5. Symbol VGH denotes a selective voltage level of the scanning line 119 and VGL represents a non-selective voltage level thereof. Symbol VCOM is a voltage value of a common electrode 123. Symbol VDBHH denotes a voltage level when the signal drive circuit 114 is operated in the positive potential region among the voltage waveforms of the high-level reference voltage line 127, and this voltage level is equal to that of the DC voltage line 603 shown in FIG. 6. Symbol VDBLH is a voltage level when the signal drive circuit 114 is operated in the negative potential region among the voltage waveforms of the high-level reference voltage line 127, and this voltage level is equal to the voltage level of the DC voltage line 604 shown in FIG. 16. Symbol VDBHL among the voltage waveforms of the low-level reference voltage line 128 represents a voltage level when the signal drive circuit 114 is operated within the positive potential region, and this voltage level is equal to the voltage level of the DC voltage line 605 shown in FIG. 6. Furthermore, symbol VDBLL among the voltage waveforms of the low-level reference voltage line 130 is voltage level when the signal drive circuit 114 is operated in the negative potential region, and this voltage level is equal to the voltage level of the DC voltage line 606 shown in FIG. 6. The voltage level of the high-level reference voltage line 128 is similar to the voltage level of the high-level reference voltage line 127, the phases of which are opposite to each other. Furthermore, the voltage level of the low-level reference voltage line 130 is similar to that of the low-level reference voltage line 129, the phases of which are opposite to each other, outputted from the respective signal lines 116 and 117 in this embodiment.

Figure 9:
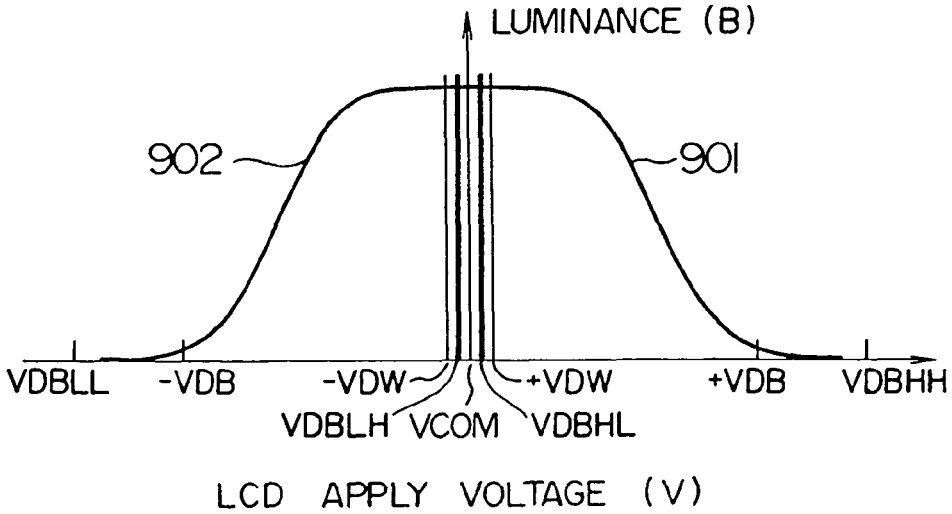
FIG. 9 is a graphic representation of a voltage-luminance characteristic of a liquid crystal display.

FIG. 9 is a graphic representation of a relationship between luminance and a voltage of the liquid crystal display employed in this embodiment.

In FIG. 9, an ordinate indicates luminance and an abscissa shows an LCD apply voltage. Reference numeral 901 shows a luminance-voltage characteristic when a positive LCD voltage is applied, and reference numeral 902 shows a voltage-luminance characteristic when a negative LCD voltage is applied. The liquid crystal display owns such a characteristic that even when any of voltages having a positive polarity and a negative polarity with respect to the common electrode voltage VCOM are applied, if absolute values of these voltages are equal to each other, then similar luminance representations are realized. In this embodiment, when the value of the LCD apply voltage is small, namely when the LCD apply voltage is approximated to the voltage value of the opposite electrode 123 (for instance, voltage +VDW and voltage −VDW), there is such a characteristic that luminance is high, and this luminance may be lowered every time any of the positive apply voltage and the negative apply voltage are increased.

Figure 10:
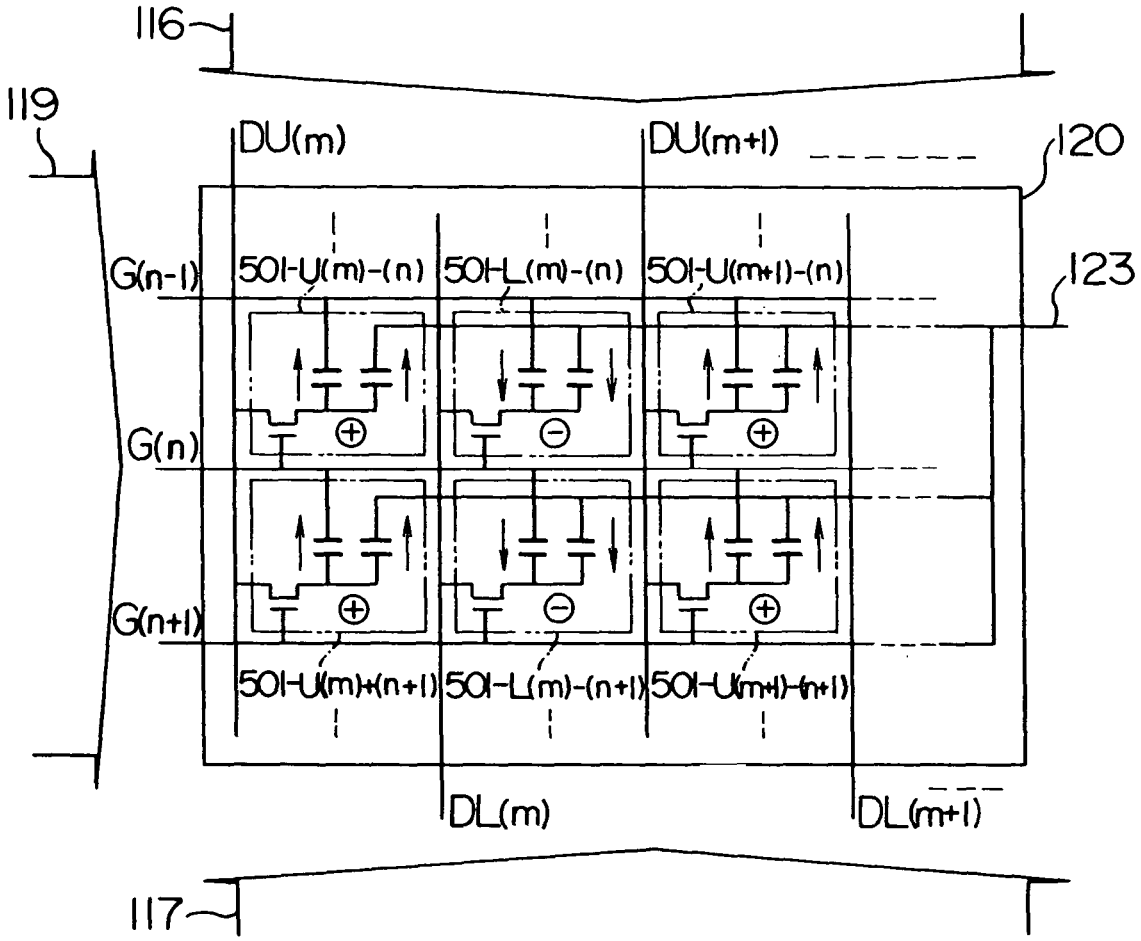
FIG. 10 schematically shows an equivalent circuit of the liquid crystal panel according to the present invention, in which current directions are indicated.

FIG. 10 explanatorily shows such states that when the LCD panel 120 is driven at the drive timings represented in FIG. 8, either positive-potential voltages, or negative-potential voltages are applied to the respective pixel units, and directions, of currents produced in the pixel units.

Figure 11:
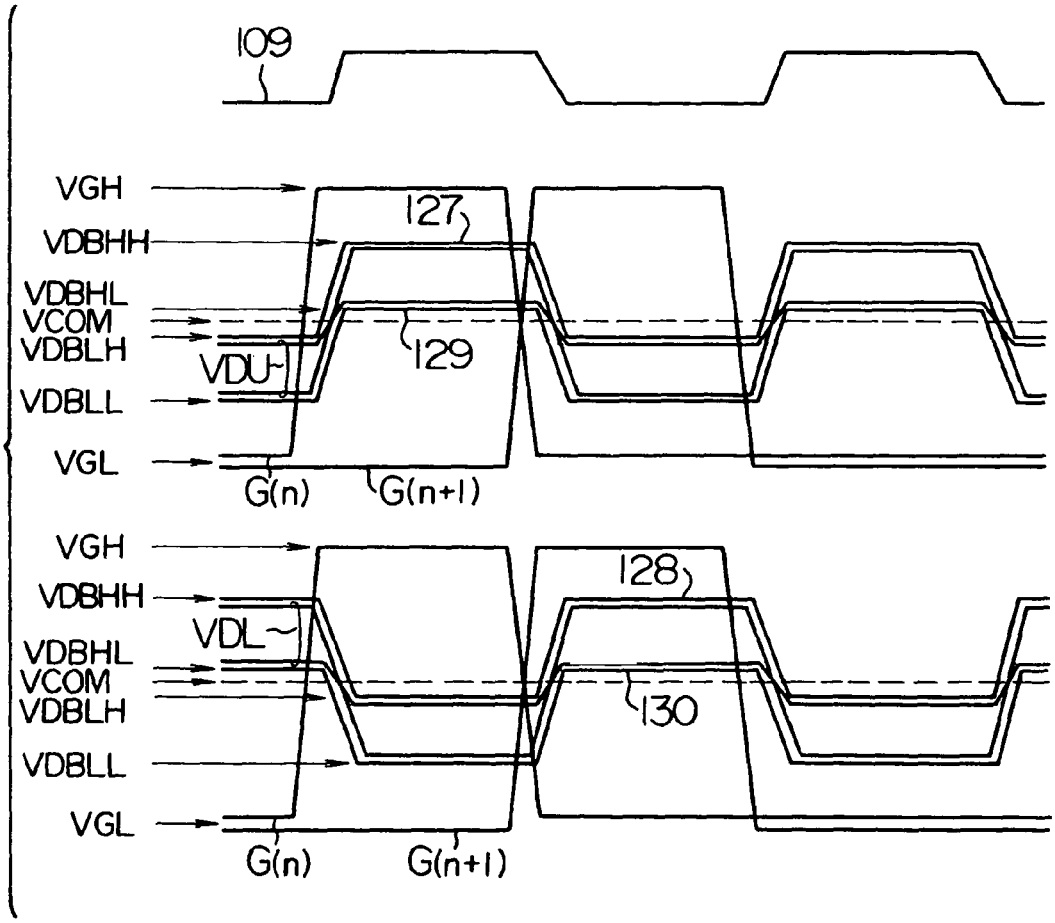
FIG. 11 shows a drive waveform (line AC) of the liquid crystal display apparatus according to the present invention.

FIG. 11 shows voltage waveforms when the LCD display apparatus of FIG. 1 is driven. It should be noted that this voltage waveform represents a line AC drive where the polarity of the voltage applied to the liquid crystal is changed for every line. Symbol VG(n) is a voltage waveform of the scanning line G(n) shown in FIG. 5, and symbol VG(n+1) is a voltage waveform of the scanning line G(n+1).

Figure 12:
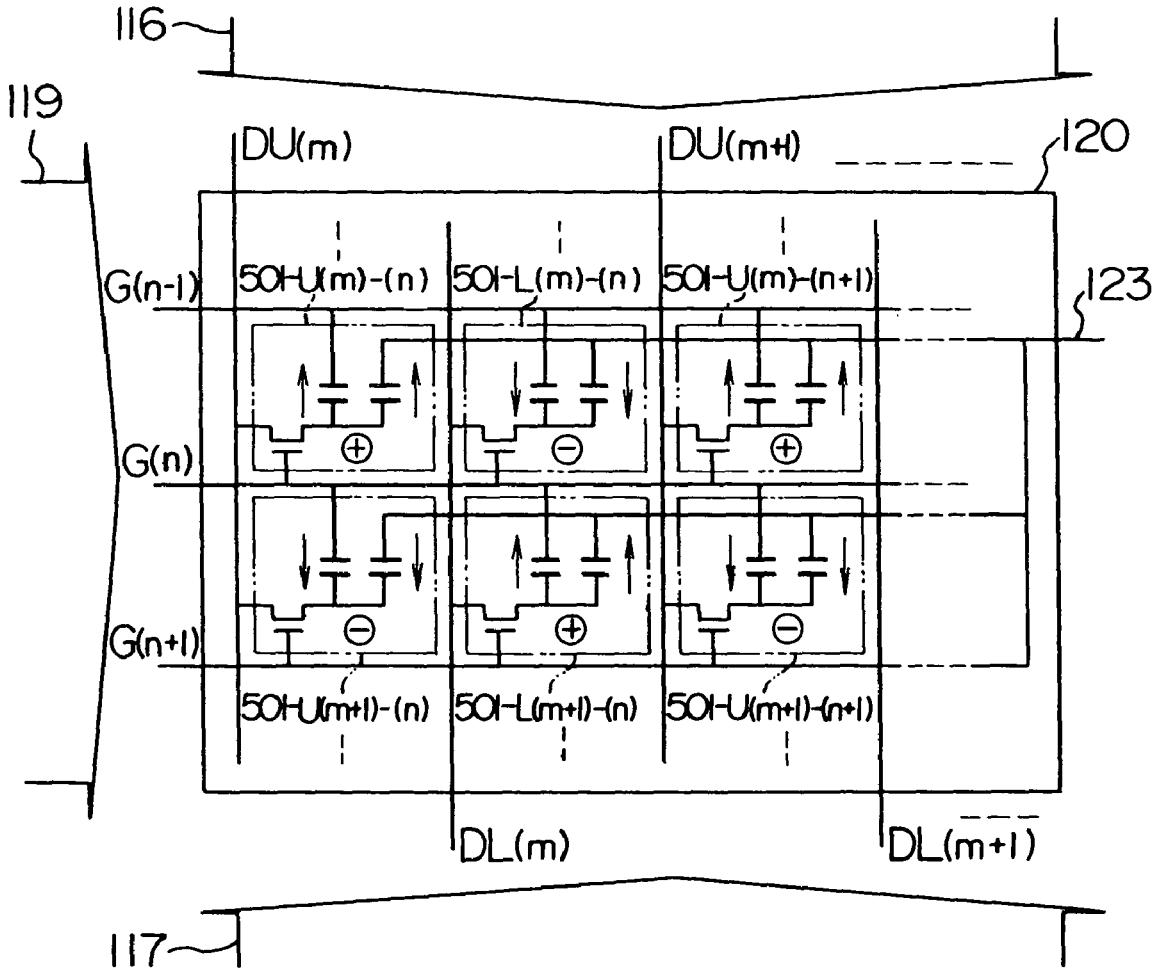
FIG. 12 schematically shows an equivalent circuit of the liquid crystal panel according to the present invention, in which current directions are denoted.

FIG. 12 explanatorily represents such conditions that when the LCD panel 120 is driven at the drive timings shown in FIG. 11, either positive-polarity voltages are applied to the respective pixel units, and directions of currents produced in the pixel units.

Figure 13:
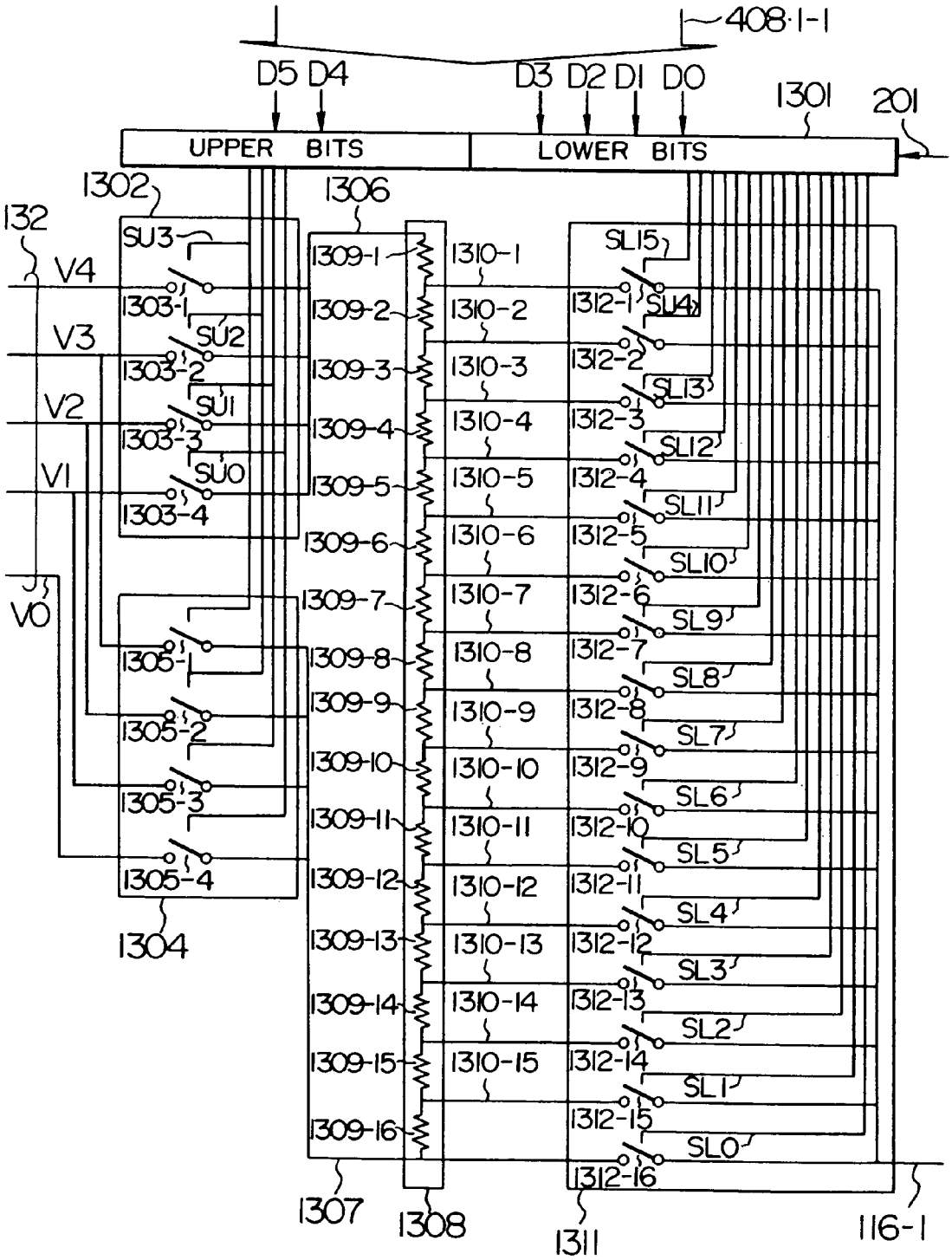
FIG. 13 is a schematic circuit diagram of a digital-to-analog converting circuit of a drain driver according to an embodiment of the present invention.

FIG. 13 is a schematic circuit diagram of the digital-to-analog converting circuit, according to an embodiment of the present invention, employed in the drain driver of FIG. 4. There are provided a plurality of the D/A converting circuits 409 whose number is equal to that of the signal lines 116. In addition, in this embodiment, it is assumed that the number of gradation which can be displayed by a single pixel is 64 under 60 bit digital data.

Reference numeral 408-1 denotes 6-bit digital data with D5, D4, D3, D2, D1 and D0 bits in the order of the upper bit. Reference numeral 1301 indicates a decoder arranged by a decoder for decoding the upper 2 bits data and another decoder for decoding the lower 4 bits data. It should be noted that a truth table of this decoder 1301 is represented in a table 1 (will be discussed).

Referring back to FIG. 13, reference numeral 1302 shows a high-potential voltage selecting circuit, and reference numerals 1303-1, 1303-2, 1303-3, 1303-4 denote analog switches for selecting voltages V4, V3, V2, V1. Reference numeral 1304 indicates a low-potential voltage selecting circuit, and reference numerals 1305-1, 1305-2, 1305-3, 1305-4 are analog switches for selecting voltages V3, V2, V1, V0. Reference numeral 1306 represent a voltage line used to output any of these voltages V4 to V1 selected by the high-potential voltage selecting circuit 1032. Reference numeral 1307 indicates a voltage line used to output any of these voltages V3 to V0 selected by the low-potential voltage selecting circuit 1034. As apparent from the drawing, when the voltage V4 is selected by the high-potential selecting circuit 1032, the voltage V3 is selected by the low-potential selecting circuit 1034, namely a pair of V4 and V3 are selected. Similarly, pairs of V3 and V2, V2 and V1, V1 and V0 are selected by the respective high-potential voltage selecting circuit 1032 and low-potential voltage selecting circuit 1034. Reference numeral 1308 is a series resistor circuit in which 16 resistors 1309-1 to 1309-16 are connected in series to each other. Reference numerals 1310-1 to 1310-15 show voltage lines used to transfer subdivided voltages obtained from this series resistor circuit 1308. Reference numeral 1311 is a voltage selecting circuit and reference numerals 1312-1 to 1312-16 are analog switches. In this embodiment, this circuit arrangement owns only 6 bits luminance information per unit pixel. Alternatively, if the bit number is increased, the number of these circuits may be simply increased in conformity of the bit number.

Furthermore, although the digital-to-analog converting circuit 409 of FIG. 4 employs the circuit system of FIG. 13 in the embodiment of FIG. 1, other circuit systems may be employed by fitting the LCD drive voltage generated from the AC circuit 131 to the D/A converting circuit 409 under the same drive conditions.

Table 1 is a truth table for representing decode controls by the decoder 1301 shown in FIG. 13.

TABLE 1

| higher bit decoding | | | lower bit decoding | | | | |
|---|---|---|---|---|---|---|---|
| data | | valid decode | data | | | | valid decode |
| D5 | D4 | signal | D3 | D2 | D1 | D0 | signal |
| 1 | 1 | SU3 | 1 | 1 | 1 | 1 | SL15 |
| 1 | 0 | SU2 | 1 | 1 | 1 | 0 | SL14 |
| 0 | 1 | SU1 | 1 | 1 | 0 | 1 | SL13 |
| 0 | 0 | SU0 | 1 | 1 | 0 | 0 | SL12 |
| | | | 1 | 0 | 1 | 1 | SL11 |
| | | | 1 | 0 | 1 | 0 | SL10 |
| | | | 1 | 0 | 0 | 1 | SL9 |
| | | | 1 | 0 | 0 | 0 | SL8 |
| | | | 0 | 1 | 1 | 1 | SL7 |
| | | | 0 | 1 | 1 | 0 | SL6 |
| | | | 0 | 1 | 0 | 1 | SL5 |
| | | | 0 | 1 | 0 | 0 | SL4 |
| | | | 0 | 0 | 1 | 1 | SL3 |
| | | | 0 | 0 | 1 | 0 | SL2 |
| | | | 0 | 0 | 0 | 1 | SL1 |
| | | | 0 | 0 | 0 | 0 | SL0 |

In Table 1, as the decode results for the upper bits, when D5 and D4 are "11", SU3 becomes active; when D5 and D4 are "10", SU2 becomes effective; when D5 and D4 are "01", SU1 becomes active; and when D5 and D4 are "00", SUO becomes active.

Furthermore, as the decode results for the lower bits, irrelevant to the values of D3, D2, D1, D0, when the latch clock 201-2 becomes valid SL0 become effective. When the latch clock 201-2 is invalid, if D3, D2, D1, D0 are "11111", then SL15 becomes active; if D3, D2, D1, D0 are "1110", then SL14 becomes active; if D3, D2, D1, D0 are "1100", then SL12 becomes active, and if D3, D2, D1, D are "1011", then SL11 becomes active. If D3, D2, D1, D0 are "1010", SL10 becomes effective; if D3, D2, D1, D0 are "1001", then SL9 becomes active; if D3, D2, D1, D0 are "1000", then SL8 becomes effective; if D3, D2, D1, D0 are "0111", then SL7 becomes active; if D3, D2, D1, D0 are "0110", then SL6 becomes effective; if D3, D2, D1, D0 are "0101", then SL5 becomes active; if D3, D2, D1, D0 are "0100", then SL4 becomes active; if D3, D2, D1, D0 are "0011", then SL3 becomes effective; if D3, D2, D1, D are "0010", then SL2 becomes active; and if D3, D2, D1, D0 are "0001", then SL1 becomes effective; and also if D3, D2, D1, D0 are "0000", then SL0 becomes active.

Referring again to FIGS. 1 to 13 and table 1, operations of the liquid crystal display apparatus according to the embodiment of the present invention will now be described.

In FIG. 1, the digital image data transferred via the system bus 101 is converted through the LCD controller 102, the level shifters 110, 111, and the signal drive circuits 114, 115 into the LCD apply voltage. The LCD apply voltage is outputted to the LCD-panel 120 for display purposes. In the LCD controller 102, the digital display data inputted via the system bus 101 is converted into the sync signal in order to be fitted to the input interfaces of the signal drive circuits 114 and 115 and the pixel arrangement of the LCD panel 120, and then the sync signal is outputted via the signal drive circuit control buses 106 and 107.

Here, there is a problem that the drive voltage levels of the digital LCD image data and the signals which are transferred via the signal drive circuit control buses 106 and 107, are different from the dive voltage levels of the signal drive circuits 114 and 115.

That is to say, as shown in the voltage-luminance characteristic diagram of FIG. 9, the liquid crystal display owns similar luminance displays to each other even when a positive-polarity voltage and a negative-polarity voltage are applied thereto with respect to the common electrode voltage VCOM, if absolute values thereof are equal to each other. Furthermore, there is a problem that when a DC voltage is applied to the liquid crystal display, deterioration thereof may occur. Therefore, the DC voltage applied to the liquid crystal display must be alternately changed in a certain period. As illustrated in FIGS. 10 and 12, such a control operation is required that the polarities of the voltages applied to the respective pixel units are not identical to each other along the horizontal line direction.

Then, with respect to the LCD apply voltages transferred via the signal lines 116, 117 of the signal drive circuits 114 and 115 shown in FIG. 1, since the common electrode voltage VCOM for controlling the common electrode line 123 is a DC voltage, the voltages of VDU and VDL shown in FIGS. 8 and 11 are required for displaying the image data on the LCD panel 120. However, as shown in FIG. 4, in the drain driver 401, any of the digital unit and the digital-to-analog converting circuit 409 must be driven by the common low voltage (VDD-VEE) as the reference voltage. Then, if the reference voltage would be fixed, then such a necessary LCD apply voltage cannot be applied to the LCD panel 120.

Thus, as represented in the drive waveforms of FIG. 8 and FIG. 11, the reference voltage lines 127, 128, 129, 130 alternately change the reference voltage in accordance with the LCD apply voltages VDU, VDL generated by the signal drive circuits 114, 115, so that the necessary voltage levels of these LCD apply voltages can be obtained.

However, since the drive voltage levels are varied by alternately changing the reference voltages of the signal drive circuits 114, 115, it is required to similarly change the drive voltage levels of the various signals inputted into the signal drive circuits 114 and 115. In this embodiment, the voltages transferred by the reference voltage lines 129 and 130 are added to the digital LCD image data and the timing signal transferred via the signal drive circuit control buses 106, 107 in the level shifters 110, 111, and then the level-shifted image data and timing signal are outputted to the signal drive circuit control buses 112, 113. With reference to FIGS. 2 and 3, a detailed operation will now be described such that the drive voltage levels of the digital LCD display data and timing signal, which are transferred via the signal drive circuit control buses 106, 107, are shifted by the level shifters 110, 111 and then the resultant image data and timing signal are outputted to the signal drive circuit control buses 112 and 113.

In FIG. 2, in the level shifter 110, there are provided the adder circuits 201-1 to 201-N, the number of which is equal to that of the signal lines for the signal drive circuit control bus 106. In the adder circuit 201, when the resistance values of the respective resistors 203, 204, 205, 206 are identical to each other, the voltage level appearing at the output 112 becomes such a value obtained by adding the voltage level transferred via the reference voltage line 129 to the voltage level indicative of the input signal 106. This condition will now be explained with reference to FIG. 3. In accordance with LCD alternating signal, the voltage value of the reference voltage line 129 for the level shifter 110 is increased by the high-potential voltage value VBH, and the voltage value of the reference voltage line 130 for the level shifter 111 is increased by the low-potential voltage value VBL with respect to the voltage VEE. As a result, when the LCD alternating signal 109 is "1", for the shift clock 112-1 after being level-sifted, the voltage value indicative of "1" becomes VCC+VBH, and the voltage value indicative of "0" becomes VEE+VBH. Similarly, when the LCD alternating signal 109 becomes "0", for the shift clock 112-1 after being level-shifted, the voltage value indicative of "1" becomes VCC+VBL, and the voltage-value indicative of "0" becomes VEE+VBL. For the shift clock 112-1 after being level-shifted, a voltage difference between the voltage difference between the voltage difference between the voltage value indicative of "1" and the voltage value indicative of "0" is VCC−VEE, which is equal to a voltage difference between the voltage values indicative of "1" and "0" of the input shift clock 106-1. Thus, when the LCD alternating signal 109 becomes 1, the voltage VBH is added to the voltage value after being level-shifted, and when the signal 109 becomes 0, the voltage VBL is added to this voltage value. Also, any one of the latch clock 112-2 and the digital LCD image data 112-2 to 112-N shown in FIG. 2, The level shifter 111 of FIG. 1 has a similar construction to that of the level shifter 110 of FIG. 2, and when the LCD alternating signal 109 becomes "0", the voltage VBH is added to the voltage value after being level-shifted, whereas when this LCD alternating signal 109 becomes "1", the voltage VBL is added to the voltage value after being level-shifted.

The drive voltage levels of the digital LCD display data and the timing signal which are transferred via the signal drive circuit control buses 112 and 113, are coincident with those of the signal drive circuits 114 and 115 by the level shifters 110 and 111, whereby a normal operation can be performed.

Both of the digital LCD image data and the timing signal which have been level-shifted by the level shifters 110 and 111, are entered into the signal drive circuits 114 and 115 so as to be converted into the LCD apply voltages. This condition will now be explained with reference to FIG. 4.

In FIG. 4, the shift register 403-1 starts its operation in the drain driver 401-1 in response to the shift clock 112-1, so that the latch signal 404-1 successively becomes valid. The storage circuit in the latch circuit 405-1 corresponding to the valid latch signal 404-1 sequentially latches the digital LCD image data transferred via the display data bus 402. The latched data is outputted to the data bus 406-1. When the data latch operation by the storage circuit in the latch circuit 405-1 is completed, namely when the shift operation by the shift register 403-1 is accomplished, the shift register 403-1 causes the enable signal 410-1 to be valid. When the enable signal 410-1 becomes effective, the shift register 403-2 within the drain driver 401-2 at the next stage commences its operation. Then, the latch circuit 405-2 sequentially latches the data which have been latched by the latch circuit 405-1 in the drain driver 401-1. Furthermore, when the data latch operation by the storage circuit in the latch circuit 405-2 is completed, the enable signal 410-2 becomes valid, and the drain driver 401 provided at the subsequent stage performs its operation similar to that of the drain drivers 401-1 and 401-2. As the respective drain drivers employed in the signal drive circuits 114 and 115 perform the above-described operations, the LCD image data for 1 horizontal line can be fetched. After the LCD image data for 1 horizontal line have been acquired into the latch circuit 405 in the respective drain drivers 401, the latch clock 112-2 becomes valid, and the data for 1 horizontal line which have been stored in the latch circuit 405 and are transferred via the data bus 406 of the respective drain drivers 401, are latched into the latch circuit 407 at the same time. After the data have been stored in the latch circuit 407, both of the shift register 403 and the latch circuit 405 of the respective drain driver 401 commence operations similar to the above-described operations in order to latch the data at the next line. The data stored in the latch circuit 407 is transferred via the data bus 408 to the D/A converting circuit 409 by which the LCD apply voltage corresponding to the digital data is produced based on the LCD drive voltage transferred by the LCD drive voltage line 132, which will then be outputted via the signal line 116.

Referring now to FIG. 13, the generating operation of the LCD apply voltage by the D/A converting circuit 406 will now be described more in detail.

In FIG. 13, 6-bit digital data transferred via the data line 408-1-1 is inputted into the decoder 1301, whereby any one of the decode signals SU3 to SU0 is made valid by values of the upper 2-bit data D5 and D4. When the latch clock 112-2 becomes effective, the decode signal SL0 is made valid irrelevant to the value of the lower 4-bit data D3, D2, D1, D0. When the latch clock 112-2 becomes invalid, any one of the decode signals SL15 to S10 is mad valid, depending upon the values of the lower 4-bit data D3, D2, D1, D0. A concrete operation will now be made when the 6-bit digital data transferred via the data line 408-1-1 is "101100". Since the upper 2 bits data are "10", the decode signal SU2 becomes valid, the analog switch 1303-2 becomes an ON state in the high-potential selecting circuit 1302, so that a voltage V3 is outputted to the voltage line 1306. Furthermore, the analog switch 1305-2 become an ON-state in the low-potential selecting circuit 1304, so that the voltage V2 is outputted to the voltage line 1307. The voltages V3 and V2 are entered into the series resistor circuit 1308, so that the voltages divided by the internal resistors 1309-1 to 1309-16 are outputted from the voltage line 1310-1 to the voltage lines 1310-15 and 1307. Furthermore, since the decode signal SL0 is made valid for a period during which the latch clock 112-2 becomes effective in the lower-bit decoders, the analog switch 1312-16 is brought into an ON state, and the voltage V2 transferred via the voltage line 1307 is outputted to the signal line 116-1-1. Thereafter, since the decode signal SL12 becomes effective during a period after the latch clock 2102-2 has been valid, the analog switch 1312-14 becomes an ON state, and then the voltage (V2+(V3−V2)×12/16) transferred via the voltage line 1310-4 is outputted to the signal line 116-1-1. This voltage (V2+(V3−V2)×12/16) is an LCD apply voltage corresponding to the digital data "101100". As described above, changing of the voltages in the periods during the latch clock 112-2 becomes valid and invalid, may become an effective means for improving the drive capabilities. In other words, since the voltage V2 outputted in the period during which the latch clock 112-2 becomes effective, is such a voltage obtained through the analog switches 1305-2 and 1312-16 having the low resistance values, the output impedances thereof become low. Under such a condition, a large current may be flown, whereby high drivability can be achieved. However, the voltage (V2+(V3−V2)×12/16) outputted for a period during which the latch clock 112-2 is invalid, corresponds to such a voltage which has been selected by the analog switch 1312-4 via the analog switches 1303-2, 1305-2 having low resistance values, and also all resistors 1309-1 to 1309-16 of the series resistor circuit 1308 having high resistance values. As a result the output impedance becomes high, so that no large current can be flown and therefore low drivability is realized. Assuming now that all of the resistors 1309-1 to 1309-16 within the series resistor circuit 1303 are low resistance values, even under such a condition that the LCD apply voltages have be sufficiently stored in the respective pixel units of the LCD panel 120, the currents flowing into/from the LCD drive voltage line 132 become large, which disturbs low power consumption. As a consequence, the driving method of the present invention for separating into two portions, the period during which the LCD apply voltage is produced and the output voltage level, may improve the drivability. Moreover, as explained in this embodiment, such a method is employed that the LCD drive voltages V4 to V0 are externally supplied from the drain driver 401, and the multi-level voltages are internally produced, whereby even when a noise or the like is more or less inputted into the reference voltages transferred via the reference voltage lines 127, 128, 129, 130 of the drain driver 401, and thus the multi-level voltage is not stable, the output voltages under stable conditions can be produced by externally supplying a stable LCD drive voltage. It should be noted that the signals used to control the decode signals SL15 to SL0 of the low-potential voltage selecting circuit 1303 in the drain driver 401 shown in FIGS. 4 and 13, may be such a signal capable of controlling the decode signals other than the latch clock 112-2.

Referring to FIGS. 6 to 8, a description will now be made of the high-level reference voltage transferred via the reference voltage line 127, the high-level reference voltage transferred via the reference voltage line 128, the low-level reference voltage transferred via the reference voltage line 129, the low-level reference voltage transferred via the reference voltage line 130, the LCD drive voltage transferred via the LCD drive voltage line 132, and the LCD drive voltage transferred via the LCD drive line 132 in order to perform these drain driver 401.

FIG. 6 shows the AC circuit for producing the reference voltages used to operate the level shifters 110, 111 and the signal drive circuits 114, 115. In this embodiment, the DC voltages VDBHH and VDBLH transferred via the voltage lines 603 and 604 are changed into AC voltages by the voltage selector 607 and the amplifier circuit 615 in response to the LCD AC signal 109, and the AC voltages are outputted to the reference voltage line 127. Similarly, as shown in FIG. 6, the DC voltages VDBHL and VDBLL transferred via the voltage lines 605 and 656 are changed into the AC voltages by the amplifier circuit 616 and the voltage selector 608 in response to the LCD AC signal 109 and the AC voltages are outputted to the reference voltage line 129. The DC voltages VDBHH and VDBLH transferred via the voltage lines 603 and 604 are changed into AC voltages by the voltage-selector 609 and the amplifier circuit 617 in response to the LCD AC signal 602, and the AC voltages are outputted to the reference voltage line 128. Similarly, the DC voltages VDBHL and VDBLL transferred via the voltage lines 605 and 656 are changed into the AC voltages by the amplifier circuit 618 and the voltage selector 610 in response to the LCD AC signal 602 and the AC voltages are outputted to the reference voltage line 130.

This condition will now be further explained in the drive waveforms shown in FIG. 8. When the AC signal 109 becomes 1, the signal drive circuit 114 shown in FIG. 1 is operated under such conditions that the LCD high-level reference voltage value is VDBHH and the low-level reference voltage value is VDBHL, whereas the signal drive circuit 115 is operated under such conditions that the LCD high-level reference voltage value is VDBLH and the low-level reference voltage value is VDBLL. When the AC signal 109 becomes 0, the signal drive circuit 114 shown in FIG. 1 is operated under such conditions that the LCD high-level reference voltage value is VDBHH and the low-level reference voltage value is VDBHL, whereas the signal drive circuit 115 is operated under such conditions that the LCD high-level reference voltage value is VDBLH and the low-level reference voltage value is VDBLL.

Accordingly, in this embodiment, the reference voltage value VDBHL is equal to the voltage value VEE+VBE shown in FIG. 3, and the reference voltage VDBLL is equal to the voltage value VEE+VBL. Further, the reference voltage value VDBHH is equal to the voltage value VCC+VBH shown in FIG. 3, and the reference voltage value VDBLH is equal to the voltage value VCC+VBL shown in FIG. 3. Thus, the operation voltages of the digital LCD image data and the timing signal transferred via the signal drive circuit control buses 112, 113 by the level shifters 110, 111, are coincident with the drive voltages of the signal drive circuits 114, 115 by the reference voltages 127, 128, 129, 130 generated in this AC circuit 126.

If no level shifters 110, 111 are provided at the post stage of the signal drive circuit control buses 106, 107 for transferring the digital LCD image data and the timing signal, the operation voltage regions of the signal drive circuits 114, 115 are not coincident with the operation voltages of the digital LCD image data and the timing signal, so that these signal drive circuits are not properly operated.

Further, the AC circuit 133 for producing the voltage transferred via the LCD drive voltage lines 132 and 133 will now be described with reference to FIG. 7.

The LCD drive voltage line 132 changes the signal drive circuit DC LCD drive voltages transferred by the signal drive circuit DC LCD drive voltage lines 703 and 704 via the voltage selector 705 and the amplifier circuit 709 into AC voltages which will then be outputted.

Similarly, the LCD drive voltage line 133 changes the signal drive circuit DC LCD drive voltages transferred by the signal drive circuit DC LCD drive voltage lines 703 and 704 via the voltage selector 706 and the amplifier circuit 710 into AC voltages which will then be outputted. When the AC signal 109 becomes "1", the LCD drive voltage line 132 outputs the voltage transferred by the signal drive circuit DC LCD voltage 703. Similarly, when the AC signal 109 becomes "0", the LCD drive voltage line 132 outputs the voltage transferred by the signal drive circuit DC LCD drive voltage line 704. When the AC signal 109 becomes "1", the LCD drive voltage line 133 outputs the voltage transferred by the signal drive circuit DC LCD voltage 704. Similarly, when the AC signal 109 becomes "0", the LCD drive voltage line 133 outputs the voltage transferred by the signal drive circuit DC LCD drive voltage line 703. Therefore, the voltages transferred by the LCD drive voltage lines 132 and 133 always have such polarities opposite to that of the common electrode voltage of the common electrode line 123. The LCD drive voltages transferred by the LCD drive voltage line 132 are inputted into the D/A converting circuit 409 of the drain driver 401 shown in FIG. 4, thereby obtaining the LCD drive voltages which will then be outputted via the signal line 116 to the LCD panel 120. Furthermore, the voltages transferred by the LCD drive voltage line 132 are changed into AC voltages within the drive voltage ranges for the reference voltages 127 and 129 generated in the AC circuit 129 shown in FIG. 6. Similarly, the voltages transferred by the LCD drive voltage line 133 are changed into the AC voltages within the drive voltage ranges for the reference voltages 128 and 130.

This will now be explained with reference to FIG. 8. The voltages transferred by the LCD apply voltage lines 132 and 133 are entered into the D/A converting circuit 409 of the drain driver 401 shown in FIG. 4, thereby producing the LCD drive voltages which will then be outputted via the signal lines 116 and 117 to the LCD panel 120. The voltage outputted from the signal line 116 of FIG. 8 is changed into the AC voltage in connection with the AC voltage generations of the reference voltages 127 and 129, whereas the voltage outputted from the signal line 117 is changed into the AC voltage in connection with the AC voltage generations of the reference voltages 128 and 130. Here, when the voltages transferred by the LCD drive voltage lines 132 and 133 are not such voltage values within the operation region of the reference voltages, the signal drive circuits 114 and 115 are not normally operated, so that no voltages required for the LCD representation appear on the signal lines 116 and 117.

Subsequently, a description will now be made of such a condition that the LCD apply voltages are generated by the signal drive circuits 114 and 115, and then these voltages are applied to the LCD panel 120.

The image data transferred by the system bus 101 are converted into the LCD apply voltages VDU and VDL (see FIG. 8) by way of the level shifters 110, 111, the signal drive circuits 114, 115, and the AC circuits 126, 131 as represented in FIG. 1. When these LCD apply voltages VDU and VDL are outputted to the LCD panel 120, the shift operation is carried out by the scanning drive circuit control bus 108 in the scanning drive circuit 118. The scanning line 119 connected to the horizontal line to which the LCD apply voltages outputted from the signal drive circuits 114 and 115 are applied, becomes valid. This condition will now be explained with reference to FIG. 8 more in detail.

Figure 18:
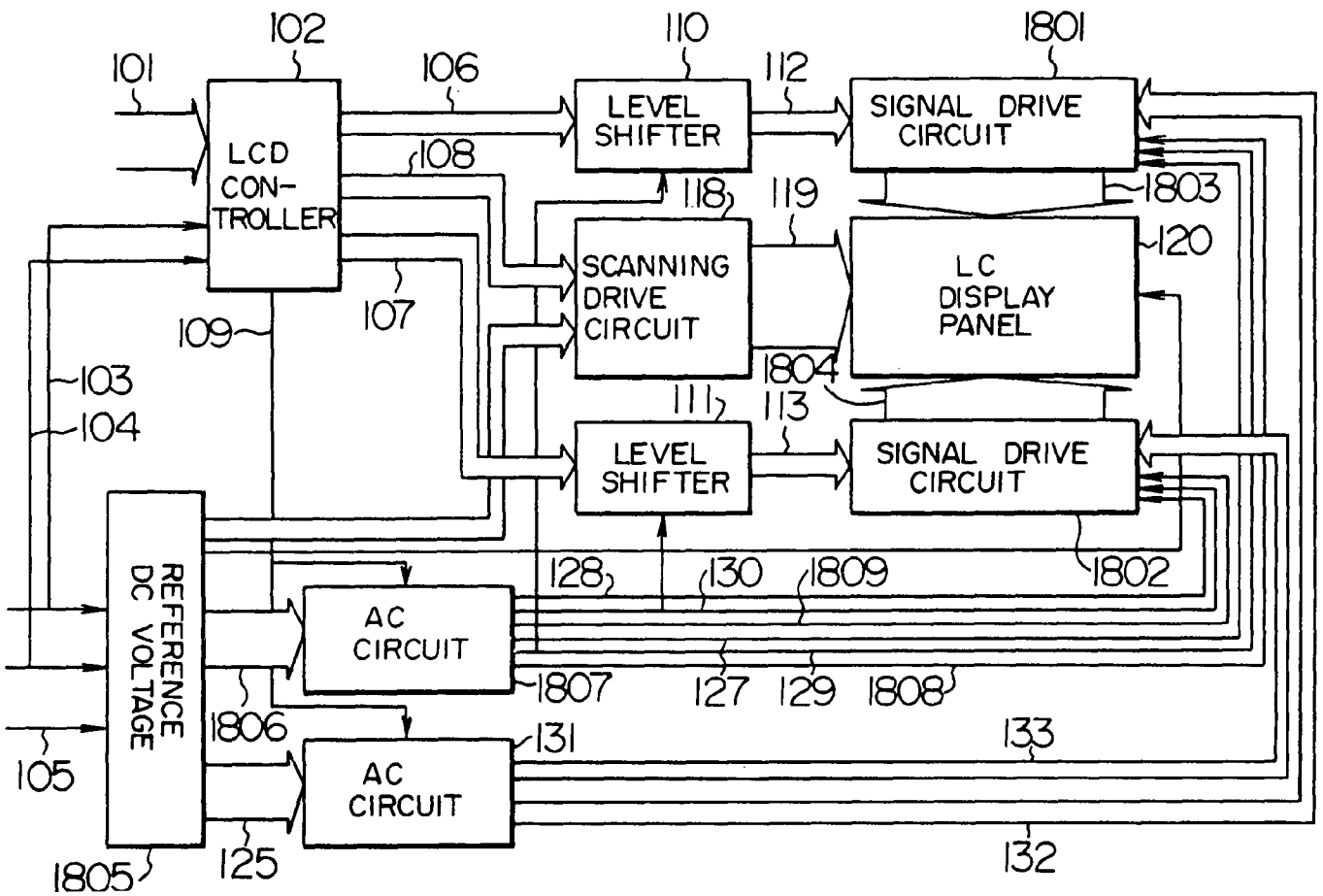
FIG. 18 schematically represents a system arrangement of a liquid crystal display apparatus according to a further embodiment of the present invention.

To the signal line 116, the drive waveform of VDU shown in the timing chart of FIG. 18 is supplied from the signal drive circuit 114. Further, the drive waveform of VDL shown in the timing chart of FIG. 8 is supplied from the signal drive circuit 115 to the signal 117. The scanning line G(n) is operated in such a manner that the selective voltage. VGH becomes valid during 1 line period, whereas the non-selective voltage VGL becomes valid during 1 frame period.

When the selective voltage VGH of the scanning line G(n) becomes valid, the TFT 50 of the pixel unit 50, connected to the scanning line G(n) represented in FIG. 10, is brought into the ON state, and then the voltages appearing on the signal lines 116 and 117 are stored via the TFT 502 into the liquid crystal 503 and the load capacitance 504.

Deterioration of the liquid crystal 503 must be prevented by changing the LCD apply voltages into the AC voltage with a certain period, and also luminance thereof may be varied by changing the voltage stored in the liquid crystal 503 as indicated in FIG. 9. When the positive-potential voltage with respect to the common electrode 123 is applied to the liquid crystal 503, it owns the characteristic of the luminance-voltage curve 901, whereas when the negative-potential voltage with respect to the common electrode 123, it owns the characteristic of the luminance-voltage curve 902. Thus, since luminance may be controlled based upon the voltage effective value irrelevant to the polarities of the apply voltages to the liquid crystal, the polarities of the apply voltages are alternately valid for every frame with regard to the common electrode voltage VCOM also as to prevent deterioration of the liquid crystal. This may be realized by alternately changing the voltage values of the digital LCD image data and the timing signal which have been level-shifted by the level shifters 110 and 111 in synchronism with the LCD AC signal shown in FIG. 1, the reference voltage values of the signal drive circuits 114 and 115, and the externally supplied LCD drive voltage value. In order not to prevent current concentration to the electrode line, the adjoining pixels are driven by applying the LCD apply voltages having the opposite polarities to the liquid crystal 503 with respect to that of the common electrode voltage VCOM. This may also be realized by changing into opposite directions, these polarities of the drive voltages for the digital LCD image data and the timing signal which have been level-shifted by the level shifter 110, the reference voltage value of the signal drive circuit 114, the externally supplied LCD drive voltage, the reference voltage value of the signal drive circuit 115, and the drive voltage levels of the digital LCD image data and the timing signal which have been level-shifted by the level shifter 111 in synchronism with the LCD AC signal 109 of FIG. 9 with respect to the polarities of the common electrode voltage VCOM of the common electrode line 123.

The polarity conditions by the apply voltages will now be explain with reference to FIG. 10. In this embodiment, the voltages with the positive polarity are applied to the pixel units driven by the signal line 116, and the voltages with the negative polarity are applied to the pixel units driven by the signal line 117. In the pixel units 501-U(m)-(n), 501-U(m)-(n+1), - - - , connected to the DU(m) of the signal line 116, and also in the pixel units 501-U(m+1)-(n), 501-U(m+1)-(n+1) connected to the DU(m+1) of the signal line 116, the currents flowing through the liquid crystal 503 are flown along the direction of the common electrode line 123, and the currents flowing through the added capacitors 504 are flown into the scanning line G(n−1) and G(n) provided at the prestage. Also, in the pixel units 501-L(m)-(n), 501-L(m)-(n+1), - - - , connected to DL(m) of the signal line 117, the currents flowing through the liquid crystal 503 is flown from the common electrode line 123, and the currents flowing through the added capacitors 504 are flown from the scanning lines G(n−1) and G(n) provided at the prestage. As a result, since when the respective pixel units along the horizontal direction are under selective conditions, such a control is made that the current directions of the common electrode lines 123 and the scanning line G(n−1) and G(n) are different from each other with regard to the adjoining pixels, it is possible to prevent that the currents flown into the respective electrodes are concentrated. Therefor, since voltage distortions of the common electrode line 123 and the scanning line 119 can be reduced, a high image quality can be obtained without varying the effective values of the LCD apply voltages to the liquid crystal 503 and the added capacitances 504. To prevent deterioration of the liquid crystal, although the polarity of the voltage applied to each pixel unit is inverted during the next frame, the current concentration to the electrodes may be prevented due to a similar reason.

With reference to FIGS. 11 and 12, a description will now be made of such a condition that the voltages applied to the liquid crystal are alternately changed for every line.

In FIG. 11, the LCD AC signal 109 has alternately been changed with a time period of 1 horizontal period. As a result, the voltage selectors 607, 608, 609, 610 employed in the AC circuit 126 shown in FIG. 6 and the voltage selectors 705, 706 employed in the AC circuit 131 indicated in FIG. 7 repeatedly perform the selecting operations for every horizontal period. Thus, in the signal drive circuit 114, as illustrated in FIG. 11, when the scanning line G(n) is under the selecting condition, namely under the voltage level VGH, the reference voltages 127 and 129 become the positive-potential voltages VDBHH, VDBHL with respect to the common electrode voltage VCOM, respectively, and the positive-potential voltage is also applied to the signal line 116 with respect to the common electrode voltage VCOM. Then, when the scanning line G(n+1) of the subsequent line is under the selecting state, the reference voltages 127 and 129 become the negative-potential voltages VDBLH and VDBLL with respect to the common electrode voltages VCOM, respectively, and the negative-potential voltage is also applied to the signal line 116 with respective to the common electrode voltage VCOM.

Further, in the signal drive circuit 115, the scanning line G(n) is under the selecting condition, namely under the voltage level VGH, the reference voltages 128 and 130 become the negative-potential voltages VDBLH, VDBLL with respect to the common electrode voltage VCOM, respectively, and the negative-potential voltage is also applied to the signal line 117 with respect to the common electrode voltage VCOM. Then, when the scanning line G(n+1) of the subsequent line is under the selecting state, the reference voltages 129 and 130 become the positive-potential voltages VDBHH and VDBHL with respect to the common electrode voltages VCOM, respectively, and the positive-potential voltage is also applied to the signal line 117 with respective to the common electrode voltage VCOM. With this operation, the polarities of the voltages applied to the pixel units for every line are reversed.

Referring now to FIG. 12, the polarities of the voltages applied to this LCD pixel unit will be explained.

In this embodiment, among the pixel units connected to the scanning line G(n), in the pixel unit 501-U(m)-(n) connected to the DU(m) of the signal line 116, and also in the pixel units 501-U(m+1)-(n) connected to the DU(m+1) of the signal line 116, the currents flowing through the liquid crystal 503 are flown along the direction of the common electrode line 123, and the currents flowing through the added capacitors 504 are flown into the scanning line G(n−1) provided at the prestage. Also, in the pixel units 501-L(m)-(n) connected to DL(m) of the signal line 116, the currents flowing through the liquid crystal 503 is flown from the common electrode line 123, and the currents flowing through the added capacitors 504 are flown from the scanning line G(n−1) provided at the prestage. Further, among the pixel units connected to the scanning line G(n+1), the pixel units 501-U(m)-(n) connected to the DU(m) of the signal line 116, and also in the pixel units 501-U(m+1)-(n) connected to the DU(m+1) of the signal line 116, the currents flowing through the liquid crystal 503 are flown along the direction of the common electrode line 123, and the currents flowing through the added capacitors 504 are flown into the scanning line G(n−1) and G(n) provided at the prestage. Also, in the pixel unit 501-L(m)-(n) connected to DL(m) of the signal line 116, the currents flowing through the liquid crystal 503 is flown from the common electrode line 123, and the currents flowing through the added capacitors 504 are flown from the scanning line G(n) provided at the prestage.

Also in this embodiment similar to the previous embodiment shown in FIGS. 9 and 10, since when the respective pixel units along the horizontal direction are under selective conditions, such a control is made that the current directions of the common electrode lines 123 and the scanning line G(n−1) and G(n) are different from each other with regard to the adjoining pixels, it is possible to prevent that the currents flown into the respective electrodes are concentrated. Accordingly, a high image quality can be achieved by the LCD panel.

Referring to FIGS. 8, and 14 to 17, a liquid crystal display apparatus according to another embodiment of the present invention will now be explained, which is so constructed by employing a signal drive circuit such that input digital image data is converted into liquid crystal apply voltages, and these liquid crystal apply voltages are outputted to a TFT liquid crystal panel for LCD representing purposes. This signal drive circuit is provided at an upper side of the TFF liquid crystal panel. It should be noted that even when the signal drive circuit is arranged at the lower side of the LCD panel, other circuits and drive conditions thereof are similar to those of the upper side case except that the signal lines from the LCD panel are extracted downwardly.

Figure 14:
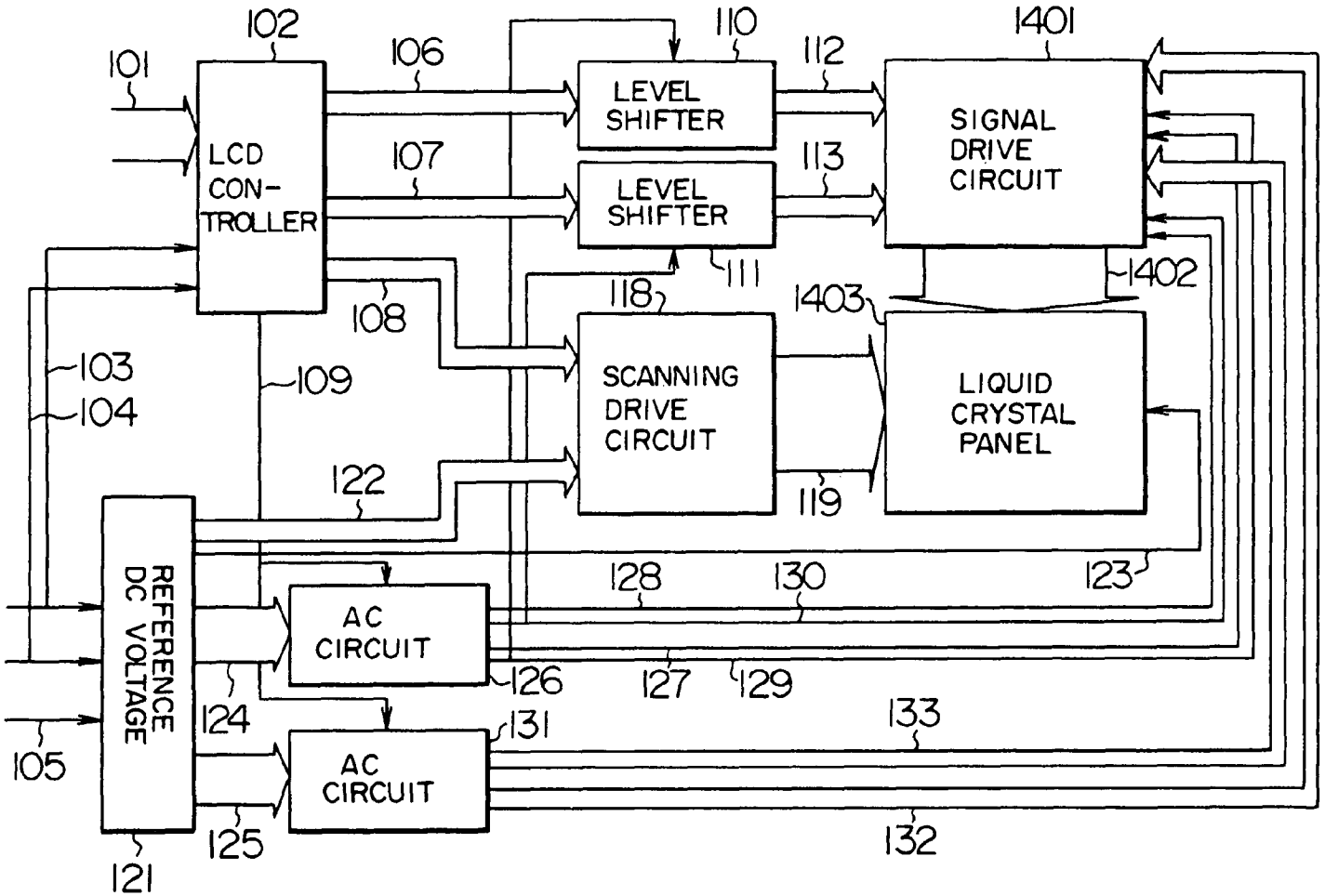
FIG. 14 is a schematic block diagram for showing a system arrangement of a liquid crystal display apparatus according to another embodiment of the present invention.

FIG. 14 schematically shows a system arrangement of the liquid crystal display apparatus.

In FIG. 14, reference numeral 1401 denotes a signal drive circuit, reference numeral 1402 shows a signal line, and reference numeral 1403 indicates a liquid crystal panel. In this embodiment, the signal drive circuit 1401 drives upwardly the liquid crystal panel 1403.

Figure 15:
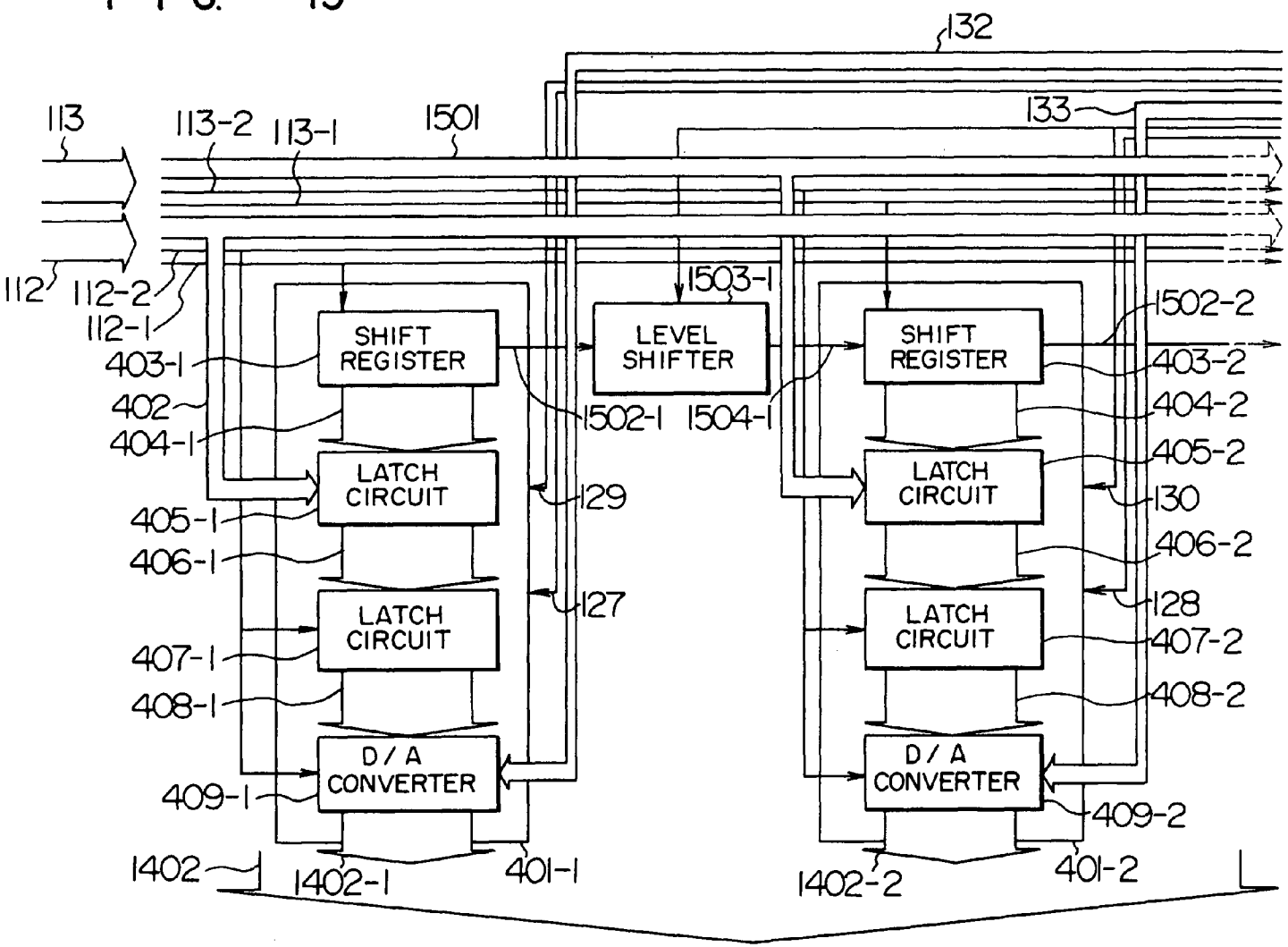
FIG. 15 is a schematic block diagram of a signal drive circuit according to another embodiment of the present invention.

FIG. 15 is a schematic block diagram for showing an internal circuit arrangement of the signal drive circuit 1401 indicated in FIG. 14.

In FIG. 15, reference numerals 401-1, 401-2, - - - , are drain drivers, and the signal drive circuit 1401 is arranged by a plurality of drain drivers 401. The drain driver 401 is so arranged that the digital image data is inputted therein to be converted into the LCD apply voltage which will then be outputted. Odd-numbered drain drivers 401-1, 401-3, - - - , drive the LCD panel 1403 by employing a signal drive circuit control bus 112, and even-numbered drain drivers 401-2, 401-4, - - - , drive the LCD panel by employing a signal drive circuit control bus 113. Accordingly, the shift clock 112-1, the latch clock 112-2, and the digital image data bus 402 for transferring the digital image data within the signal drive circuit control bus 112 are connected to the odd-numbered drain drivers 401-1, 401-3, - - - . The shift clock 113-1, the latch clock 113-2, and the digital image data bus 1501 for transferring the digital image data within the signal drive circuit control bus 113 are connected to the even-numbered drain drivers 401-2, 401-4, - - - . Also, the odd-numbered drain drivers 401-1, 401-3, - - - , convert the LCD drive voltage transferred via the LCD drive voltage line 132 into the LCD apply voltage, whereas the even-numbered drain drivers 401-2, 401-4, - - - , convert the LCD drive voltage transferred via the LCD drive voltage line 133 into the LCD apply voltage, and these LCD apply voltages are outputted to the signal lines 1402. As to the reference voltage, the odd-numbered drain drivers 401-1, 401-3, - - - , use the high-level reference voltage transferred via the reference voltage line 127 and the low-level reference voltage transferred via the reference voltage line 129, whereas the even-numbered drain drivers 401-2, 401-4, - - - , utilizes the high-level reference voltage transferred via the reference voltage line 128 and the low-level reference voltage transferred via the reference voltage line 130.

Referring numeral 1502 denotes enable signal outputted from the drain driver 401, which has the same function as that of the enable signal 410 shown in FIG. 4. Reference numeral shows a level shifter for level-shifting the operating voltage level of the enable signal 1502 to the operating voltage level of the drain driver 401-2 at the next stage. It should be noted that the level shifter 1503 is provided among all of the drain drivers 401. Reference numeral 1504 is a level-shifted enable signal which becomes an input signal to the drain driver 401.

Figure 16:
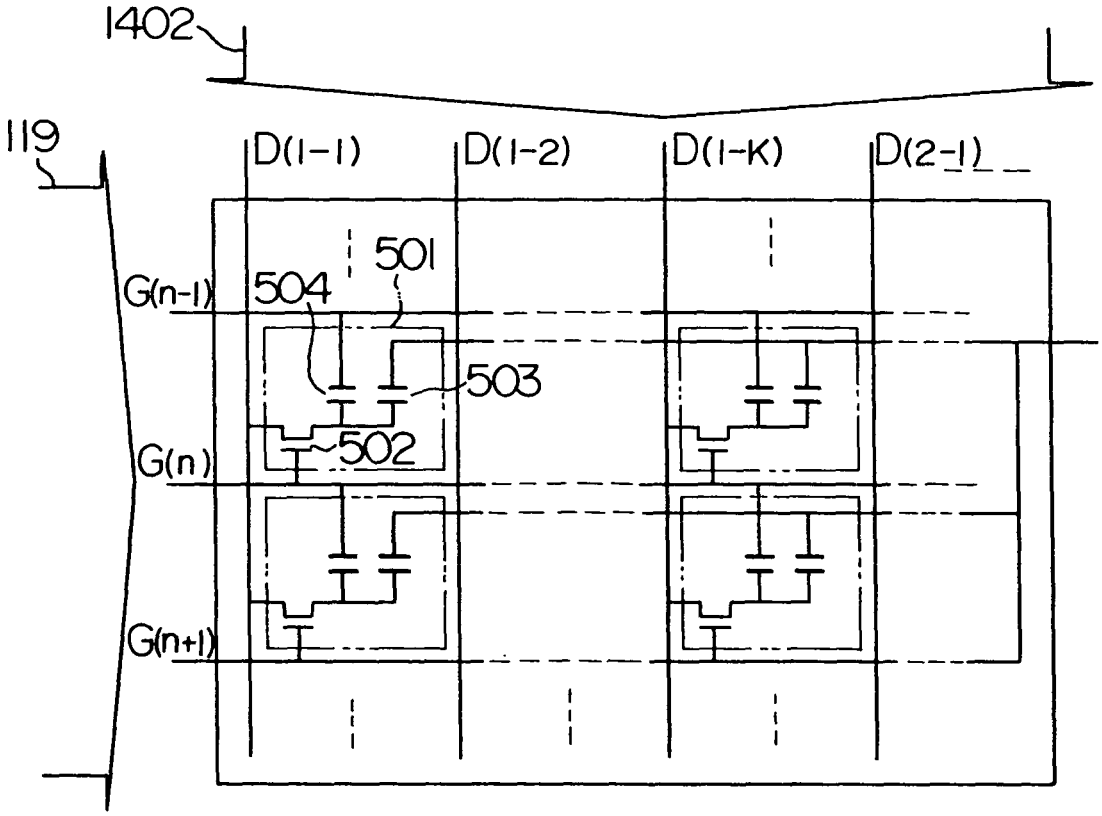
FIG. 16 is an equivalent surcoat of a liquid crystal panel according to another embodiment of the present invention.

FIG. 16 represents an equivalent circuit diagram of the liquid crystal panel 1403 in FIG. 14.

In FIG. 16, symbols D(1−1), D(1−2), - - - , D(1−k) indicate signal lines driven by the drain driver 401-1 shown in FIG. 15, and symbol D(2−1) denotes a signal lien driven by the drain driver 401-2 indicated in FIG. 15. Other circuits are similar to the equivalent circuit of the liquid crystal panel shown in FIG. 5.

Figure 17A:
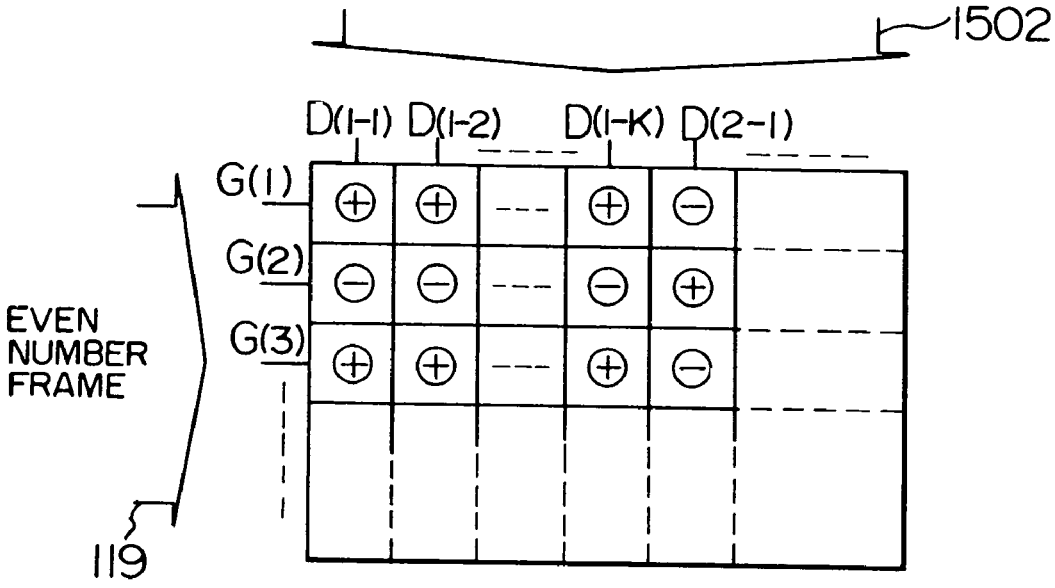
FIG. 17 schematically indicates polarities of liquid crystal apply voltages with respect to that of the common electrode voltage in the equivalent circuit of the present invention.
Figure 17B:
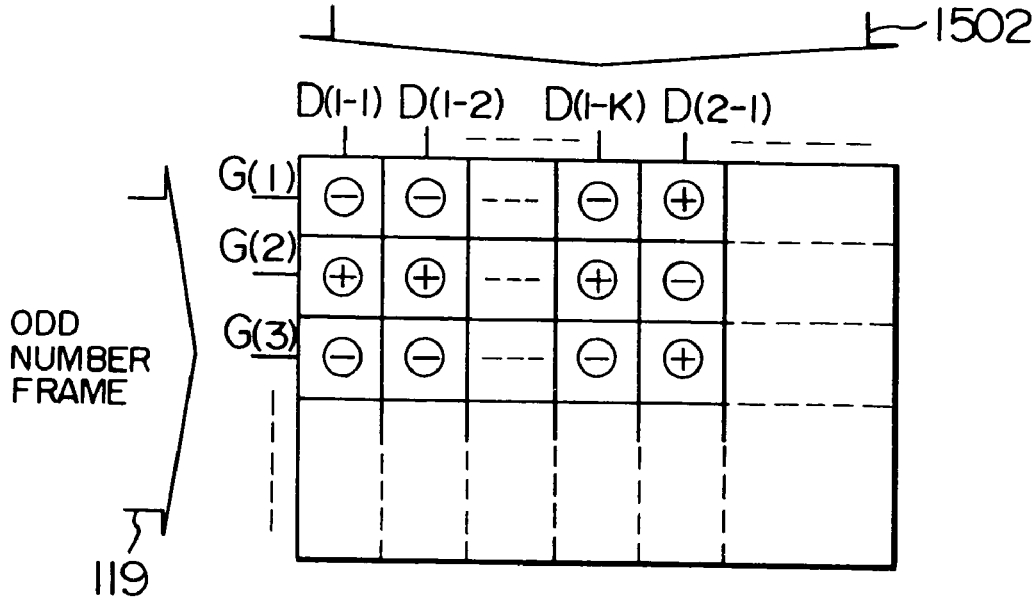

FIG. 17 schematically shows such a diagram for indicating the polarities of the LCD apply voltages applied to the respective pixel units when the LCD pixel units when the LCD panel 1403 is driven in accordance with another embodiment of the present invention (see FIG. 14). Symbol "+" indicates an application of a positive potential and symbol "–" denotes an application of a negative potential.

Referring again to FIGS. 8 and 14 to 17, operations of the LCD display apparatus according to another embodiment of the present invention will now be described.

In FIG. 14, the digital image data transferred by the system bus 101 is processed through the LCD controller 102, the level shifters 110, 111, and the signal drive circuit 1401, and then converted into the LCD apply voltage, and the converted LCD apply voltage is outputted to the LCD panel 1403 for display purposes. At this time, the circuit arrangements as well as the functions of the LCD controller 102 and the level shifters 110, 111 are similar to these of the previous embodiment shown in FIG. 1. Also, the circuit arrangements and the functions of the scanning drive circuit 118, the DC reference voltage generating circuit 121, and the AC circuits 126 and 131 are similar to those of the previous embodiment of FIG. 1.

However, a different point is such that the signal line 1402 used for applying the LCD apply voltage to the LCD panel 1403 is drawn upwardly from one side of the signal drive circuit 1401. Accordingly, this signal drive circuit 1401 must be provided at one side of the LCD panel 1403. In the drain driver 401 shown in FIG. 15, any of the digital unit and the digital-to-analog converting circuit 409 is driven under low voltage as the reference voltage. Therefore, it is required to control that the voltages applied to the liquid crystal are changed into AC voltages in a certain period, and the polarities of the voltages applied to all of the pixel units along the horizontal line direction are not coincident with each other. Changing of the voltages applied to the liquid crystal into the AC voltages may be realized by changing the various signals entered to the signal drive circuit 1401 containing the reference voltage into the AC signals in a similar manner to that of the first-mentioned embodiment shown in FIG. 1. As to such a control that the polarities of the voltages applied to all the pixel units along the horizontal line direction are not coincident with each other, in the previous embodiment shown in FIG. 1, it is possible to realize this control to realize this control in such a manner that when the upper-sided signal drive driver 114 is operated under the drive voltage level along the positive potential direction, the lower-sided signal drive driver 115 is operated under the drive voltage level along the negative potential direction with respect to the common electrode voltage VCOM transferred via the common electrode line 123. However, in this embodiment, since the signal drive circuit 1401 is provided only at one side of the LCD panel 1403, the respective drain drivers 401 must be controlled within the signal drive circuit 1401 in such a manner that the respective drain drivers may be operated under both of the drive voltage level along the positive potential direction and the drive voltage level along the negative potential direction.

This operation will now be explained with reference to FIGS. 14 and 15.

Since the signal drive circuit 1401 is constructed of a plurality of drain drivers 401, both the timings of the LCD apply voltage and the drive voltage level are separated for operating the drain driver 401 to produce the voltage VDU shown in FIG. 11, and the drain driver 401 to produce the voltage VDL. That is to say, according to the present embodiment, the odd-numbered drain drivers 401-1, 401-3, - - - , commonly uses the signal drive circuit control bus 112, the LCD drive voltage line 132, and the reference voltage lines 127, 129. Furthermore, the even-numbered drain driver 401-2, 401-4, - - - , commonly utilizes the signal drive circuit control bus 113, the LCD drive voltage line 133, and the reference voltage lines 128, 130. Then, such an operation condition is realized for a certain period that when the signal drive circuit voltage line 133, the LCD drive voltage line 132, and the reference voltage lines 17, 129 own the positive-polarity voltage, with respect to the common electrode voltage VCOM transferred via the common electrode line 123, the signal drive circuit control bus 113, the LCD drive voltage line 133, and the reference voltage lines 128, 130 owns the negative-polarity voltage with regard to the common electrode voltage VCOM transferred via the common electrode line 123. This implies that the odd-numbered drain drivers 401-1, 401-3, - - - , among the signal drive circuit 1401 are operated in a similar manner to that of the signal drive circuit 114 shown in FIG. 1, and the even-numbered drain drivers 401-2, 404-4, - - - , are operated in a similar manner to that of the signal drive circuit 115 represented in FIG. 1.

The operation of this signal drive circuit 1401 will now be explained more in detail.

In the drain driver 401-1, the shift register 403-1 commences its operation in response to the shift clock 112-1, thereby sequentially making the latch signal 404-1 valid, and the storage circuit within the latch circuit 405-1 sequentially latches the digital LCD image data transferred via the image data bus 402. The latched data is outputted to the data bus 406-1. When the data fetching operation is completed by the storage circuit within the latch circuit 405-1, namely when the shift operation by the shift register 403-1 is accomplished, the shift register 403-1 makes the enable signal 1502-1 effective.

Although the drain driver 401 within the signal drive circuit 114 is operated under the same drive voltage level in the previous embodiment of FIG. 4, the drive voltage level of the odd-numbered drain drivers 401-1, 401-3, - - - , is different from that of the even-numbered drain drivers 401-2, 401-4, - - - , because the polarities of the LCD drive voltages outputted are different from the polarity of the common electrode voltage VCOM transferred via the common electrode line 123. Accordingly, the drive voltage level of the enable signal 1502-1 is shifted to the drive voltage level of the drain driver 401-2 provided at the subsequent stage. Since the level of the level-shifted enable signal 1504-1 is the same as the drive voltage level of the drain driver 401-2, when the enable signal 1504-1 becomes valid, the internal shift register 403-2 starts its operation similar to the drain driver 401-2 shown in FIG. 4. Then, the latch circuit 405-2 sequentially latches the data which have been latched by the latch circuit 405-1 employed within the drain driver 401-1. Furthermore, when the data fetching operation by the storage circuit in the latch circuit 405-2 is completed, the enable signal 1502-2 becomes valid, and then the drive voltage level of the drain driver 401 at the subsequent stage is equal to that of the drain driver 401-1. The LCD image data for 1 horizontal line can be fetched by performing the above-described operations by the respective drain drivers 401 employed in the signal drive circuit 1401.

In this embodiment, the internal arrangement of the LCD panel 1403 is similar to that of the LCD panel 130 of the previous embodiment shown in FIG. 5, but has such a different portion that as previously-explained, the signal line 1402 is drawn from only one side of the LCD panel 1403. As a consequence, the situations where the voltages are applied to the respective pixel units 501 inside the LCD panel 1403, are the same drive waveforms as shown in FIG. 11 in the previous embodiment. It should be noted that, as previously stated, the odd-numbered drain drivers 401-1, 401-3, - - - , and the even-numbered drain drivers 401-2, 401-4, - - - , are operated with the opposite polarities in regard to the polarity of the common electrode voltage VCOM. Thus, in case that the LCD apply voltage VDU shown in FIG. 11 corresponds to the voltages outputted from the odd-numbered drain drivers 401-1, 401-3, - - - , the LCD apply voltage. VDL corresponds to the voltages outputted from the even-numbered drain drivers 401-2, 402-4, - - - .

A description will now be made of the polarities of the voltages applied to the pixel units with respect to the common electrode voltage VCOM with reference to FIG. 17. It should be noted that the LCD panel is driven by the line AC drive system where the polarity of the voltage applied to the liquid crystal is changed for every line in this embodiment.

Assuming now that signal lines used to control the drain driver 401-1 among the signal lines 1502 are D(1−1), D(1+2), - - - , D(1−k), where symbol "k" denotes a natural number, and is equal to the number of signal lines used to control the drain driver 401. Similarly, a signal line used to control the drain driver 401-2 is D(2−1). In the odd frame, the positive-polarity voltages are applied to the horizontal line controlled under the scanning line G(1), and also the pixel units under control of the drain driver 401-1, whereas the negative-polarity voltages are applied to the pixel units under control of the drain driver 401-2. Similarly, the positive-polarity voltage is applied to the pixel units controlled by other odd-numbered drain drivers 401-3, 401-5, - - - , whereas the negative-polarity voltage is applied to the pixel units controlled by the even-numbered drain drivers 401-4, 401-6, - - - . Furthermore, the negative voltages are applied to the horizontal line controlled by the scanning line G(2) and to the odd-numbered drain drivers 401-1, 401-3, - - - , whereas the positive-polarity voltages are applied to the even-numbered drain drivers 401-2, 401-4, - - - . Then, the polarities of the voltages applied to the respective pixel units in the odd frame are opposite to those of the voltages applied to the respective pixel units in the even frame. The inversion of the voltage polarities is repeated during the odd frame and the even frame, so that deterioration of the liquid crystal can be avoided. Moreover, in accordance with this embodiment, since such a control can be realized that the current directions of the common electrode 123 and the scanning lines G(1), G(2) are different from each other under the selective states of the respective pixel units along the horizontal direction in the respective pixel units controlled by the odd-numbered drain drivers 401-1, 401-3, - - - , and the even-numbered drain drivers 401-2, 401-4, - - - , concentration of the currents flowing into the respective electrodes can be prevented. Similar to the previous embodiment shown in since voltage distortions of the common electrode line 123 and the scanning line 119 can be reduced, a high image quality can be obtained without varying the effective values of the LCD apply voltages to the liquid crystal 503 and the added capacitances 504. To prevent deterioration of the liquid crystal, although the polarity of the voltage applied to each pixel unit is inverted during the next frame, the current concentration to the electrodes may be prevented due to a similar reason.

Figure 19:
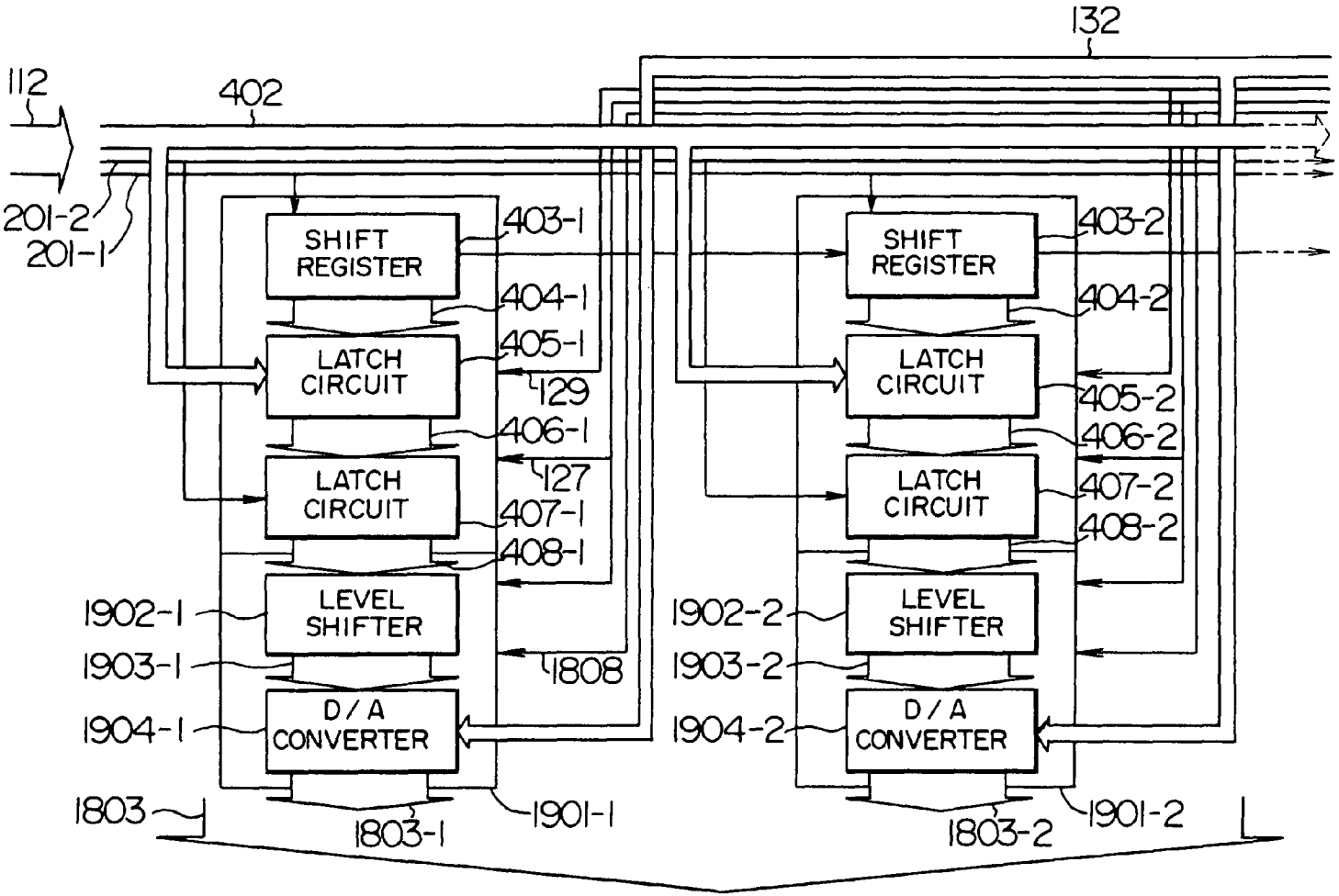
FIG. 19 is a schematic block diagram of a signal drive circuit according to a further embodiment of the present invention.
Figure 20:
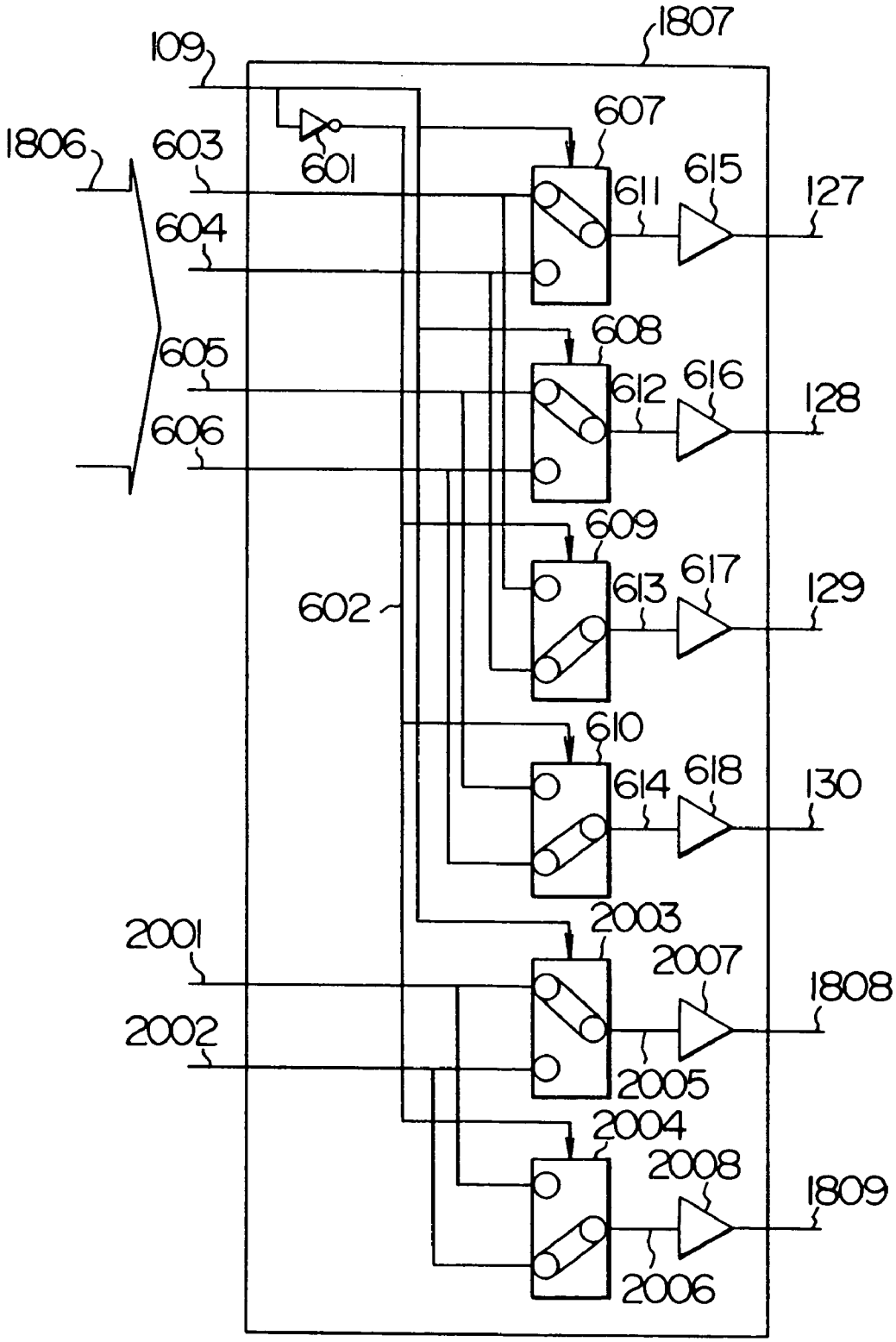
FIG. 20 is a schematic block diagram of an AC circuit according to a further embodiment of the present invention.

Referring now to FIGS. 18 to 20, a liquid crystal display apparatus according to another embodiment of the present invention will be described which is constructed of employing such a signal drive circuit that entered digital image data is converted into a liquid crystal apply voltage, the liquid crystal apply voltage is outputted to a TFT liquid crystal panel for LCD representation, and the digital circuit portion to process the digital image data is operated under different voltage from that of the LCD apply voltage generating unit.

FIG. 18 schematically shows a system arrangement of this liquid crystal display apparatus.

In FIG. 18, reference numerals 1801 and 1802 show signal drive circuits, which fetch the digital LCD image data transferred via the respective signal drive circuit control buses 112, 113 in response to the timing signal, and then convert these LCD image data into the LCD apply voltages corresponding thereto. Reference numerals 1803 and 1804 show signal lines for transferring the LCD apply voltages produced in the respective signal drive circuits 1801 and 1802. Reference numeral 1805 is a reference DC voltage generating circuit for generating various DC voltages used to operate the LCD display apparatus according to this embodiment. Reference numeral 1806 denotes a reference DC voltage line for signal drive circuit. Reference numeral 1807 shows an AC circuit. Reference numeral 1808 denotes a reference voltage line for transferring an LCD drive unit reference voltage used to drive the upper-sided signal drive circuit 1801, and reference numeral 1809 shows a reference voltage line for transferring an LCD drive circuit reference voltage used to drive the lower-sided signal drive circuit 1802.

FIG. 19 is a schematic block diagram for showing an internal circuit arrangement of the signal drive circuit 1801 of FIG. 18 according to another embodiment of the present invention. It should be understood that the signal drive circuit 1802 provided at the low side of the LCD panel 120 has a similar circuit arrangement to that of this signal drive circuit 1801.

In FIG. 19 reference numerals 1901-1, 1901-2, - - - , denote drain drivers, and the signal drive circuit 1801 is constructed of a plurality of drain drivers 1901. The drain driver 1901 has a function such that the digital LCD image data is inputted and converted into the LCD apply voltage which will then be outputted. In the signal drive circuit control bus 112, reference numeral 402 is an LCD image data bus. Furthermore, reference numeral 201-1 is a shift clock, and reference numeral 201-2 is a latch clock. The shift clock 201-1 is synchronized with the digital LCD image data transferred via the LCD image data bus 402. The latch clock 201-2 become active after the digital LCD image data for 1 horizontal line have been transferred to the signal drive circuits 1801 and 1802. Reference numeral 1902 shows a level shifter for converting a voltage amplitude level of the digital data transferred via the data bus 408. Reference numeral 1903 is a data bus for transferring the converted digital data.

Reference 1904 denotes a digital-to-analog converting circuit for converting the digital data transferred via the data bus 1903 into the LCD apply voltage based on the LCD drive voltage transferred via the AC LCD drive voltage line 132. Reference numeral 1803 shows a signal lien for transferring the LCD apply voltage generated in the digital-to-analog converting circuit 1904.

In the drain driver 1901 the digital circuit units for the shift register 403, the latch circuit 405 and the latch circuit 407 are driven under the high-level reference voltage transferred via the reference voltage line 127 and the low-level reference voltage transferred via the reference voltage line 129. Furthermore, the level shifter 1902 and the digital-to-analog converting circuit 1904 are driven by the low-level reference voltage transferred via the reference voltage line 127 and the LCD drive unit reference voltage transferred via the reference voltage line 1808.

FIG. 20 is a schematic block diagram for showing an internal circuit of the AC circuit 1807 indicated in FIG. 18, according to another embodiment of the present invention.

In FIG. 20, reference numeral 2001 and 2002 indicate DC voltage lines within the DC reference voltage line 1806 for the signal drive circuit, by which DC voltages functioning as the reference of the AC voltages outputted from this AC circuit 1807 are transferred.

Reference numerals 2003 and 2004 denote voltage selectors for changing the entered DC voltages into AC voltages. Reference numerals 2005 and 2006 are voltage lines for transferring the AC voltages derived from the respective voltage selectors 2003 and 2004. Reference numerals 2007 and 2008 show amplifier circuits play such role to increase the drive capabilities of the AC voltages outputted from the respective voltage selectors 2003 and 2004.

Operations of the liquid crystal display apparatus according to another embodiment of the present invention will now be described with reference to FIGS. 18 to 20.

In FIG. 18, the digital image data transferred via the system bus 101 are converted into the LCD apply voltages trough the LCD controller 102, the level shifters 110, 111 and the signal drive circuit 1801, and thereafter outputted to the LCD panel 120 for representation purposes. At this time, the circuit arrangements and the functions of the LCD controller 102 and the level shifters 110 and 111 are similar to those of the previous embodiment shown in FIG. 1. Similarly, the circuit arrangements and the functions of the scanning drive circuit 118 and the AC circuit 131 are similar to those of the embodiment of FIG. 1.

As compared with the drain driver 401 of FIG. 4 in the preceding embodiment of FIG. 1, a different point is the drain driver 1901 shown in FIG. 1, for constituting the signal drive circuit 1801. In other words, in accordance with the drain driver 401 shown in FIG. 4, any of the digital circuit units of the shift register 403, the latch circuit 405, the latch circuit 407, and also the digital-to-analog converting circuit 409 are operated under the common reference voltage. To the contrary, according to the drain driver 1901 of this embodiment, the digital circuit units and the digital-to-analog converting circuit 1904 are operated under the different reference voltages.

As a consequence, the reference DC voltage generating circuit 1805 for supplying the reference voltages to the signal drive circuit 1801, and the AC circuit 1807 must be different from the reference DC voltage generating circuit 121 and the AC circuit 126 shown in FIG. 1.

This operation will now be explained with reference to FIGS. 19 and 20.

The signal drive circuit 1801 is constructed of a plurality of drain drivers 1901 in a similar to the signal drive circuits 114, 115 of the embodiment shown in FIG. 1 as well as the signal drive circuit 1401 of the embodiment indicated in FIG. 14. However, the shift register 403, the latch circuit 405 and the latch circuit 407 are operated under the low-level reference voltage transferred via the reference voltage line 127 and also under the high-level reference voltage transferred via the reference voltage line 129. This operation is similar to that of the embodiment shown in FIG. 4. The digital-to-analog converting circuit 1904 for producing the LCD apply voltages is operated under the low-level reference voltage transferred via the reference voltage line 127 and the LCD drive unit reference voltage line 1808. Therefore, since the drive voltages of the digital unit and of the digital-to-analog converting circuit 1904 in the drain driver 1901 according to this embodiment are different from each other, the level shift circuit 1902 for performing the voltage conversion is required between these circuits. The data which are latched in the latch circuit 407 and transferred via the data line 408, are voltage-converted by this level shift circuit 1902, and the voltage-converted data are inputted via the data line 1903 to the digital-to-analog converting circuit 1904. In the digital-to-analog converting circuit 1904, the liquid crystal apply voltage corresponding to the digital data is produced by the LCD drive voltage transferred via the LCD drive voltage 132, and the produced LCD apply voltage is outputted to the signal line 1803 in a similar manner to the digital-to-analog converting circuit 409 shown in FIG. 4. This control operation is similar to these of the signal drive circuits 114 and 115, as previously explain in the embodiment of FIG. 1, whereby the LCD apply voltages can be obtained.

In this embodiment, as the internal arrangement of the liquid crystal panel 120 is similar to that of FIG. 1 and also the structures of the signal drive circuits 1801 and 1802 are arranged at the upper said and the lower side of the liquid crystal panel 120, the drive waveforms of the LCD apply voltages are similar to those of FIGS. 8 and 11. Also, since the high-level drive voltages of the digital-to-analog converting circuit 1904 are the LCD drive unit reference voltages transferred via the reference voltage lines 1808 and 1809, the waveforms represented by the reference voltage line 129 shown in FIGS. 8 and 11 are the waveforms indicated by the reference voltage line 1801 in this embodiment, and the waveform shown by the reference voltage line 130 is the waveform indicated by the reference voltage line 1809. Accordingly, it is possible to realize such a same LCD drive operation as that of FIG. 1.

Subsequently, the AC circuit 1807 for producing the reference voltages will now be explained.

In the AC circuit 1807, the circuit for producing the AC reference voltages transferred via the reference voltage lines 127, 128, 129, 130 are similar to that of the embodiment shown in FIG. 6. Furthermore, in this embodiment, the LCD drive unit reference voltages which are transferred via reference voltage lines 1808 and 1809 are required. The LCD drive unit reference voltage which has been changed into an AC reference voltage and will be transferred via the reference voltage line 1808, is generated by a voltage selector 2003 and an amplifier circuit 2007, whereas the reference voltage which is transferred via the reference voltage line 1809 is generated by a voltage selector 2004 and an amplifier circuit 2008.

At this time, to realize the drive waveforms shown in FIGS. 8 and 11, when the LCD AC signal 109 becomes "1", the voltage transferred via the reference voltage line 1808 corresponds to the voltage transferred via the signal drive circuit reference voltage line 2001, and also the voltage transferred via the reference voltage line 1809 corresponds to the voltage transferred via the signal drive circuit reference voltage line 2002. When the LCD AC signal 109 becomes "0", the voltage transferred via the reference voltage line 1808 corresponds to the voltage transferred via the signal drive circuit reference voltage line 2002, and also the voltage transferred via the reference voltage line 1809 corresponds to the voltage transferred via the signal drive circuit reference voltage line 2001. Thus, the phase of the voltage transferred via the reference voltage line 1808 is the same phase as each the voltages transferred via the reference voltage lines 127 and 129, whereas the phase of the voltage transferred via the reference voltage line 1809 is the same phase as each of the voltages transferred via the reference voltage lines 128 and 130. As a result, since the LCD drive voltages transferred via the LCD drive voltage lines 132 and 133 are operated within the drive voltage levels of the LCD drive unit reference voltages transferred via the reference voltage lines 1808 and 1809, the normal operation is available.

The LCD drive operation similar to that of the previous embodiment shown in FIG. 1 may be signal drive circuits 1801 and 1802 and also this AC circuit 1807. Therefore, the conditions under which the voltages are applied to the LCD panel 120 are similar to that of the embodiment shown in FIG. 1, so that a high quality LCD display can be obtained.

Furthermore, even when the signal line of the LCD panel would be extracted from either the upper side, or the lower side, since the drain driver 1901 for constituting the signal drive circuit employed in this embodiment is arranged at the side where the signal line is extracted in a similar manner to that of FIG. 14, and also the level shifter is provided between the drain drivers 1901, there may be provided similar effects to those of the previous embodiment shown in FIG. 14.

Figure 21:
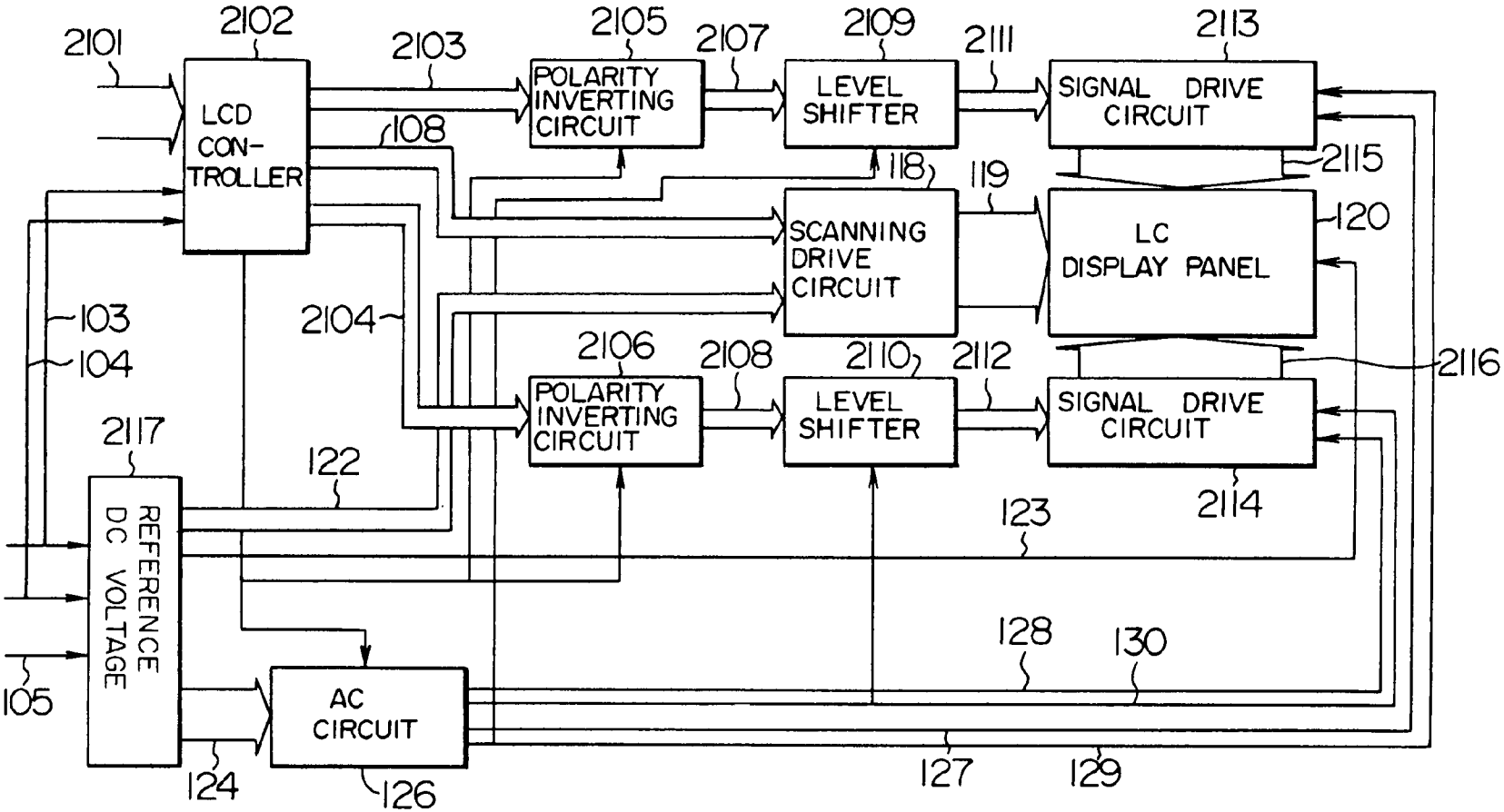
FIG. 21 is a schematic block diagram for showing a system arrangement of a liquid crystal display apparatus according to a still further embodiment of the present invention.
Figure 22:
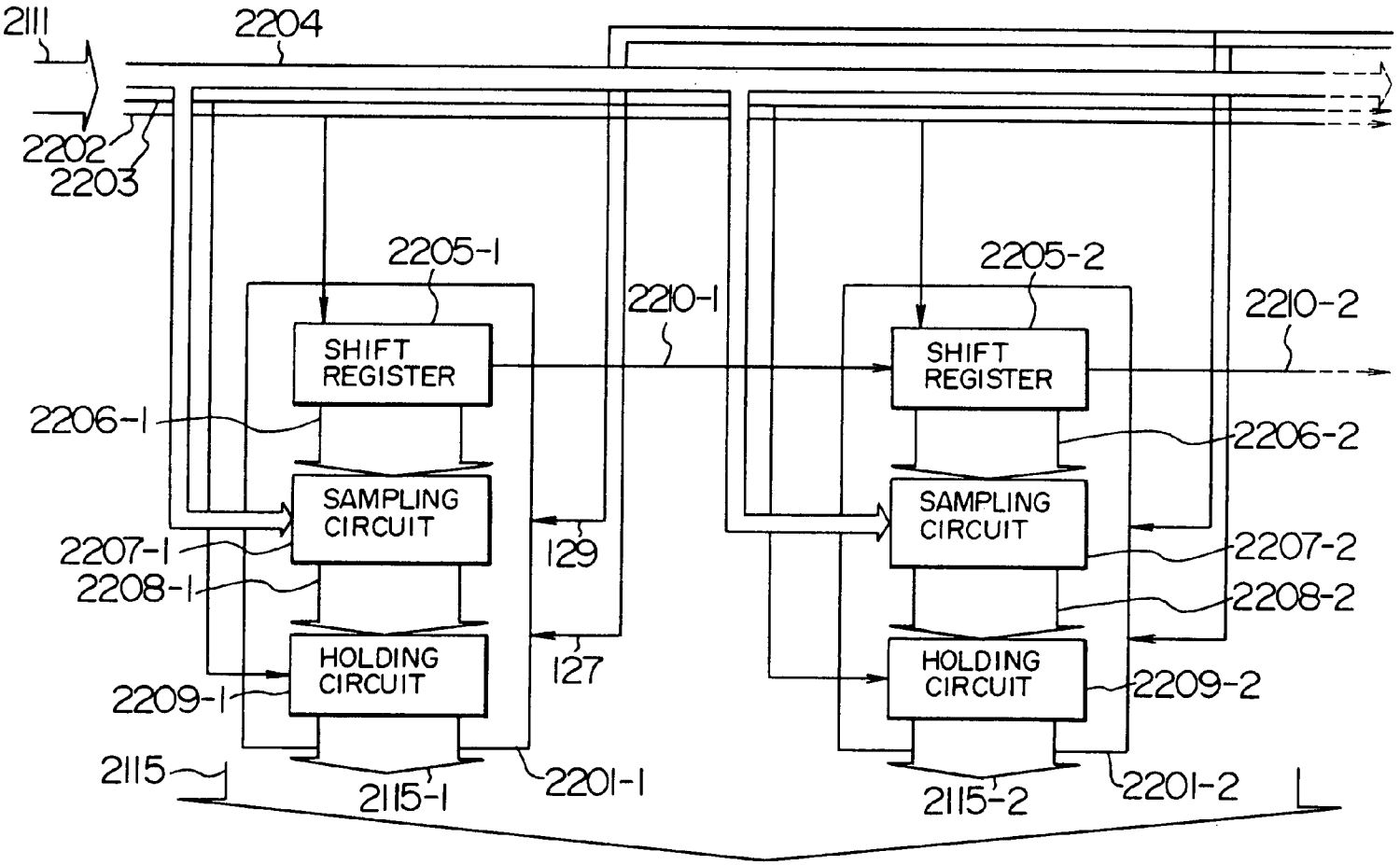
FIG. 22 is a schematic block diagram for representing a signal drive circuit according to a still further embodiment of the present invention.

Referring now to FIGS. 21 and 22, a description will now be made of a liquid crystal display apparatus according to one embodiment of the present invention, which is arranged by employing a signal drive circuit for fetching inputted analog image data and for outputting this image data as an LCD apply voltage to a TFT liquid crystal panel for representation purposes.

FIG. 21 is a schematic block diagram for showing a system arrangement of the liquid crystal display apparatus.

In FIG. 21, reference numeral 2101 is a system bus for transferring analog image data and a synchronization (sync) signal. In this embodiment, it should be noted that both the image data and the sync signal transferred via the system bus 2101 are such line sequential scanning signals similar to the image data and the sync signal transferred to be displayed on the CRT (cathode-ray tube) display apparatus. Reference numeral 2102 denotes a liquid crystal controller for converting the analog image data and the sync signal transferred by the system bus 2101 into analog LCD image data and a timing signal for driving the liquid crystal display apparatus.

Reference numerals 2103 and 2104 show signal drive circuit control buses used to transfer the analog LCD image data and the timing signal which have been converted into the signal drive circuits under control of the LCD controller 2102. Reference numerals 2105 and 2106 show polarity inverting circuits, and reference numerals 2107 and 2108 are signal drive circuit control buses for transferring the analog image data and the sync signal, the polarities of which have been inverted. Reference numerals 2109 and 2110 are level shifters for shifting the voltage levels of the analog LCD image data and the timing signal, which are transferred via the signal drive circuit control buses 2107 and 2108, into the operation region of the signal drive circuit. Reference numerals 2111 and 2112 are signal drive circuit control buses for transferring the analog LCD image data and the timing signal whose voltage levels have been shifted by the level shifters 2110 and 2109. Reference numerals 2113 and 2114 denote signal drive circuits which fetch the analog LCD image data transferred via the respective signal drive circuit control buses 2111, 2112 in response to the timing signal, and convert the fetched image data into LCD apply voltages corresponding to the LCD image data. Reference 2117 is a reference DC voltage producing circuit for producing various DC reference voltages used to operate this LCD display apparatus.

FIG. 22 is a schematic block diagram for driving an internal circuit arrangement of the signal drive circuit 2113 of FIG. 21 according to a further embodiment of the present invention. It should be understood that the signal drive circuit 2114 provided at the low side of the LCD panel 120 has a similar circuit arrangement to that of this signal drive circuit 2113.

In FIG. 22, reference numerals 2201-1, 2201-2, - - - , denote drain drivers, and the signal drive circuit 2113 is constructed of a plurality of drain drivers 2201. The drain driver 2201 has a function such that the analog image data is inputted and converted into the LCD apply voltage which will then be outputted to the LCD panel 120. Furthermore, reference numeral 2202 is a shift clock, and reference numeral 2203 is a latch clock. The shift clock 2202 is synchronized with the digital LCD image data transferred via the LCD image data bus 2204. The latch clock 2203 becomes active (valid) after the analog LCD image data for 1 horizontal line have been transferred to the signal drive circuits 2113 and 2114.

Reference numeral 2204 shows an LCD image data bus for transferring the analog image data. Reference numeral 2205 indicates a shift register, and reference numeral 2206 represents a latch signal. In response to the shift clock 2202, the shift register 2205 performs the shift operation. In accordance with this shift operation, the latch signals 2206 are sequentially valid. Reference numeral 2207 is a sampling circuit for sequentially latching the analog LCD image data transferred via the LCD image data bus 402 in response to the latch signal 2206. Reference numeral 2209 indicates a holding circuit for simultaneously acquiring the data transferred via the data bus 2208 in response to a latch clock 2203 so as to hold the data, and for transferring the held data as the liquid crystal apply voltage via a signal line 2215. Reference numeral 2210 shows an enable signal functioning as same as the enable signal 410 shown in FIG. 4. In the drain driver 2201 any of the shift register 2205, the sampling circuit 2207 and the holding circuit 2209 are driven under the high-level reference voltage transferred via the reference voltage line 127 and the low-level reference voltage transferred via the reference voltage line 129.

Referring again to FIGS. 21 and 22, operations of the liquid crystal display apparatus according to the embodiment of the present invention.

Since the inputted image data is the analog value in this embodiment, this is a different point, as compared with the embodiments of FIGS. 1, 14 and 18. In FIG. 21, the analog image data transferred via the system bus 2101, is converted into the LCD apply voltage via the analog image data, the LCD controller 2102, the polarity inverting circuits 2105, 2106, the level shifters 2109, 2110, and the signal drive circuits 2113, 2114, and then the LCD apply voltage is outputted to the LCD panel 120 for display purposes. In the LCD controller, the analog image data inputted via the system bus 2101 is converted in response to the sync signal into the LCD apply voltage in such a manner that the converted data is suitable for the input interfaces of the signal drive circuits 2113 and 2114, and the pixel arrangements of the LCD panel 120, and then the converted data is outputted via the signal drive circuit control bus 2103 and 2104.

Here, there is such a problem due to the reasons similar to those of the previous embodiment shown in FIG. 1 that the drive voltage levels of the analog data and the timing signal, which are transferred via the signal drive circuit control buses 2103 and 2104, are different from the drive voltage levels of the signal drive circuits 2113 and 2114.

Moreover, the signal drive circuits 2113 and 2114 according to this embodiment are so constructed that the analog display data is sampled, and the held voltage is converted into the LCD apply voltage which will then be outputted. As previously explained in FIG. 9, a liquid crystal display owns such a characteristic that luminance thereof becomes high when a low-potential voltage with respect to a common electrode voltage VCOM is applied thereto irrelevant to a polarity thereof, whereas luminance thereof becomes low when a high-potential voltage is applied thereof. Therefore, since the analog image data transferred via the signal drive circuit control buses 2103 and 2104 owns only the positive-polarity voltage and the luminance information, the polarity inversion fitted to the liquid crystal characteristic by the polarity inverting circuits 2105 and 2106 is required.

Both of the analog image data whose polarity and level have been inverted/converted, and also the timing signal whose level has been converted are supplied via the signal drive circuit control buses 2111 and 2112 to the respective signal drive circuits 2113 and 2114. In the signal drive circuits 2113 and 2114, the data on the above-described signal drive circuit control buses 2111 and 2112 are converted into the LCD apply voltage. This converting operation will now be explained with reference to FIG. 22.

In FIG. 22, the shift register 2205-1 starts its operation in response to the shift clock 2202 and sequentially causes the latch signal 2206-1 to be valid in the drain driver 2201-1. The storage circuit within the latch circuit 2207-1 corresponding to the valid latch signal 2206-1 successively latches the analog LCD image data transferred via the image data bus 2204. The latched analog data is outputted to the data bus 2208-1. When the data fetch operation by the storage circuit within the latch circuit 2207-1 is completed, namely when the shift operation of the shift register 2205-1 is accomplished, the shift register 2205-1 caused the enable signal 2210-1 to be valid. When the enable signal 2210-1 becomes valid, the shift operation by the shift register 2205-2 employed in the drain driver 2201-2 provided at the subsequent stage is commenced. Then, the latch circuit 2207-2 sequentially latches the data which have been latched by the latch circuit 2207-1 employed in the drain driver 2201-1. Furthermore, when the data fetching operation by the storage circuit in the latch circuit 2207-2 is accomplished, the enable signal 2210-2 becomes valid and the drain driver 2201 at the next stage executes the similar operation to that of the drain drivers 2201-1 and 2201-2. Since the respective drain drivers employed in the signal drive circuit perform this operation, the analog LCD image data for 1 horizontal line can be acquired.

After the LCD image data for 1 horizontal line have been latched by the latch circuit 2207 within the respective drain driver 2201, the latch clock 2203 becomes valid, so that the data for 1 horizontal line which have been stored in the latch circuit 2207 and will be transferred via the data bus 2208 of the respective drain driver 2201, are similarly stored in the latch circuit 2209. After the data have been stored in the latch circuit 2209, the shift register 2205 and the latch circuit 2207 of the respective drain drivers 2201 commence the similar operation to the above operation in order to fetch the data in the next line.

The latch circuit 2209 includes an amplifier circuit which improve the drive capability of the latched analog data to obtain the LCD apply voltage which will then be outputted to the signal line 2115.

In this embodiment, as the internal arrangement of the liquid crystal panel 120 is similar to that of FIG. 1 and also the structures of the signal drive circuits 2113 and 2114 are arranged at the upper side and the lower side of the liquid crystal panel 120, the drive waveforms of the LCD apply voltages are similar to those of FIGS. 8 and 11.

The LCD drive operation similar to that of the previous embodiment shown in FIG. 1 may be realized with employment of the signal drive circuits 2113 and 2114 and also this AC circuit 1807. Therefore, the conditions under which the voltages are applied to the LCD panel 120 are similar to that of the embodiment shown in FIG. 1, so that a high quality LCD display can be obtained.

Furthermore, even when the signal line of the LCD panel would be extracted from either the upper side, or the lower side, since the drain driver 2201 for constituting the signal drive circuit employed in this embodiment is arranged at the side where the signal line is extracted in a similar manner to that of FIG. 14, and also the level shifter is provided between the drain drivers 2201 there may be provided similar effects to those of the previous embodiment shown in FIG. 14.

Figure 23:
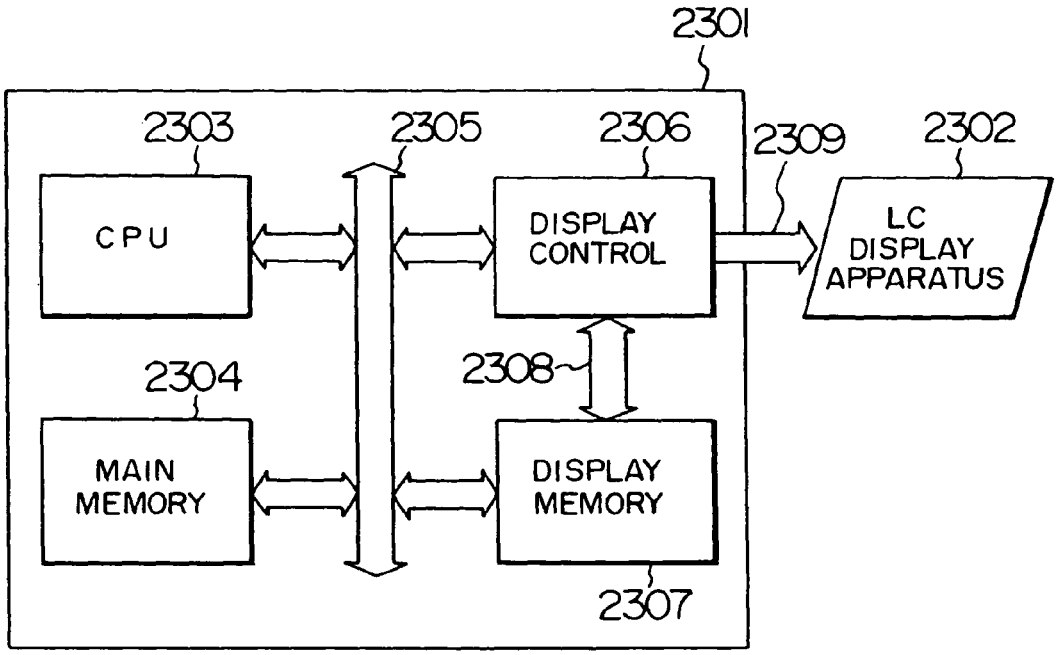
FIG. 23 is a schematic block diagram for indicating an information processing apparatus according to one embodiment of the present invention.
Figure 24:
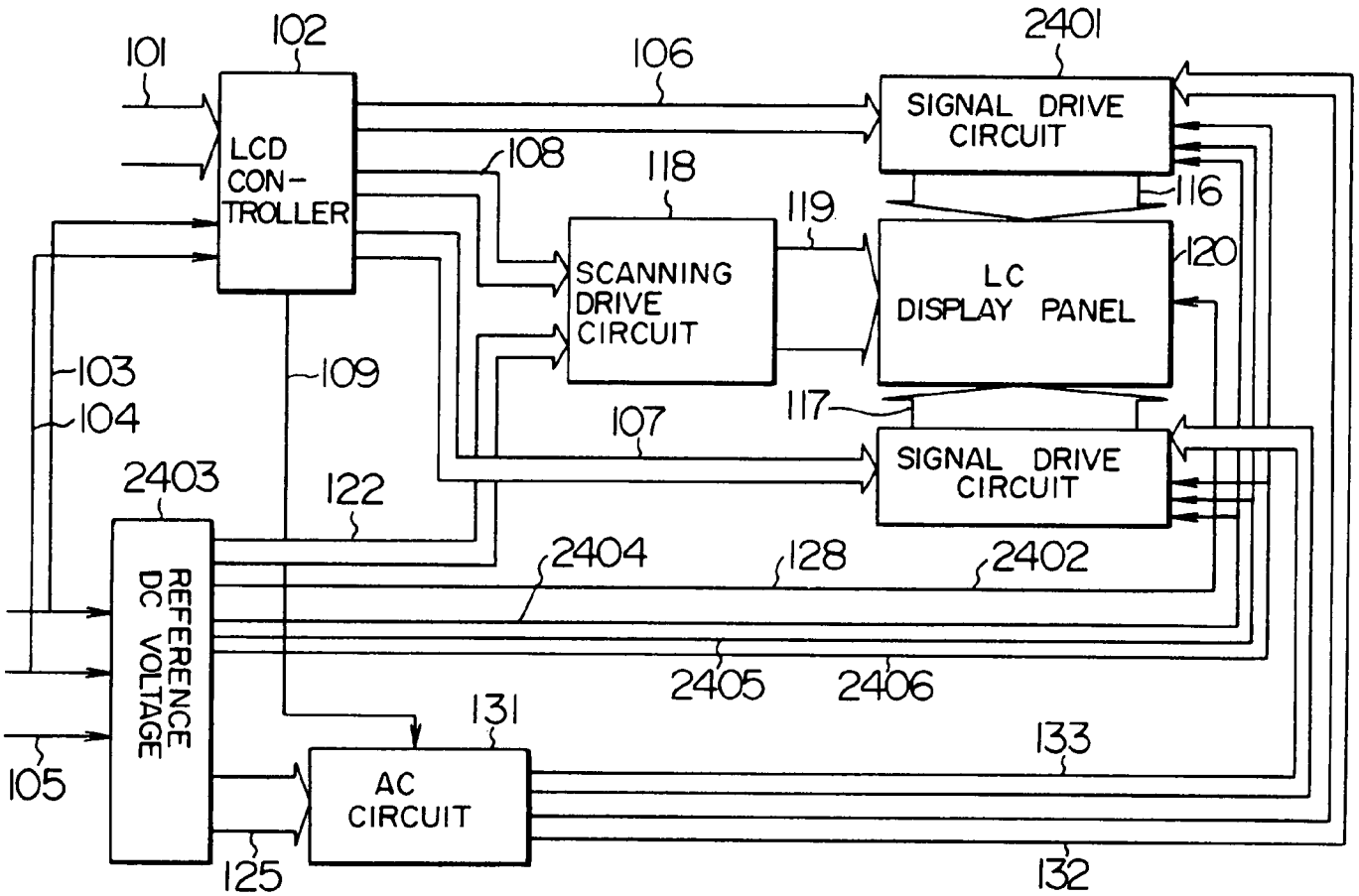
FIG. 24 is a schematic block diagram for showing a system arrangement of the conventional liquid crystal display apparatus.
Figure 25:
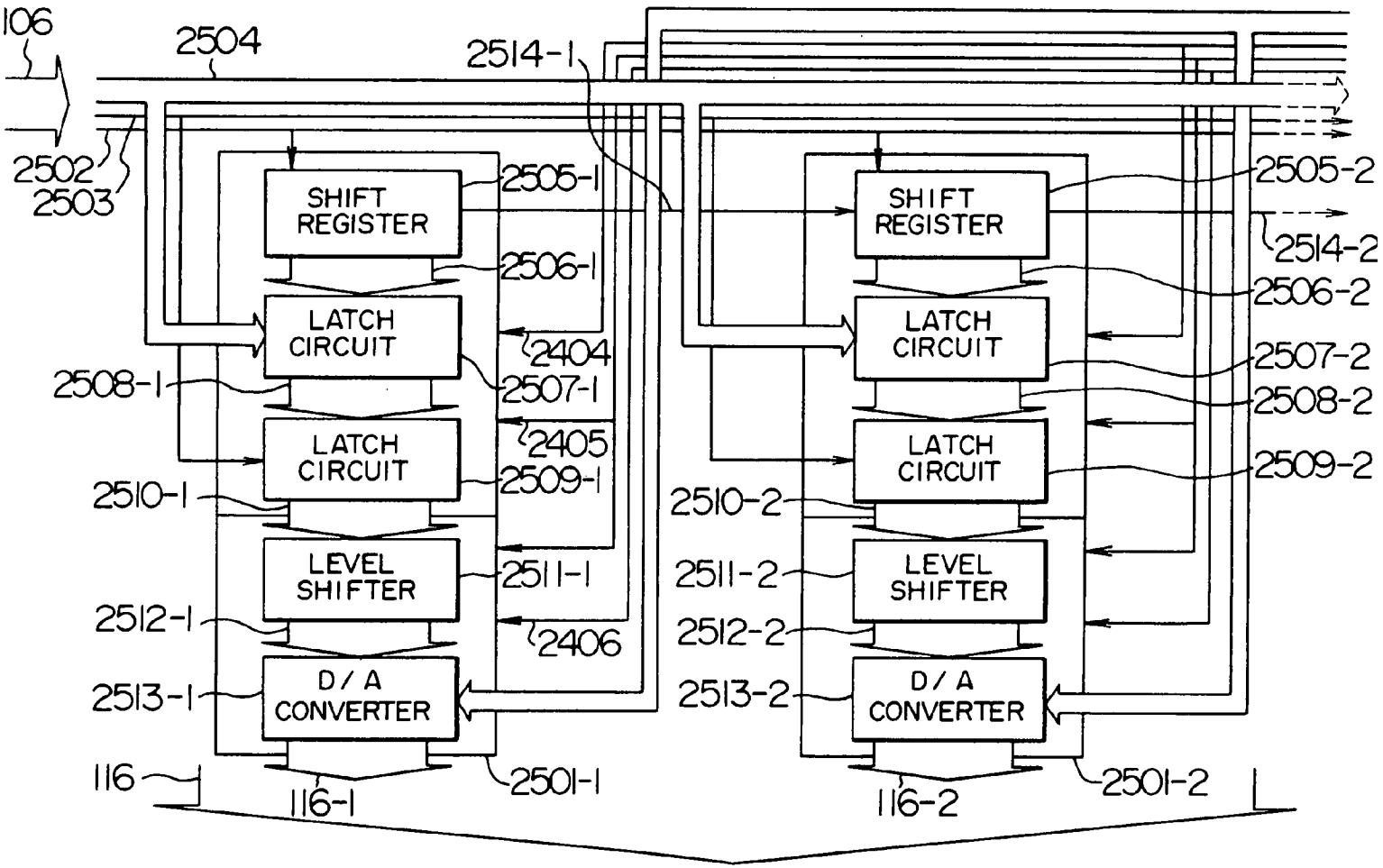
FIG. 25 is a schematic block diagram of the conventional signal drive circuit as one example.
Figure 26:
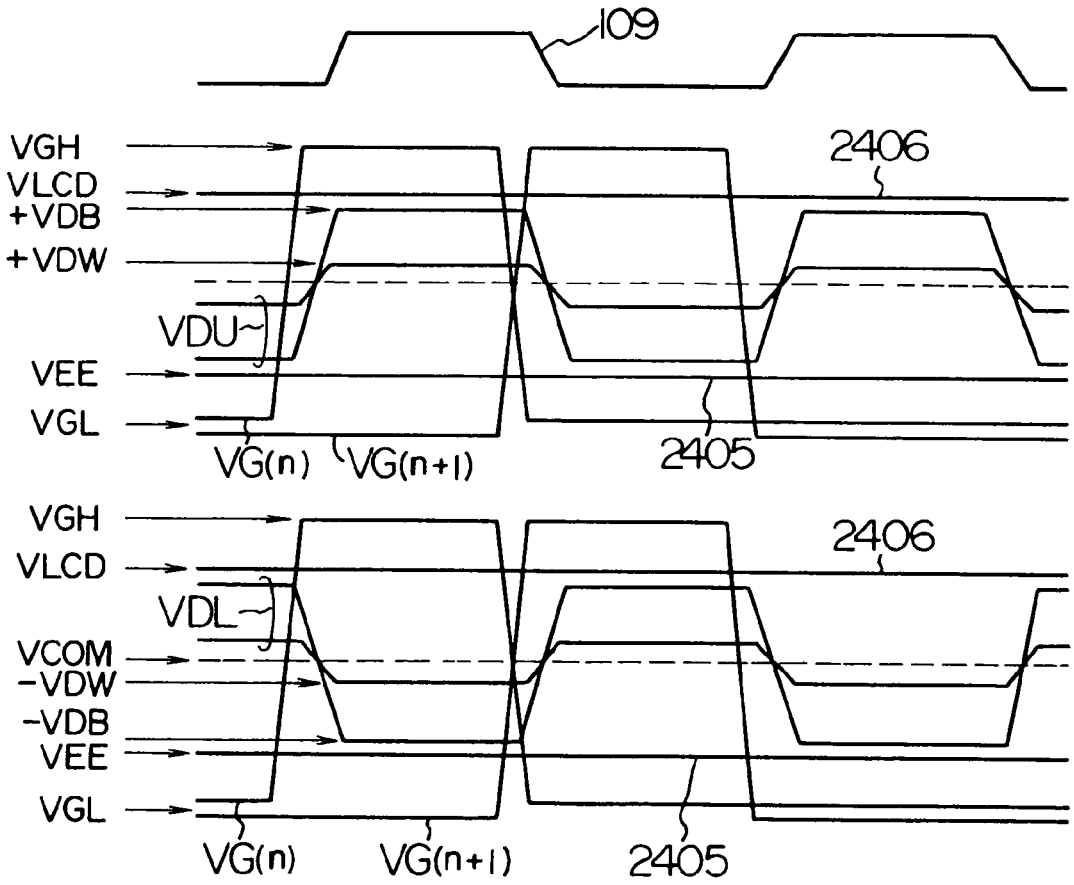
FIG. 26 shows a drive waveform (line AC) of the conventional LCD display apparatus.
Figure 27:
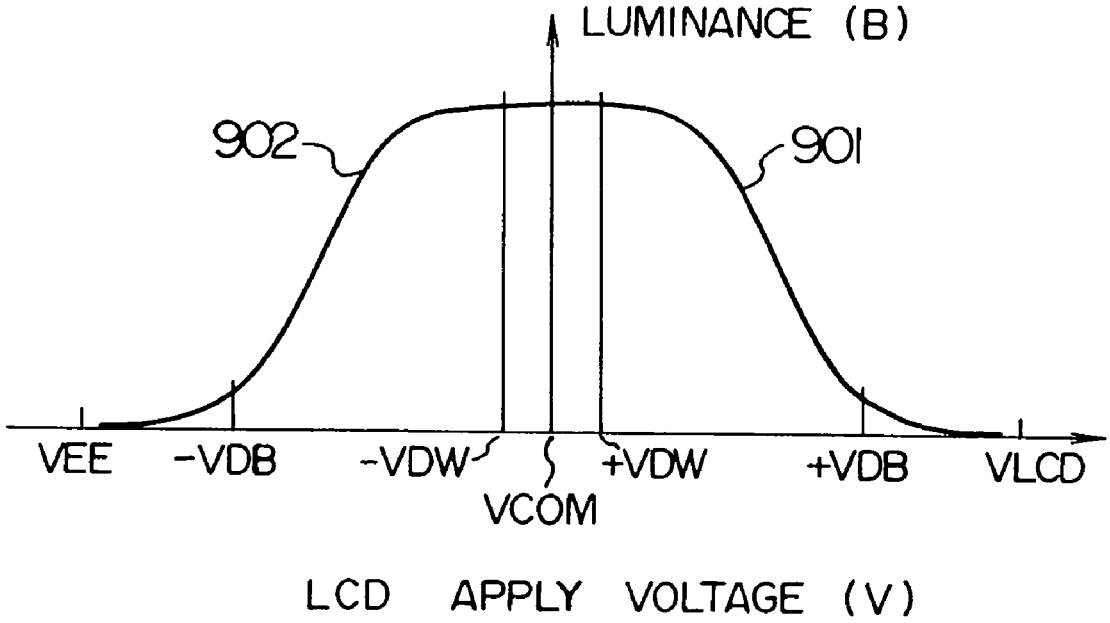
FIG. 27 is a graphic representation for showing a voltage-luminance characteristic of liquid crystal.
Figure 28:
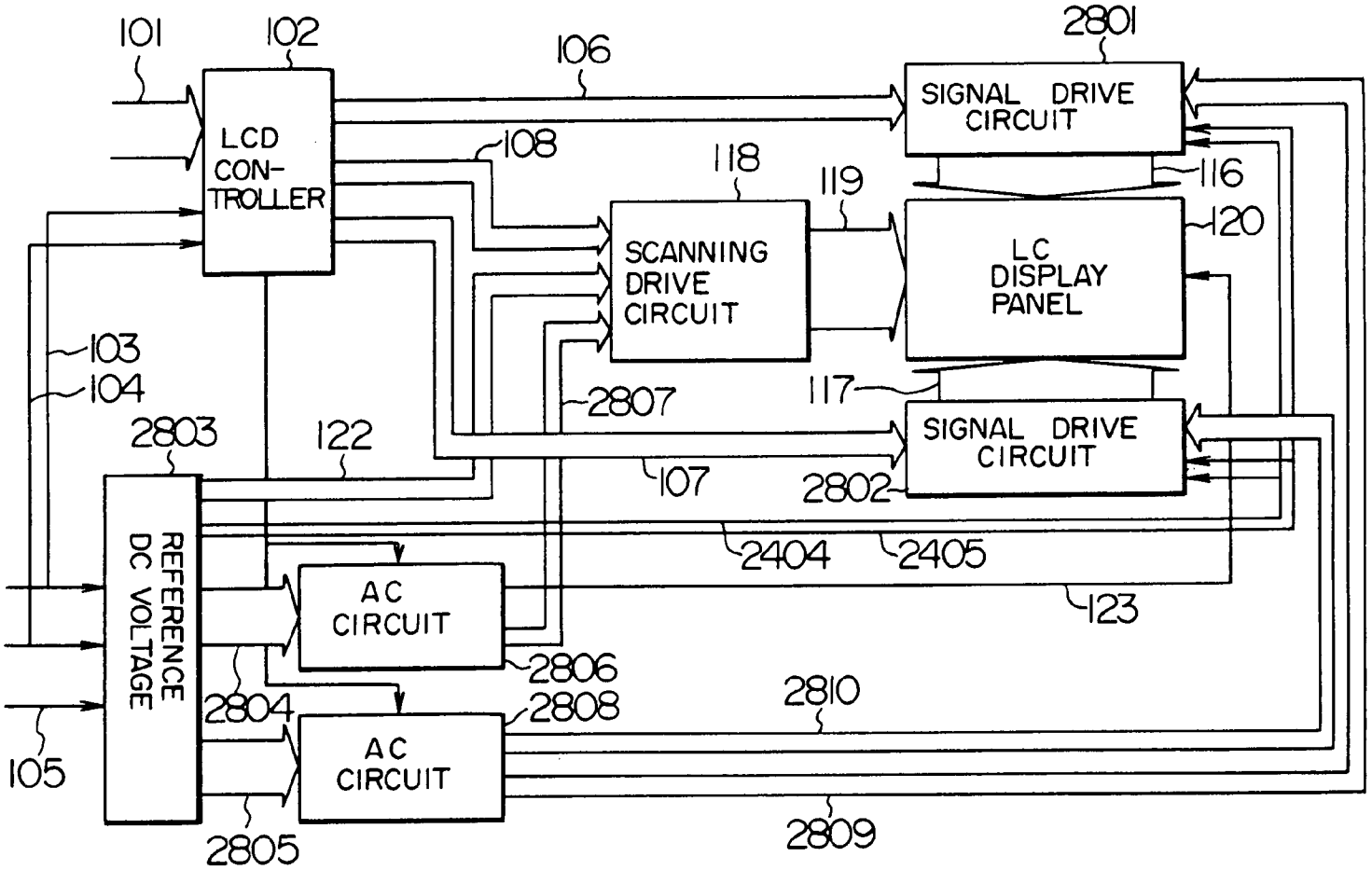
FIG. 28 schematically shows a system arrangement of the conventional LCD display apparatus as another example.
Figure 29:
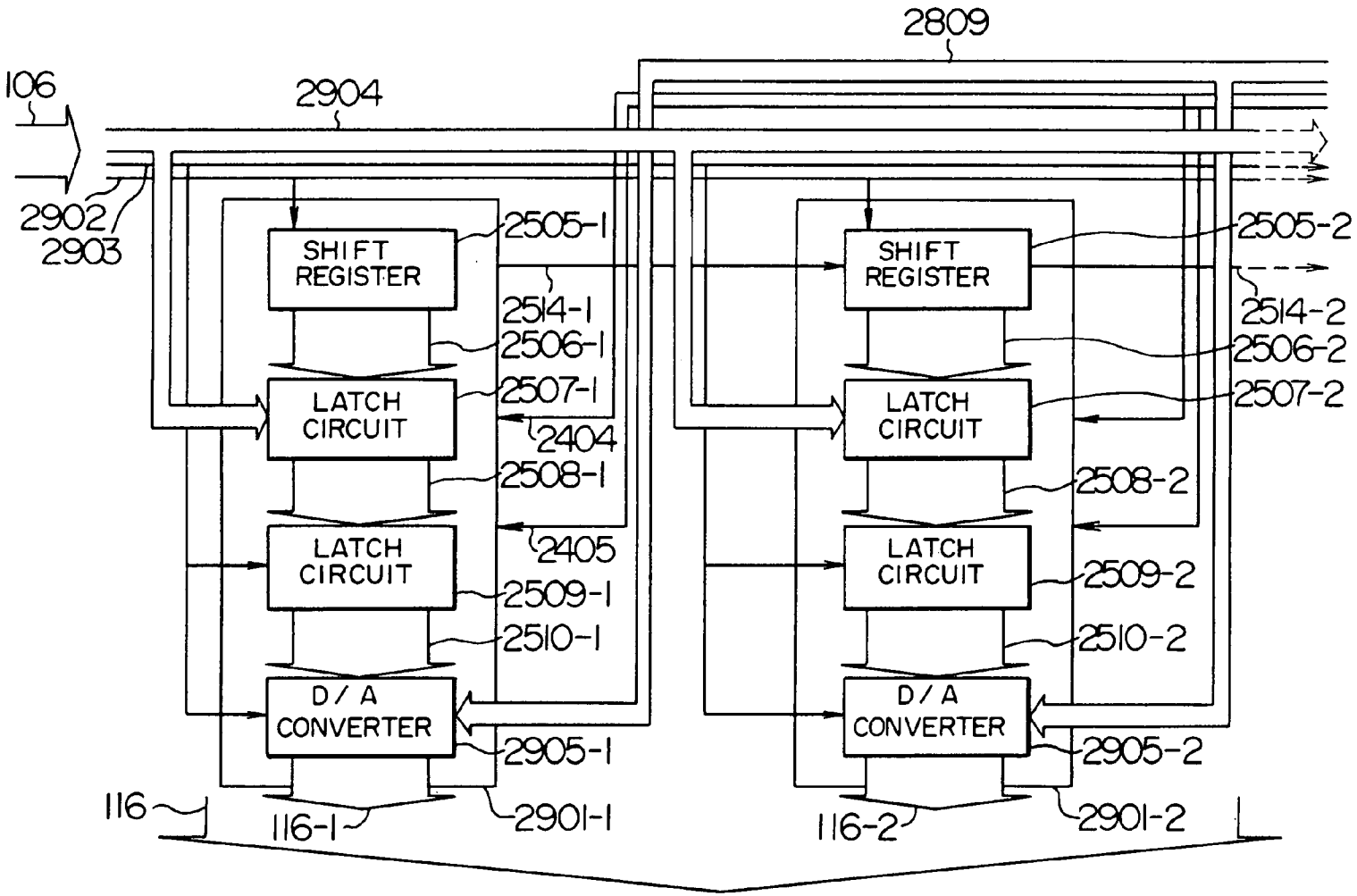
FIG. 29 is a schematic block diagram for showing the conventional signal drive circuit as another example.
Figure 30A:
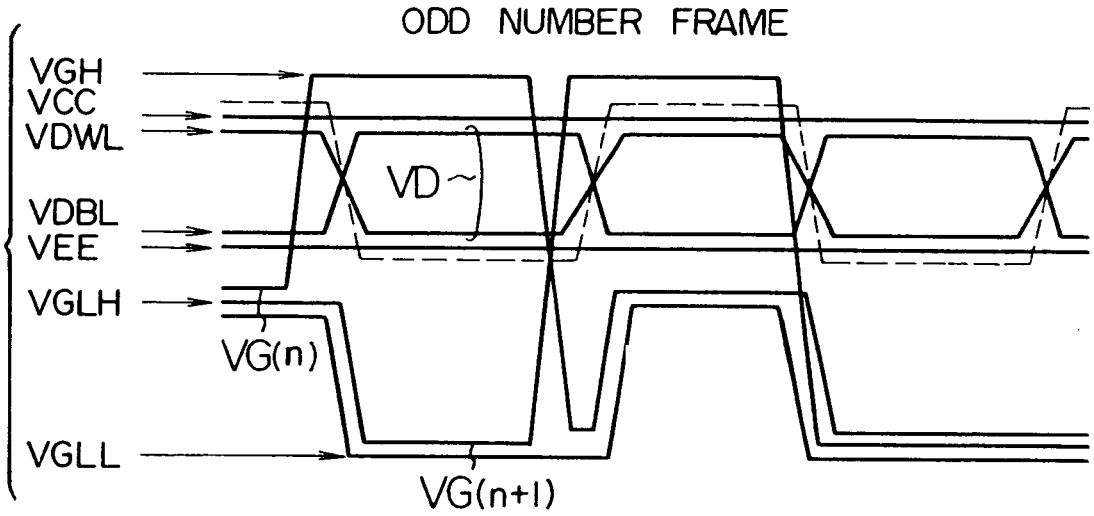
FIG. 30 shows a drive waveform (line AC) of the conventional LCD display apparatus as a further embodiment.
Figure 30B:
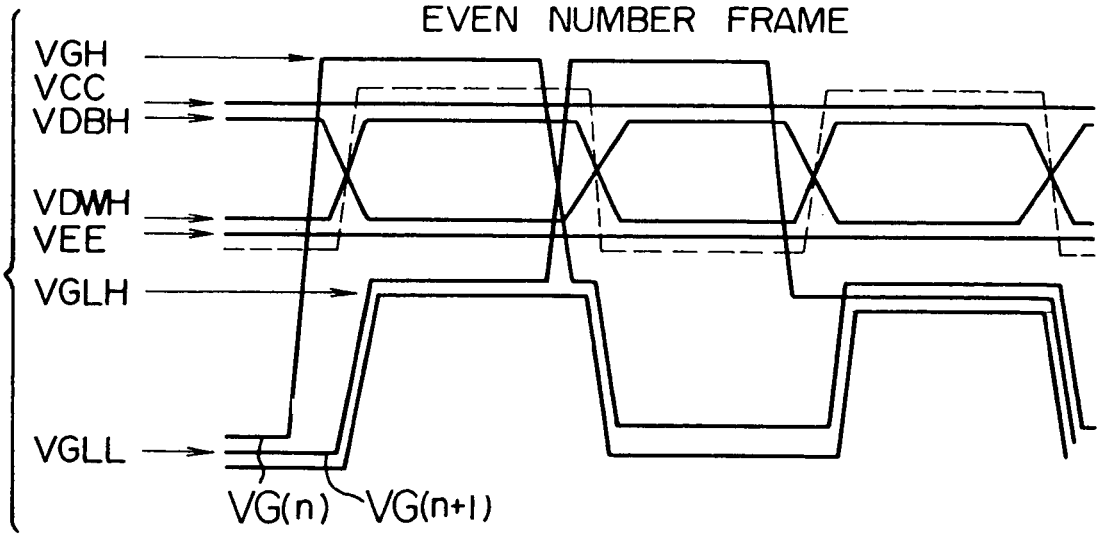
Figure 31:
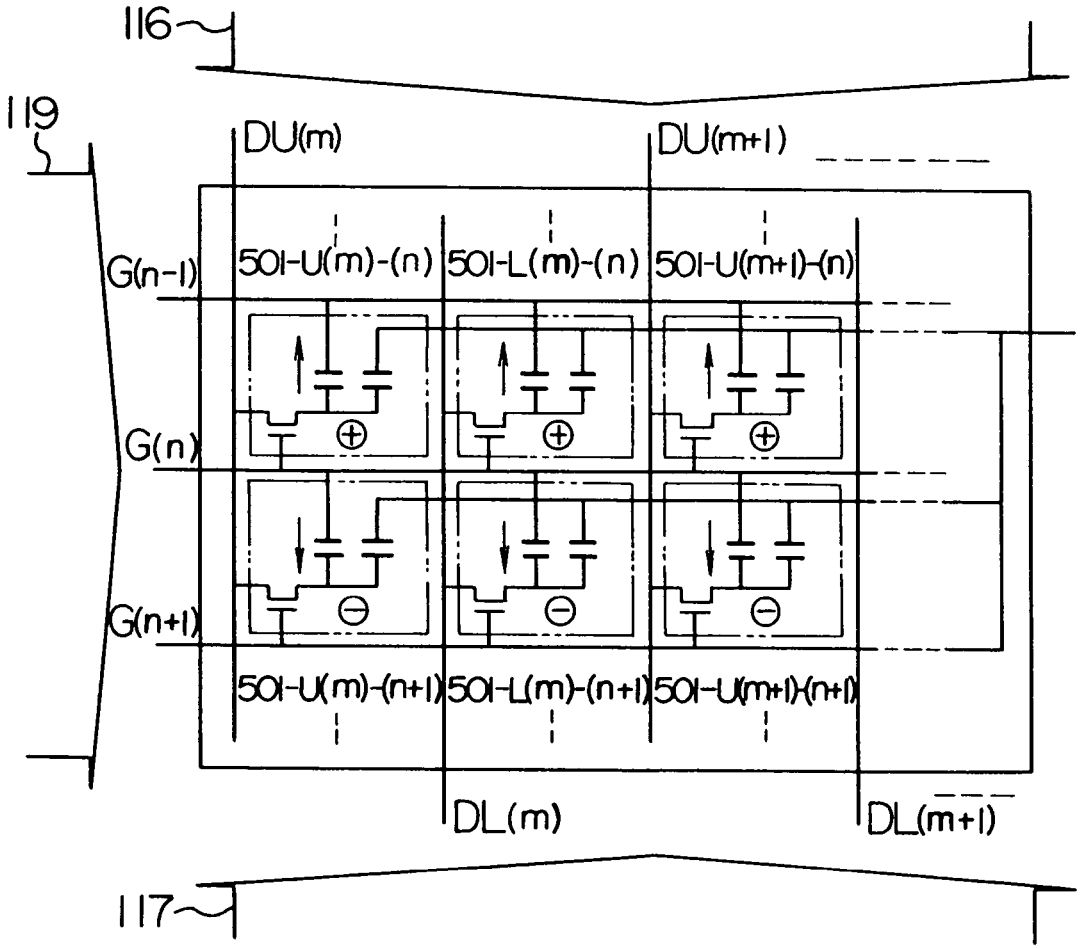
FIG. 31 shows an equivalent circuit of the conventional LCD panel in which current directions are represented.
Figure 32:
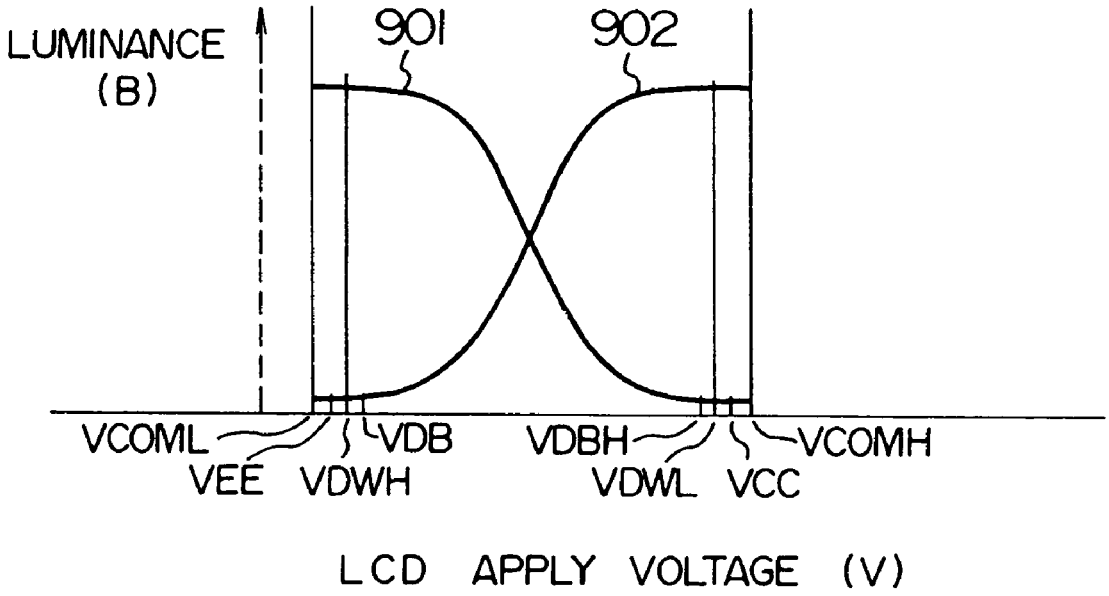
FIG. 32 is a graphic representation of a voltage-luminance characteristic of liquid crystal.

In FIG. 23, there is shown a block diagram of an information processing apparatus with employment of the liquid crystal display apparatus according to the present invention.

In FIG. 23, reference numeral 2301 indicates a main body of the information processing apparatus such as a personal computer, and reference numeral 2302 denotes the liquid crystal display apparatus according to the present invention. Reference numeral 2303 indicates a central processing unit, reference numeral 2304 is a main memory, and a reference numeral 2305 indicates a system bus. Reference numeral 2306 shows a display control, reference numeral 2307 is a display memory, and reference numeral 2308 shows a display bus. Reference numeral 2309 represents a system bus for transferring image data and a synchronization signal.

An operation of an information processing apparatus shown in FIG. 23 will now be explained.

The central processing unit 2303 reads out a program stored in the main memory 2304, performs a calculation process, and writes the image data via the system bus 2305 and the display controller 2306 into the display memory 2307. The display controller 2306 reads out the image data stored in the display memory 2307, and outputs the read image data and also the synchronization signal via the system bus 2309 to the liquid crystal display apparatus 2302 for representation purposes. In accordance with this embodiment, the information processing apparatus with employment of the liquid crystal display apparatus 2302 may be constructed.

Figure 33:
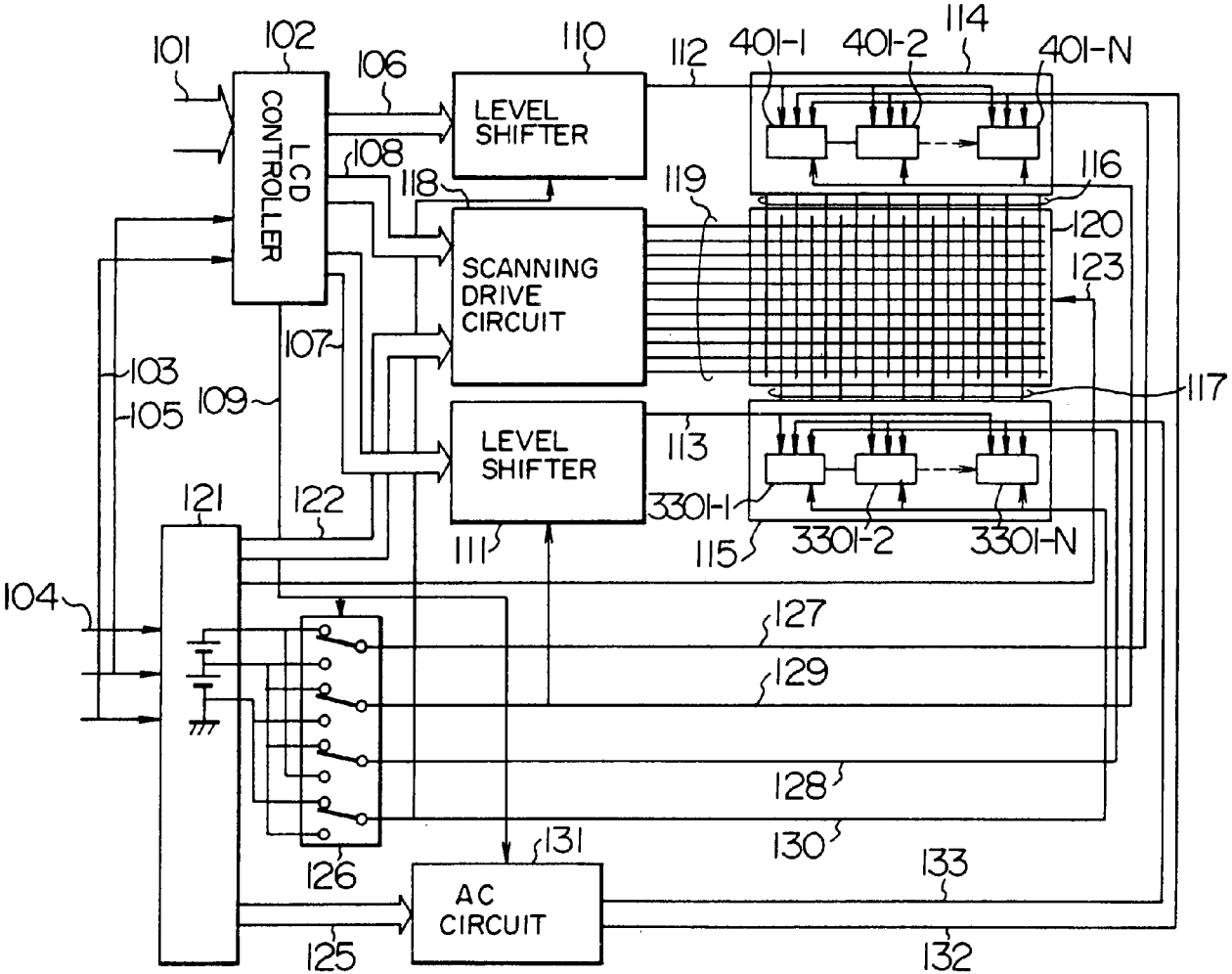
FIG. 33 schematically denotes a system arrangement of a system arrangement of a liquid crystal display apparatus according to another embodiment of the present invention.

A first embodiment of the present invention will now be explained with employment of a structural diagram shown in FIG. 33. Reference numeral 3301 denotes a drain driver for constituting a lower-sided signal drive circuit 115. As shown in this figure, reference voltages 127 to 130 of a drain driver 401 for constituting the upper-sided signal drive circuit 114, and of the drain driver 3301 for constituting the lower-sided signal drive circuit 115, which are generated in the AC circuit 126, can be produced as AC voltages in synchronism with the LCD AC signal 109.

Another object of the present invention, a further object, and another feature of the present invention will be appreciated from the below-mentioned description with reference to drawings.

Active Matrix LCD Display Apparatus

A description will now be made of an active matrix type color LCD apparatus to which the present invention has been applied. It should be noted that like reference numerals are employed as those for denoting the same functions in the following drawings, and thus no further explanation thereof are made.

Summary of Matrix Unit

Figure 34:
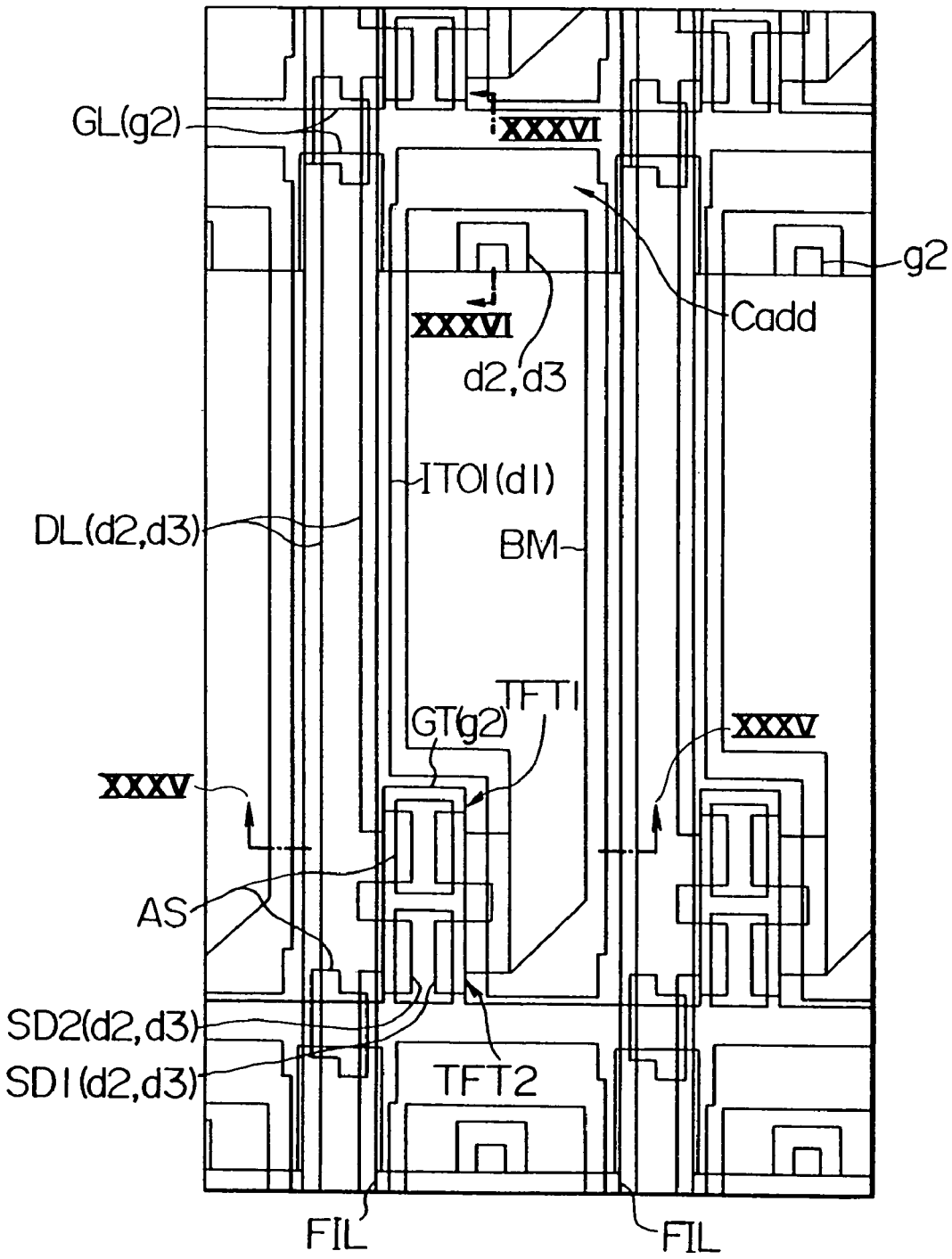
FIG. 34 is a plan view of major portions of a pixel of a liquid crystal display unit for an active matrix type color LCD display apparatus, and of a peripheral portion thereof, to which the present invention is applied.
Figure 35:
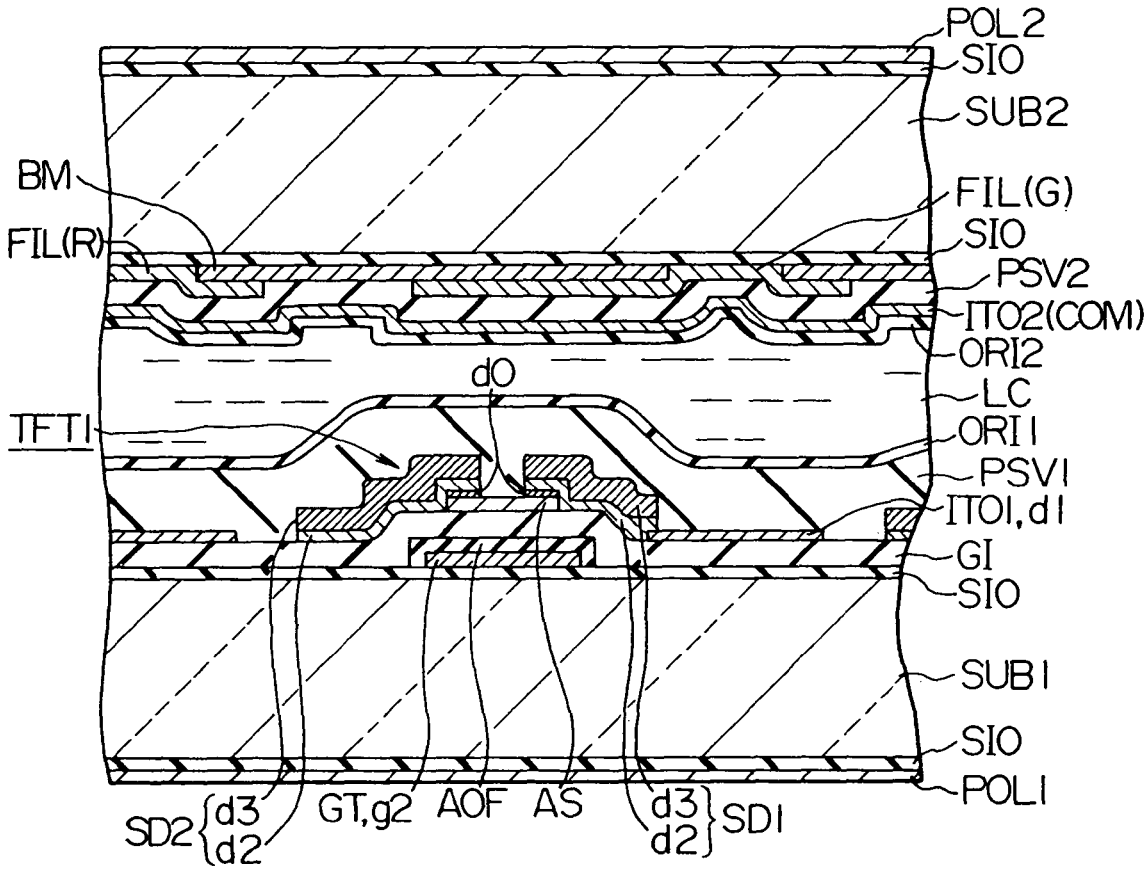
FIG. 35 is a sectional view for indicating one pixel and the peripheral portion thereof, taken along a cutting line 3-3 of FIG. 33.
Figure 36:
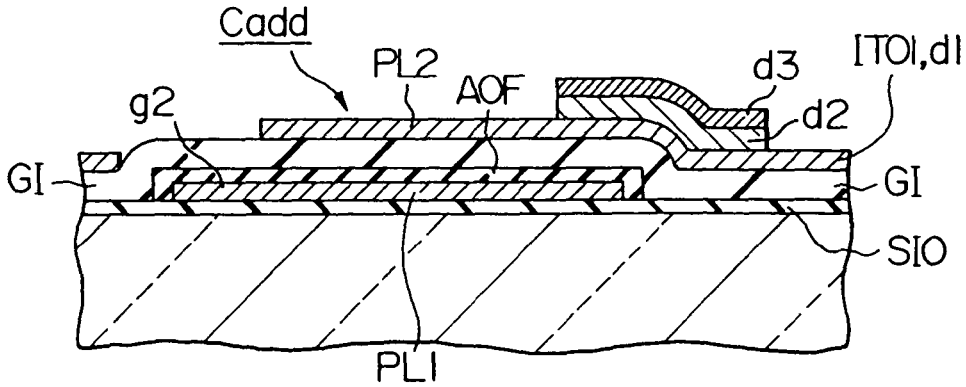
FIG. 36 is a sectional view of an added capacitance Cadd, taken along a cutting line 4-4 of FIG. 33.

FIG. 34 is a plan view for showing a pixel and a peripheral portion thereof in the active matrix type color liquid crystal display (LCD) apparatus to which the present invention is applied. FIG. 35 is a sectional view of the color LCD apparatus, taken along a cutting line A-A' of FIG. 34. FIG. 36 is a sectional view of the color LCD apparatus, taken along a cutting line B-B of FIG. 34.

As shown in FIG. 34, each pixel is arranged within an intersecting region (region surrounded by four signal lines) between two adjacent scanning lines (gate signal lines or horizontal signal lines) GL and two adjacent picture signal lines (drain signal lines or vertical signal lines) DL. Each of the pixels contains a thin-film transistor TFT, a transparent pixel electrode IT01, and a storage capacitance element Cdd. The scanning signal lines GL are elongated along left and right directions, as viewed in this drawing, and a plurality of scanning signal lines GL are arranged along upper and lower directions. The picture signal lines DL are elongated along the upper and lower directions, and a plurality of picture signal lines DL are arranged along the upper and lower directions.

As illustrated in FIG. 35, a thin-film transistor TFT and a transparent pixel electrode IT01 are fabricated at a side of a lower transparent glass substrate SUB1 on the basis of a color filter FIL and a light shielding black matrix pattern BM are formed at a side of an upper transparent glass substrate. Silicon oxide films SIO formed by way of the dip process and the like are provided on both surfaces of the transparent glass substrates SUB1 and SUB2.

On a surface of an inside (namely, side of liquid crystal LC) of the upper transparent glass substrate SUB2, the light shielding film BM, the color filter FIL, a protection film PSV2, a transparent common pixel electrode ITO2 (COM), and an upper orientation film ORI2 are successively provided in a stacked form.

Summary of Matrix Peripheral Portion

Figure 37:
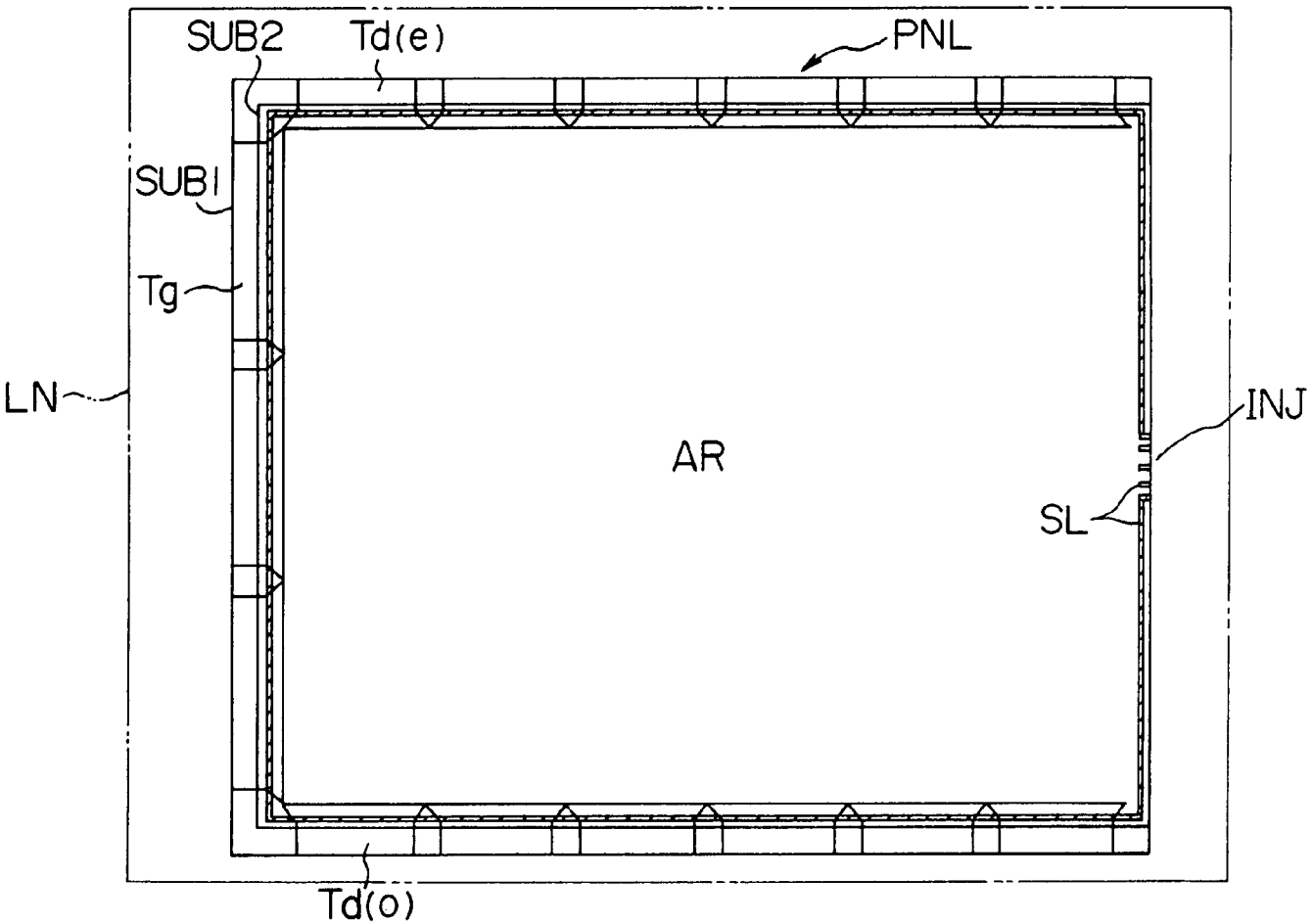
FIG. 37 is a plan view for explaining a structure of a matrix peripheral portion of a display panel.
Figure 38:
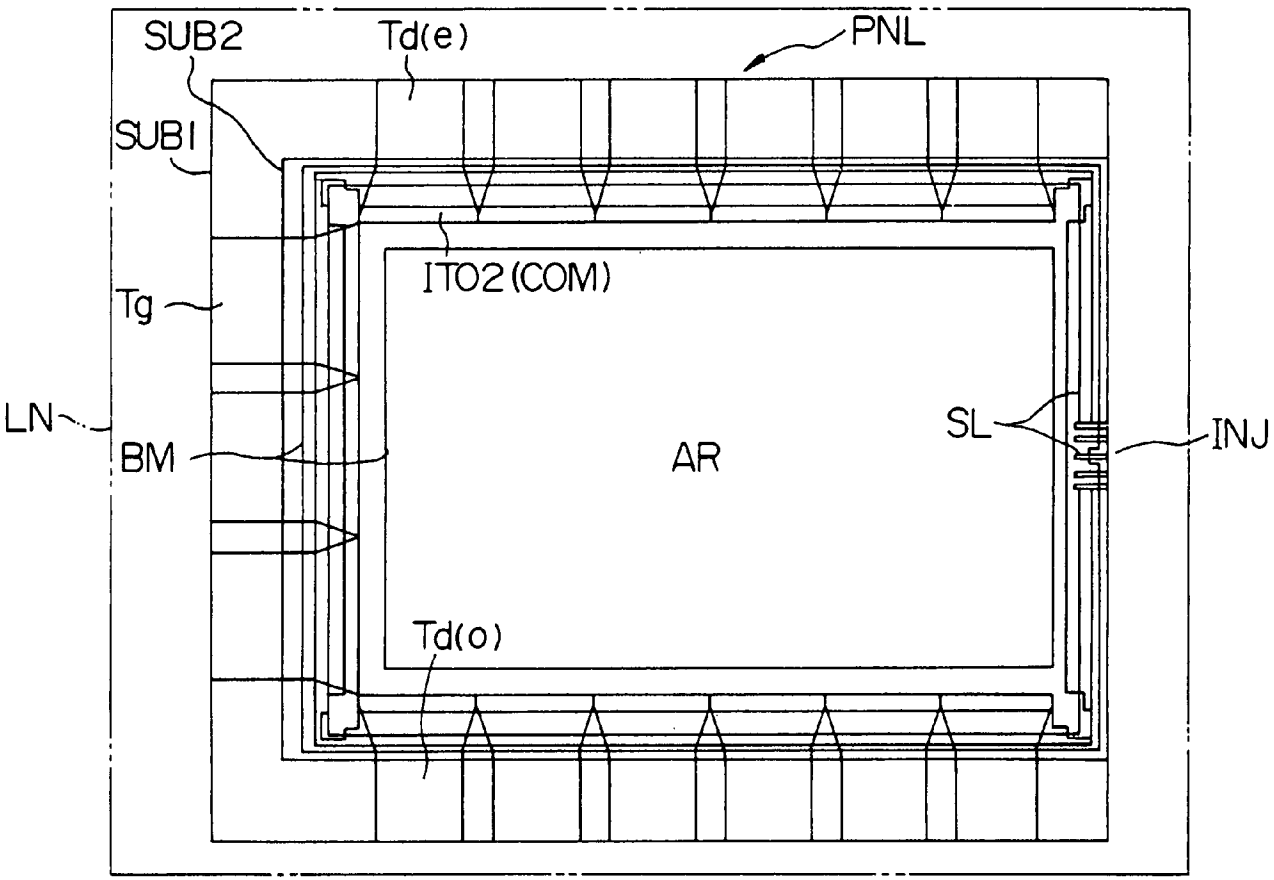
FIG. 38 is another plan view for explaining the panel more concretely with an exaggerate peripheral portion of FIG. 36.
Figure 39:
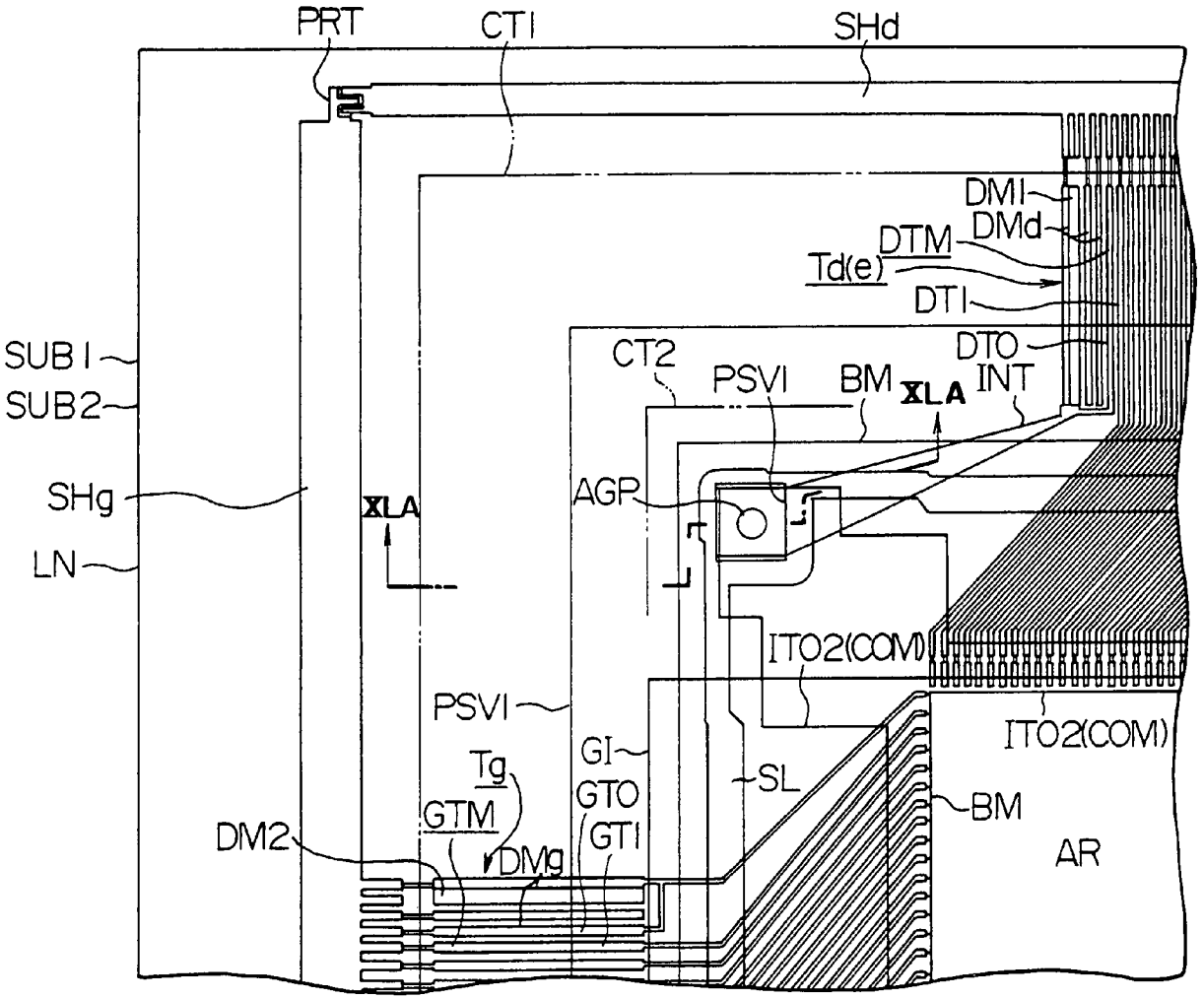
FIG. 39 is an enlarged plan view of corners of the display panel containing electric connection units of upper/lower substrates.
Figure 40A:
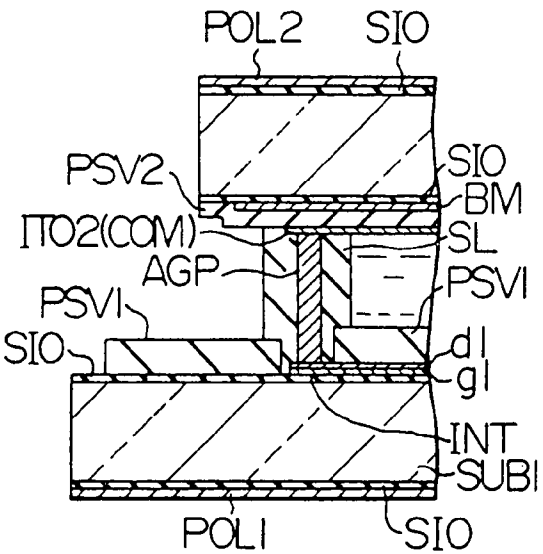
FIG. 40 is a sectional view for representing that the pixel unit of the matrix is positioned at a center, and both of panel corners and video signal terminals are located on both sides.
Figure 40B:
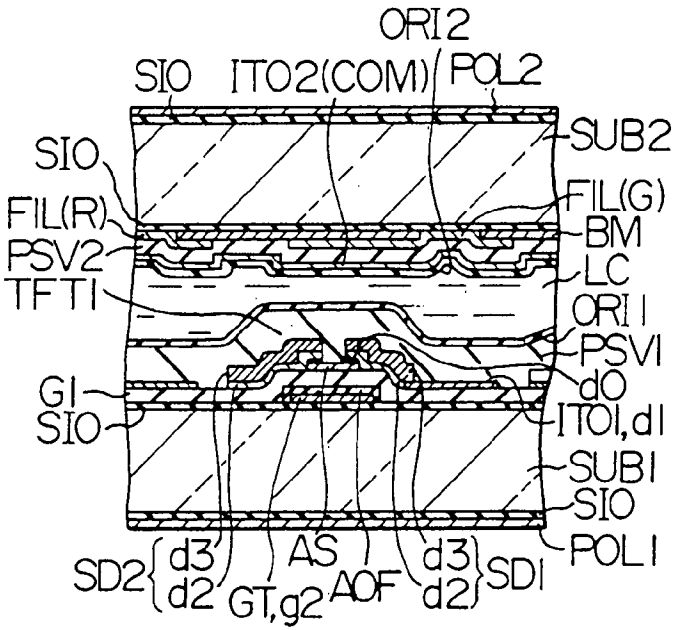
Figure 40C:
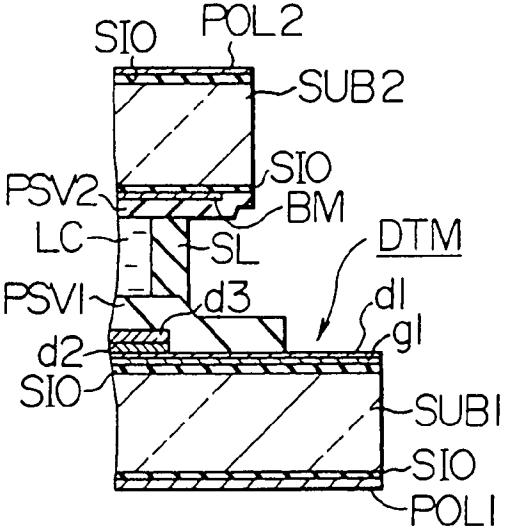
Figure 41B:
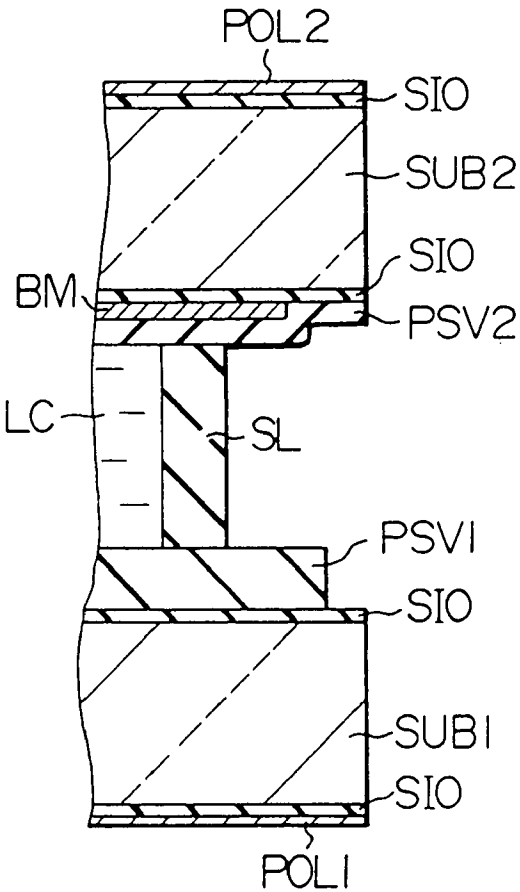
FIG. 41 is a sectional view for showing that a scanning signal terminal is located at a left side and a panel edge portion having no external connection terminal is located at a right side.
Figure 41A:
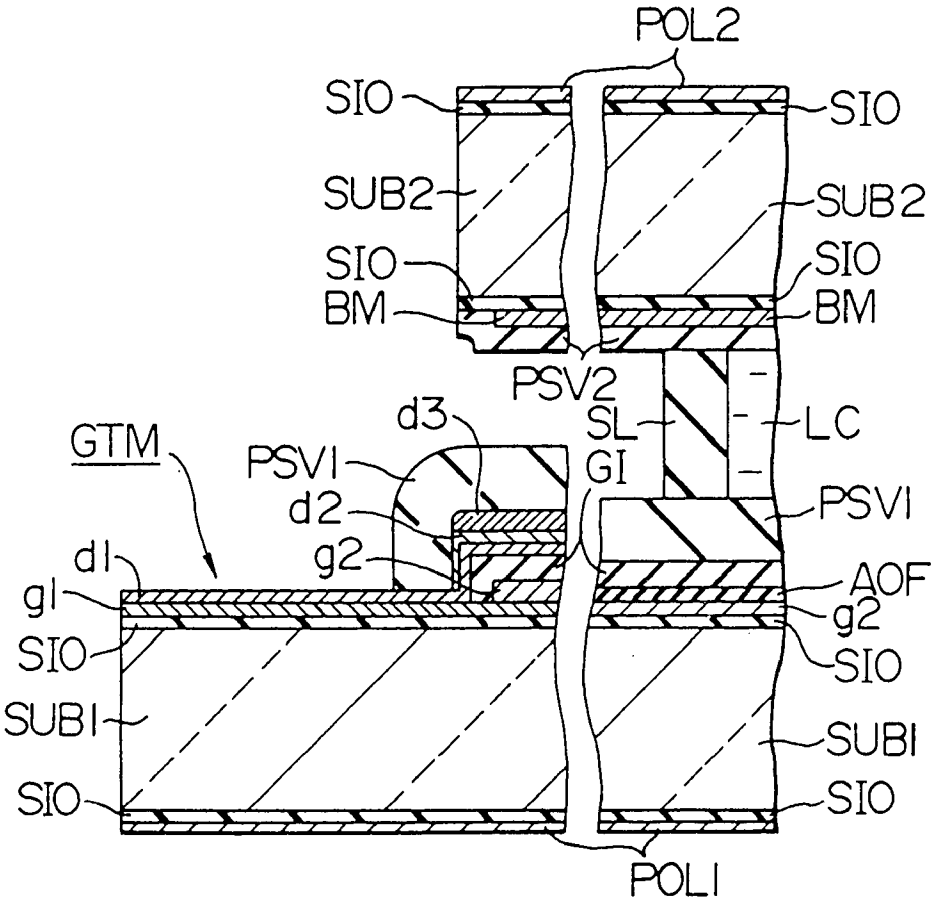

FIG. 37 is a plan view for showing a major portion of a matrix (AR) peripheral portion for a display panel PNL containing the upper/lower glass substrates SUB1 and SUB2. FIG. 38 is a plan view for showing an exaggerated peripheral portion. FIG. 39 is a plan view for representing an enlarged sealing portion SL corresponding to the panel left upper corner. FIG. 40 is a sectional view in which a left-sided sectional view portion shows the sealing portion SL, taken along a cutting line C-C' of FIG. 39, a centered sectional view portion shows the pixel of FIG. 34, and a right-sided sectional view portion shows an external connection terminal DTM to which a picture signal drive circuit should be connected. Similarly, FIG. 41 is a sectional view in which a left-sided sectional view portion shows an external connection terminal GTM to which a scanning circuit should be connected, and a right-sided sectional view shows a sealing portion without the external connection terminal.

In manufacturing of this LCD panel, in case of a small size, after a plurality of devices have been simultaneously made on a single glass substrate, these devices are subdivided in order to improve throughput, whereas in case of a large size, after a glass substrate having a standardized size has been processed for any types of devices, this large-sized glass substrate is subdivided in accordance with proper sizes to various sorts of devices. In any case, the glass is cut after a series of processing steps has been completed. FIGS. 37 to 39 represent the latter case. FIGS. 37 and 38 represent that the upper and lower substrates SUB1 and SUB2 have been cut. FIG. 39 indicates the upper and lower substrates before the cutting process, in which symbol LN denotes edges of both substrates before the cutting process, and symbols CT1 and CT2 represent positions at which those substrates SUB1 and SUB2 should be cut. In any cases, the dimension of the upper-side substrate SUB2 is limited to be inside of the lower side substrate SUB1 in such a manner that when the external connection terminal groups Tg and Td exist (upper/lower edges and left edge in this figure), these group portions are exposed under complete state. The terminal groups Tg and Td are referred to such a state that a plurality of scanning circuit connecting terminal GTM and the picture signal circuit connecting terminals DTM, and also leading wire portions are combined with each other in unit of tape carrier package TCP (see FIGS. 47, 48) on which an IC chip CHI has been mounted (will be discussed). The leading wires extended from the matrix unit to the external connection terminal unit for each group, are inclined, while these wires approach to both ends. This is because the terminals DTM and GTM of the display panel PNL are fitted to the connection terminal pitch in the respective packages TCP and the arranging pitch of the package TCP.

A sealing pattern SL is formed except for an LCD sealing inlet IVJ, along edges of the transparent glass substrates SUB1 and SUB2 so as to seal the liquid crystal LC. The sealing material is made from, for instance, an epoxy resin. At least one portion of the common transparent pixel electrode IT02 at the side of the upper transparent glass substrate SUB2 is connected to the lead wires INT fabricated at the side of the lower transparent glass substrate SUB1 by a silver paste material AGP at the four corners of the LCD panel in accordance with this embodiment. The lead wires INT are manufactured at the same step with the gate terminal GTM and the drain terminal DTM (will be discussed later).

Each layer of the orientation film ORT1, the transparent pixel electrode IT01, and the common transparent pixel electrode IT02 are formed inside the sealing pattern SL. Polarizing plates POL1 and POL2 are formed on outer surfaces of the lower transparent glass substrate SUB1 and the upper transparent glass substrate SUB2, respectively. The liquid crystal LC is sealed into a region partitioned between the lower orientation film CRI1 and the upper orientation ORI2 which set orientation of liquid crystal molecule. The lower orientation film ORI1 is formed on an upper portion of the protection film PSV1 at the side of the lower transparent glass substrate SUB1.

This liquid crystal display apparatus is assembled in such a manner that various layers are stacked at each side of the lower transparent glass substrate SUB1 and the upper transparent glass substrate SUB2, the sealing pattern SL is formed at the substrate SUB2, the lower transparent glass substrate SUB1 and the upper transparent glass substrate SUB2 are stacked, the liquid crystal LC is injected from the opening portion INJ of the sealing material SL, the injection port INJ is sealed by an epoxy resin or the like, and the upper/lower substrates are cut.

Thin-Film Transistor TFT

Referring back to FIGS. 34 and 35, a structure of the TFT substrate SUB1 will now be explained more in detail.

The thin-film transistor TFT is operated in such a manner that when a positive bias voltage is applied to the gate electrode GT, the channel resistance between the source and the drain becomes small, and when the bias voltage becomes zero, the channel resistance becomes large.

A plurality (two) of thin-film transistors TFT1 and TFT2 are formed on the respective pixels. Each of these thin-film transistor TFT1 and TFT2 is fabricated in an essentially same size (channel length and channel width are the same), and has an i type semiconductor layer AS constructed of a gate electrode GT, a gate insulating film GI and an i type (intrinsic type, namely no conductivity type determining impurity is doped) amorphous silicon (Si), and a pair of source electrode SD1 and drain electrode SD2. It should be understood that since a source and a drain are originally determined based on a biasing polarity between then, and this polarity is inverted during its operation in the circuit of the liquid crystal display apparatus according to the present invention, the drain and the source may be substituted by each other during the operation.

However, for the sake of easy explanation, the following description defines that one electrode is a source and the other electrode is a drain.

Gate Electrode GT

The gate electrode GT is formed in such a shape that this gate electrode projects from the scanning signal line GL along the vertical direction (branched in a T-shaped form). The gate electrodes GT project from the active regions of the thin-film transistors TFT1 and TFT2. The respective gate electrodes GT of the thin-film transistors TFT1 and TFT2 are constructed in an integral form (namely as a common gate electrode), and are formed continuous to the scanning signal line GL. As the second conductive film g2, for instance, an aluminum (Al) film formed by a sputtering method is employed, and an anode oxide film AOF of aluminum is provided on this aluminum film.

This gate electrode GT is fabricated with having a relatively large size in order to completely cover the i type semiconductor layer AS (as viewed from bottom), so that neither light nor back light is incident upon, or illuminated to the i type semiconductor layer AS.

Scanning Signal Line GL

The scanning signal line GL is constructed of the second conducting film g2. The second conducting film g2 of the scanning signal line GL is manufactured by the same manufacturing step with the second conducting film g2 of the gate electrode GT, and also fabricated in an integral form. Also, an anode oxide film AOF of aluminum is provided on the scanning signal line GL.

Insulating Film GI

In the thin-film transistors TFT1 and TFT2, the insulating film GI is used as a gate insulating film used to apply an electric field to the semiconductor layer AS in conjunction with the gate electrode GT. The insulating film GI is fabricated on the upper layers of the gate electrode GT and the scanning signal line GL. As the insulating film GI, a selection is made of a silicon nitride film made of, e.g., the plasma CVD method, and a thickness thereof is approximately 1,200 to 2,700 angstroms (on the order of 2,000 angstroms in this embodiment). As illustrated in FIG. 39, the gate insulating film GI is so fabricated as to cover an entire portion of the matrix portion AR, and a peripheral portion is removed in such a manner that the external connection terminals DTM and GTM are exposed. The insulating film GI also contributes to establish electric insulating of the scanning signal line GL and the picture signal line DL.

i Type Semiconductor Layer AS

In this embodiment, the i type semiconductor layer AS are manufactured by amorphous silicon in such a manner that the i type semiconductor layer becomes an independent island in the respective thin-film transistors TFT1 and TFT2, and have a thickness of 200 to 2,200 angstroms (on the order of 2,000 angstroms in this embodiment). A layer d0 is an N(+) type amorphous silicon semiconductor layer into which phosphorus (P) used for an ohmic contact has been doped, and is remained only such places that the i type semiconductor layer AS is present at the lower side and the conducting layer d2 (d3) is present at the upper side.

The i type semiconductor layer AS is also provided at the crossover portion between the scanning signal line GL and the picture signal line DL. The i type semiconductor layer AS of this crossover portion causes shortcircuits between the scanning signal line GL and the picture signal line DL at the crossover portion.

Transparent Pixel Electrode IT01

The transparent pixel electrode IT01 constitutes one of the pixel electrode of the LCD display unit.

The transparent pixel electrode IT01 is connected to both of the source electrode SD1 of the thin-film transistor TFT1 and also the source electrode SD1 of the thin-film transistor TFT2. As a consequence, if defect happens to occur in one of these thin-film transistors TFT1 and TFT2, and a side effect may be produced, a proper portion of this defective TFT transistor is cut away by using laser light or the like. Conversely, if no side effect may be produced, no specific care is taken because the remaining normal TFT transistor is still operable. The transparent pixel electrode IT01 is constructed of the first conducting film d1. This first conducting film d1 is made of a transparent conducting film (indium-tin-oxide, - - - film) manufactured by the sputtering method, and has a film thickness of 1,000 to 2,000 angstroms (on the order of 1,400 angstroms in this embodiment).

Source Electrode SD1 and Drain Electrode SD2

Each of the source electrode SD1 and the drain electrode SD2 is constructed of a second conducting film d2 provided in contact with an N(+) type semiconductor layer d0 and a third conducting film d3 formed thereon.

The second conducting film d2 is fabricated by employing a chromium formed by the sputtering method with a thickness of 500 to 1,000 angstroms (on the order of 600 angstroms in this embodiment). If the chromium film would be made with a thicker thickness, stress becomes high, so that this thickness never exceed the thickness value of approximately 2,000 angstroms. This chromium film is aimed to make good adhesive characteristics with the N(+) type semiconductor layer N0 and also to prevent aluminum of the third conducting film d3 from being diffused into the N(+) type semiconductor layer d0 (a so-called "barrier layer"). Alternatively, other metal (Mo, Ti, Ta, W) films with high melting points, and metal silicide ($MoSi_2$, $TiSi_2$, $TaSi_2$, $WSi_2$) films with high melting points may be employed as this second conducting film d2.

The third conducting film d3 with a thickness of 3,000 to 5,000 angstroms is fabricated by the sputtering of aluminum (on the order of 4,000 angstroms in this embodiment). The aluminum film has low stress and may be made with a thicker thickness, as compared with the chromium film. Accordingly, this aluminum film owns such a function to reduce the resistance values of the source electrode SD1, the drain electrode SD2, and the picture signal line DL, and further to improve step coverages caused by the gate electrode GT and the i type semiconductor layer AS.

After the second conducting film d2 and the third conducting film d3 have been patterned by using the same mask pattern, the N(+) type semiconductor layer d0 is removed by either employing the same mask, or utilizing the second conducting film d2 and the third conducting film d3. In other word, the N(+) type semiconductor layer d0 left on the i type semiconductor layer AS is removed by way of the self-alignment, which corresponds the layer portions other than the second conducting film d2 and the third conducting film d3.

At this time, since all of the N(+) type semiconductor layers d0 are etched away along its thickness direction, although the surface portion of the i type semiconductor layer AS is more or less etched away, this difficulty may be avoided by controlling the etching time period.

Protection Film PSV1

Protection films PSV1 are provided on the thin-film transistor TFT and the transparent pixel electrode IT01. The protection film PSV1 is formed in order that the thin-film transistors TFT are mainly protected from humidity and soon, and has a high transparent characteristic and a high humidity resistivity. The protection film PSV1 is manufactured by a silicon oxide film, or a silicon nitride film which has been fabricated by, for example, a plasma CVD apparatus, and has a thickness of approximately 1 micron.

As represented in FIG. 39, the protection film PSV1 is formed in such a manner that this protection film entirely surrounds the matrix portion AR, and the peripheral portion thereof is removed to expose the external connecting terminals DTM and GTM. Also, such a portion of this protection film is removed where the common electrode COM of the upper substrate SUB2 is connected to the lead wires INT for external connection terminal by silver paste AGP. As to a relationship between the thickness of the protection film PSV1 and the thickness of the insulating film GI, the thickness of the protection film is made thicker due to protection effects, whereas the thickness of the insulating film is made thinner due to mutual conductance gm. As a consequence, as shown in FIG. 39, the protection film PSV1 having such a high protection effect is made larger than the gate insulating film GI in order that the peripheral portion thereof can be protected as widely as possible.

Light Shielding Film BM

At the side of the upper transparent glass substrate SUB2, the light shielding film BM for preventing either external light, or back light from being incident upon the i type semiconductor layer AS, is provided. A polygon contour line of the light shielding film BM represents by its inside an opening where no light shielding film BM is formed. The light shielding film BM is made of a high light shielding material such as an aluminum film and a chromium film. In this embodiment, the chromium film having a thickness of on the order of 1,300 angstroms is formed by the sputtering method.

As a result, the i type semiconductor layer AS of the respective thin-film transistors TFT1 and TFT2 are sandwiched by the upper/lower light shielding films BM and the gate electrode GT having a larger size, whereby neither externally supplied natural light, nor back light is incident thereon. The light shielding film BM is formed in a grid shape around the respective pixels (so-called "black matrix"). This grid partitions an effective display region of one pixel. As a result, the contours of the respective pixels become clear by way of the light shielding films BM, thereby improving contrast. In other words, the light shielding film BM owns two functions of light shielding and also "black matrix" with respect to the i type semiconductor layer AS.

Since the edge portions (lower right portion in FIG. 34) of the transparent pixel electrode ITO1 at the root side thereof along the rubbing direction are shielded by the light shielding film BM, even when domains happen to occur in the edge portions, no one can observe these domains, so that the LCD representation is not deteriorated.

As shown in FIG. 38, the light shielding film BM is formed in a frame shape around the peripheral portion, and a pattern thereof is fabricated in connection with a series of the matrix pattern where a plurality of dot-shaped openings are provided as shown in FIG. 34. As represented in FIG. 38 to 41, the light shielding film BM of the peripheral portion is extended outside the sealing portion SL, thereby preventing that leakage light such as reflection light caused by LCD-mounted products, e.g., a personal computer with an LCD display is entered into the matrix unit. On the other hand, this light shielding film BM is retained inside the edge of the substrate SUB2 by approximately 03 to 1.0 mm in order to detour around the cutting region of the substrate SUB2.

Color Filter FIL

The color filter FIL is formed in a stripe shape that a repetition of red, green, and blue filters is made at the positions located opposite to the pixels. The color filter FIL is made large so as to cover the entire region of the transparent pixel electrode ITO1. The light shielding film BM is formed inside the peripheral portion of the transparent pixel electrode ITO1 in order to overlap with the color filter FIL and the edge portion of the transparent pixel electrode ITO1.

The color filter FIL is fabricated as follows. First, a dyeing material such as an acrylate resin is formed on the surface of the upper transparent glass substrate SUB2, and the dyeing material other than the red filter forming region is removed by way of the lithographic technique. Subsequently, the dyeing material is colored by red dye and then processed by the fixing process to form a red filter "R". Next, a similar process is carried out, whereby a green filter "G" and a blue filter "B" are sequentially fabricated.

Protection Film PSV2

The protection film PSV2 is provided in order to prevent the dye of the color filter FIL from being leaked into the liquid crystal LC. The protection film PSV2 is manufactured by such a transparent resin material as, for example, an acrylate resin and an epoxy resin.

Common Transparent Pixel Electrode ITO2

The common transparent pixel electrode ITO2 is positioned opposite to the transparent pixel electrode IT01 provided for each pixel at the side of the lower transparent glass substrate SUB1, and an optical condition of the liquid crystal LC is varied in response to a potential difference (electric field) between the respective pixel electrode ITO1 and the common transparent pixel electrode ITO2. It is so constructed that a common voltage Vcom is applied to this common transparent pixel electrode ITO2. In accordance with this embodiment, the common voltage Vcom is set to a DC intermediate potential between a minimum-leveled drive voltage Vdmin and a maximum-leveled drive voltage Vdmax, which are applied to the picture signal line DL. It should be noted that a plane shape of the common transparent pixel electrode ITO2 is referred to FIGS. 37 and 38.

Structure of Held Capacitance Element Cadd

The transparent pixel electrode ITO1 is formed in such a manner that both of one end portion thereof connected to the thin-film transistor TFT and the other end portion thereof are overlapped with the adjacent scanning signal line GL. As apparent from FIG. 36, this overlapping structure will constitute a held capacitance element (electrostatic capacity) having one electrode PL2 being the transparent pixel electrode ITO1 and the other electrode PL1 being the adjacent scanning signal line GL. The dielectric film of this held capacitance element Cadd is arranged by an insulating film GI used as a gate insulating film of the thin-film transistor TFT, and an anode oxide film AOF.

The held capacitance element Cadd is formed on a portion where the width of the second conducing film g2 of the scanning signal line GL is widened. It should be understood that the intersecting portion with the picture signal line DL is made narrow in order to reduce a probability of occurrences of shortcircuiting with the picture signal line DL.

Even when the transparent pixel electrode ITO1 would be electrically broken at the step coverage of the electrode PL1 of the held capacitance element Cadd, such an electric defect may be compensated by way of the island region which is fabricated by the second conducting film d2 and the third conducting film d3 and is bridged over this step coverage.

Gate Terminal Unit

Figure 42A:
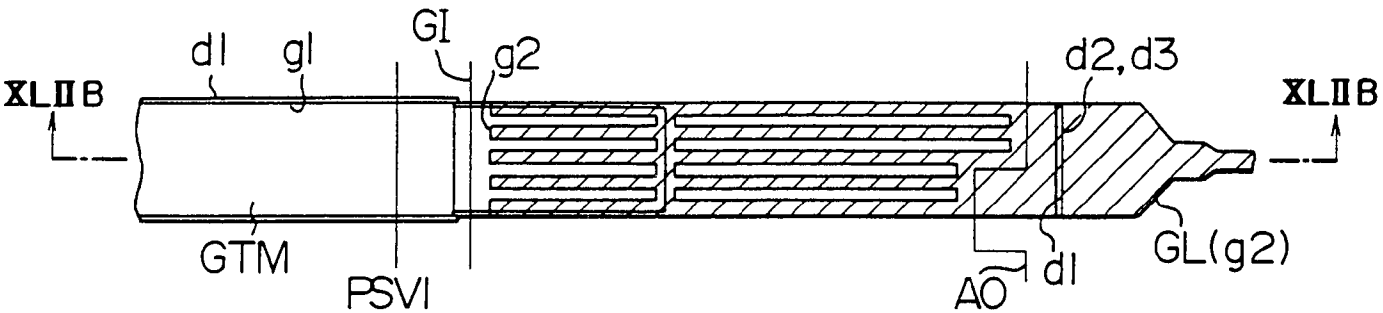
FIGS. 42A and 42B are plan view/sectional view for indicating a connection portion between a gate terminal GTM and a gate wiring GL.
Figure 42B:
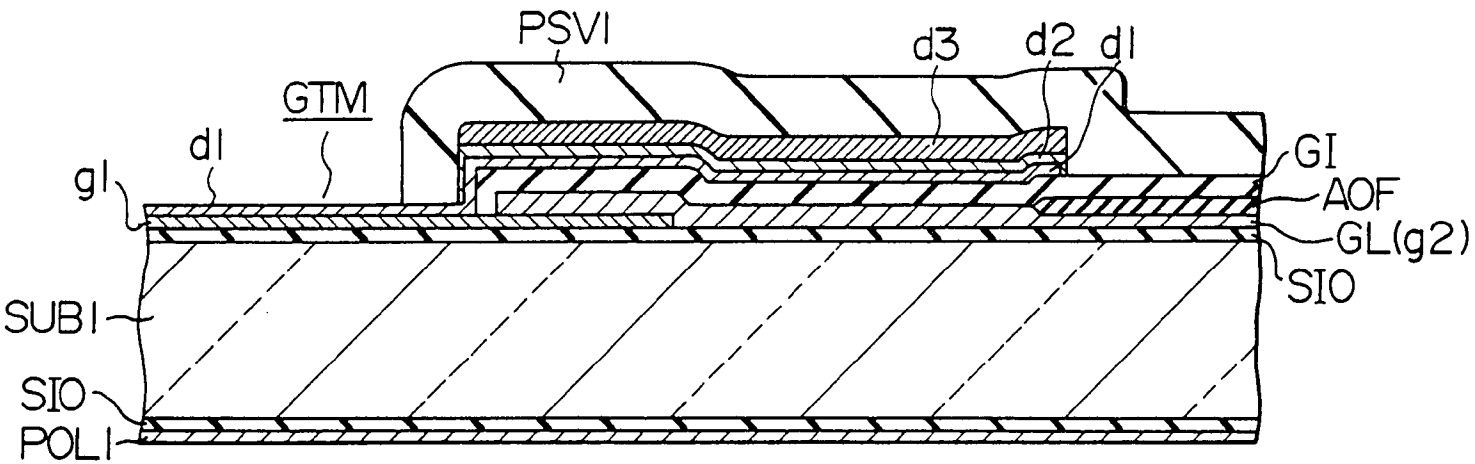

FIG. 42 represents a connection structure from the scanning signal line GL of the display matrix and the external connection terminal GTM. FIG. 42A is a plan view of this connection structure, and FIG. 42B is a sectional view thereof, taken along a cutting line D-D' of FIG. 42A. It should be noted that FIG. 42 corresponds to the lower portion of FIG. 39, and the incline wire portion is expressed as a straight line for the sake of convenience.

Symbol "AO" indicates a mask pattern used for a photographic process, namely a photoresist pattern of selective anode oxidation. Therefore, this photoresist is removed after anode oxidation. Although the pattern AO shown in FIG. 42A is not left as a final product, the oxide film AOF is selectively formed on the gate electrode GL, so that a trail thereof is remained (see sectional view of FIG. 42B). In this plan view, there are represented a left-sided region which is covered by the photoresist and therefor is not anode-oxided, a right-sided region which is exposed from the photoresist for anode-oxidation purposes, and a central region of a boundary line AO of the photoresist. An oxide $Al_2O_3$ film AOF is formed on the surface of the anode-oxided Al layer $g_2$, and the lower conducting portion thereof is reduced with its volume. It is of course to properly set time periods and voltages during the anode oxidation in order that the conducting portion thereof is left. The mask pattern AO is not intersected with the scanning line by a single straight line, but is intersected therewith in a crank form.

For the sake of easy understanding, the Al layer $g_2$ is hatched. The region which is not anodic-oxidized is patterned in a comb shape. If the width of the Al layer is wide, than whisker is produced on the surface, so that the widths of the respective Al layers are made narrow and a plurality of Al layers are banded in a parallel form. This may prevent occurrences of whisker, and probabilities of wire broken as well as lowering of conductivity can be suppressed under minimum values. As a consequence, the portions corresponding to the root portions of the comb are positionally shifted along the mask AO in this embodiment.

The gate terminal GTM is arranged by a chromium layer g1 having a good adhesive to the silicon oxide layer SIO and also a higher anti-electrolytic-corrosion characteristic than Al, and a transparent conducting layer d1 for protecting a surface thereof and formed at the same level as the pixel electrode ITO1 (same layer, simultaneous fabrication). It should be noted that the conducting layers d2 and d3 formed on the gate insulating film GI and on the side portions thereof are left as a result of covering such a region by the photoresist that these conducting layers $g_2$ and $g_1$ are not etched away together due to a pin hole while etching the conducting layers d3 and d2. Also, the ITO layer d1 which exceeds the gate insulating film GI and further extends along the right direction, may complete the above-described measurements.

In the plan view, the gate insulating film GI is formed at the right side, and the protection film PSV1 is similarly formed at the right side with respect to the boundary line, whereas the terminal unit GTM located at the left end is exposed therefrom and may be electrically contacted to the external circuit. Although only one pair of gate line GL and gate terminal are illustrated in the drawing, a plurality of such pairs are arranged at the upper/lower sides to constitute a terminal group Tg (see FIGS. 38 and 39). The left end of the gate terminal exceeds the cutting region CT1 of the substrate and then extend during the manufacturing stage, which will then be shortcircuits by the wiring line SHg. Such a shortcircuit line SHg during the manufacturing stage may contribute that power is supplied for the anodic oxidation and electrostatic breakdown is prevented during the rubbing of the orientation film ORI1.

Drain Terminal DTM

Figure 43A:
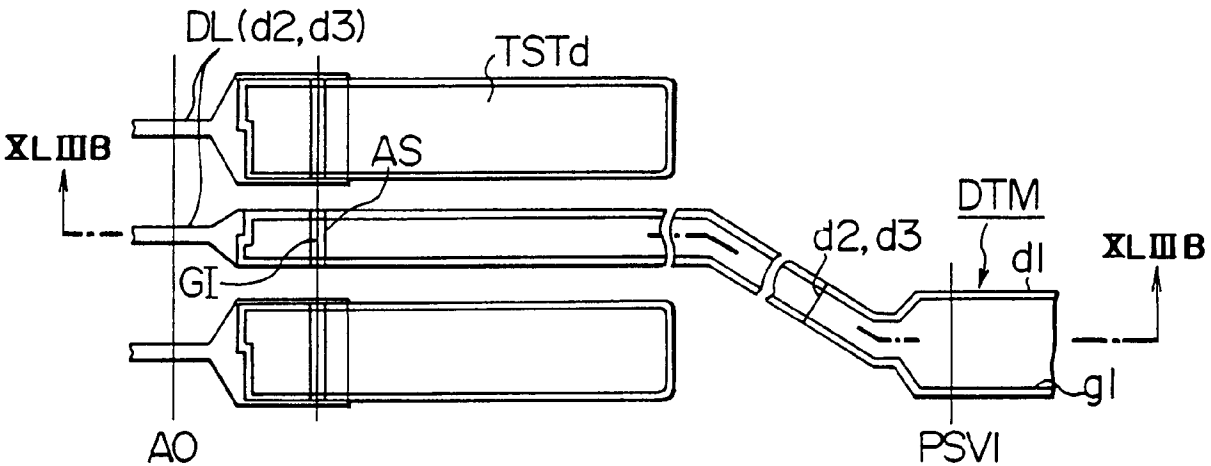
FIGS. 43A and 43B are plan view/sectional view for representing a connection portion between a drain terminal DTM and a video signal line DL.
Figure 43B:
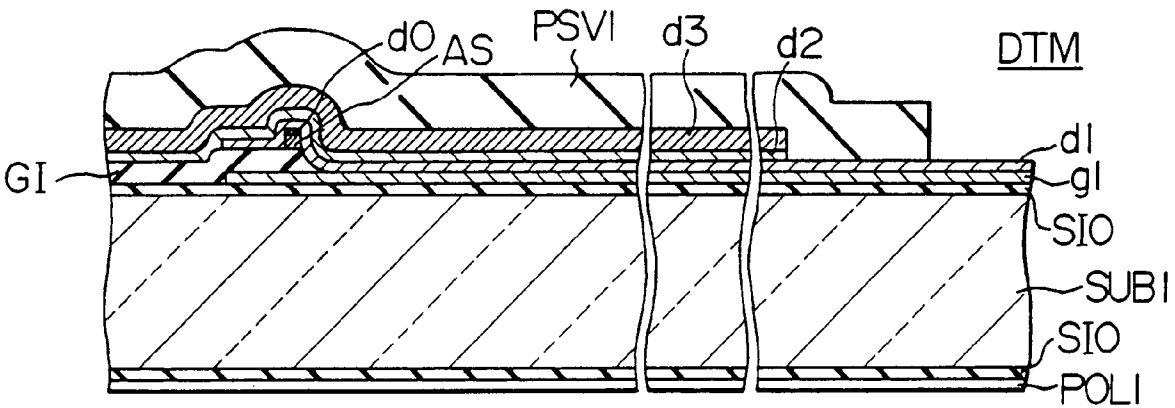

FIG. 43 shows a connection condition from the picture signal line DL to the external connection terminal DTM thereof. FIG. 43A is a plan view of this connection, and FIG. 43B is a sectional view of this connection, taken along a cutting line E-E' of FIG. 43A. It should be noted that FIG. 43 corresponds to an upper right portion shown in FIG. 39, and although the drawing orientation is changed for the sake of convenience, the right edge direction corresponds to the upper edge portion (or lower edge portion of the substrate SUB1.

Symbol TSTd indicates an examination terminal to which no external circuit is connected. However, the width of this terminal is widened in order to be connectable thereto, as compared with that of the wiring portion. Similarly, the width of the drain terminal DTM is widened which can be connected to the external circuit, as compared with that of the wiring portion. A plurality of examination terminals TSTd and external connection drain terminals DTM are alternately arranged in a cross-stitch shape along the upper/lower direction. As illustrated in this figure, although the examination terminals TSTd are terminated without reaching the edge portion of the substrate SUB1, the drain terminals DTM constitute a terminal group Td as shown i FIG. 39. These drain terminals exceed the cutting line CT1 of the substrate SUB1 and further extend, and also all of them are mutually shortcircuited by the wiring SHd during the manufacturing stage due to protection of electrostatic breakdown. The drain connection terminals are connected to the opposite side with sandwiching the matrix of the picture signal line DL where the examination terminal TSTd is present, and conversely the examination terminals are connected to the opposite said with sandwiching the matrix of the picture signal line DL where the drain connection terminal DTM is present.

The drain connection terminal DTM is fabricated by two layers of the Cr layer $g_1$ and the ITO layer $d_1$ due to the same reason for the above-explained gate terminal GTM, and the portion thereof from which the gate insulating film GI has been removed, is connected to the picture signal line DL. The semiconductor layer AS formed on the edge portion of the gate insulating film GI is used to etch the edge portion of the gate insulating film GI in a taper shape. As apparent from the foregoing descriptions, the protection film PSV1 employed to be connected to the external circuit on the terminal DTM has been removed. Symbol AO denotes an anodic oxidation mask, the boundary line of which is formed so as to entirely surround the matrix. Although the left-sided portion from this boundary line is covered with the made in this figure, since no layer g2 is present on the uncovered portion, this pattern has no direct relation thereto.

As illustrated in FIG. 40, the lead wiring pattern from the matrix portion to the drain terminal unit DTM is so constructed that the layers d2 and d3 provided at the same level as the picture signal line DL are stacked just over the layers d1 and g1 provided at the same level as the drain terminal unit DTM up to a half way to the seal pattern SL. This structure is aimed to suppress probabilities of wiring breakdown to a minimum value, and also to protect the Al layer d3 by the protection film PSV1 and the seal pattern SL a much as possible, which is electrolytic corrosive.

Equivalent Circuit of Overall Display Apparatus

Figure 44:
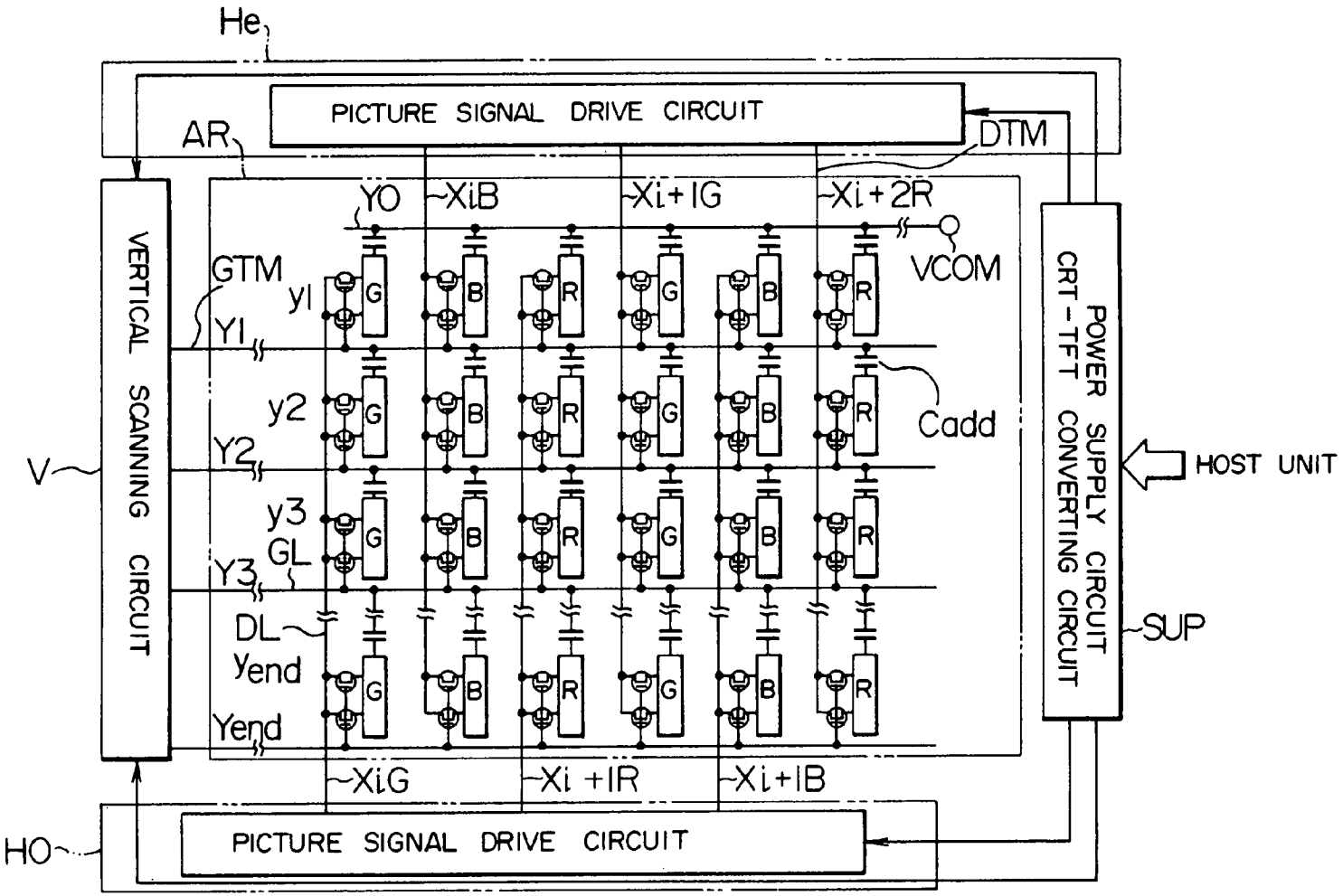
FIG. 44 is a circuit diagram of a matrix unit and a peripheral portion thereof for the active matrix type color LCD display apparatus.

In FIG. 44, there is shown a circuit arrangement of an equivalent circuit of the display matrix unit and a peripheral circuit thereof. Although this drawing corresponds to the circuit diagram, it represents an actual geometrical arrangement. Symbol AR shows a matrix array in which a plurality of pixels are arranged in a two dimensional form.

In this drawing, symbol "X" implies the picture signal line DL, and subscripts G, B and R are attached thereto which correspond to green, blue and red pixels, respectively. Symbol Y implies the scanning signal line GL, and subscripts 1, 2, 3, - - - , end are attached thereto in accordance with the scanning timings.

The picture signal lines X (subscripts are omitted) are alternately connected to the upper (otherwise odd-numbered) picture signal drive circuit He and the lower (otherwise even-numbered) picture signal drive circuit Ho.

The scanning signal line Y (subscripts are omitted) are connected to the vertical scanning circuit V.

Symbol "SUP" denotes such a circuit containing a power supply circuit for obtaining a plurality of subdivided/stabilized voltage sources from a single voltage source, and a circuit for converting CRT information derived from a host (host calculating unit) unit into information for TFT LCD display apparatus.

Functions of Held Capacitance Element Cadd

The held capacitance element Cadd functions to reduce an adverse influence caused by the gate potential variation vg with regard to a neutral potential (pixel electrode potential) Vlc when the TFT transistors TFT are switched. This state will be expressed by the following equation:

$$\Delta Vlc=\{Cgs/(Cgs+Cadd+Cpix)\}\times\Delta Vg$$

where symbol Cgs indicates a stray capacitance formed between the gate electrode GJ of the thin-film transistor TFT and the source electrode SD1, symbol Cpix represents a capacitance formed between the transparent pixel electrode IT01 (PIx) and the common transparent pixel electrode ITO2 (COM), and symbol ΔV1*c* may cause a DC component to be added to the liquid crystal LC, if the held capacitance Cadd is made large, then this variation may be lowered. Also, the held capacitance element Cadd owns an effect to prolong discharge time, and therefore stores for a long time, the picture information obtained after the thin-film transistor TFT is turned OFF. Lowering of the DC component added to the liquid crystal LC may improve a lifetime of the liquid crystal LC, and may reduce a so-called "burning", namely such a phenomenon that a preceding image remains when an LCD image is switched.

As previously explained, since the gate electrode GT is made large sufficiently covering the overall i type semiconductor layer AS, the overlapped area between the source electrode SD1 and the drain electrode SD2 is increased, so that the stray capacitance Cgs becomes large. There is an adverse influence that the neutral potential V1*c* is readily influenced by the gate (scanning) signal Vg. However, this demerit may be solved by employing the held capacitance element Cadd.

A capacitance of this held capacitance element Cadd is selected to be 4 to 8 times higher than the LCD capacitance Cpix (4.Cpix<Cadd<8.Cpix) and 8 to 32 times higher than the stray capacitance Cgs (8.Cgs<Cadd<32.Cgs) in view of the writing characteristic of the pixel.

The potential of the scanning signal line GL (Yo) provided at the first stage which is used as only the held capacitance electrode line is equal to that of the common transparent pixel electrode IT02 (Vcom). In the example shown in FIG. 39, the scanning signal line at the first stage is shortcircuits by the common electrode COM via the terminal GTO, the lead wiring line INT, the terminal DTO, and the external wiring. Otherwise, the held capacitance electrode line Yo provided at the first stage may be connected to the scanning signal line Yend provided at the final stage, to the DC potential point (AC grown point) other than Vcom, or to receive one extra scanning pulse Yo from the vertical scanning circuit Vo.

Overall Arrangement of LCD Module

Figure 45:
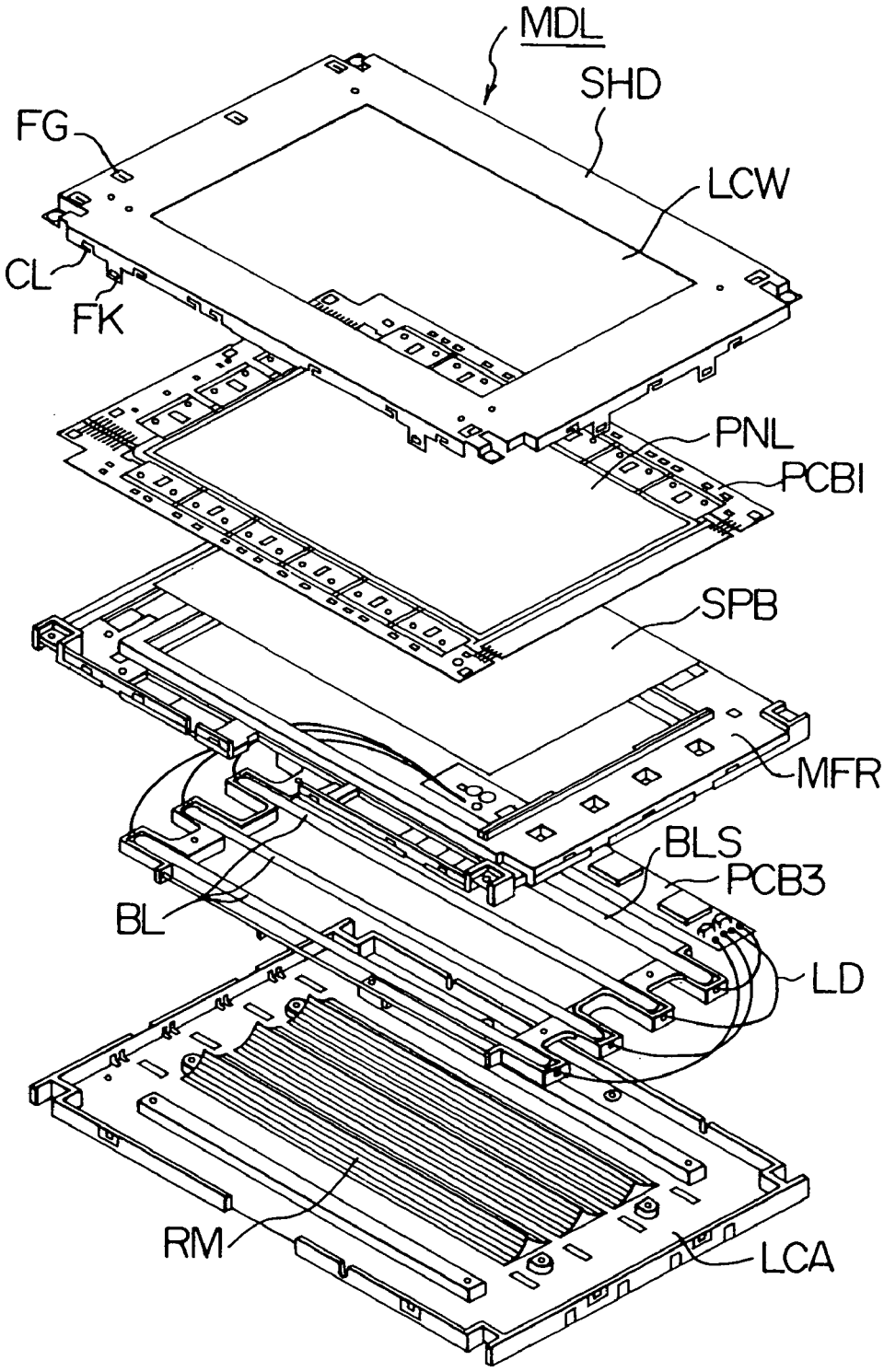
FIG. 45 is a perspective view for showing a resolved LCD display module.

FIG. 45 is an exploded perspective view for showing constructive components of a liquid crystal module MDL. In this drawing, symbol SHD indicates a frame-shaped shield case made of a metal plate (metal frame), symbol LCW denotes a display window of the metal frame, symbol PNL is an LCD display panel, symbol SPB is a light diffusing plate, symbol MFR denotes an intermediate frame, symbol BL is a back light, symbol BLS show a back light supporter, and symbol LCA is a lower case. As illustrated, the respective components are stacked with the vertical positional relationship to assemble the LCD module MDL.

The module MDL is fixed by a claw CL and a hook FK provided on the shield case SHD.

The intermediate frame MFR is made in a frame shape in such a manner that an opening corresponding to the display window LCW is provided, on which there are provided the light diffusing plate SPB, the back light supporter BLS, and concave/convex fitted to the shapes/thicknesses of various circuit components, and also the heat radiating opening.

The lower case LCA has another function as a reflector for back light radiation, on which a reflecting will "RM" is formed in accordance with a fluorescent lamp BL in order to effectively reflect the light radiation.

Display Panel & Drive Circuit Board PCB1

Figure 46:
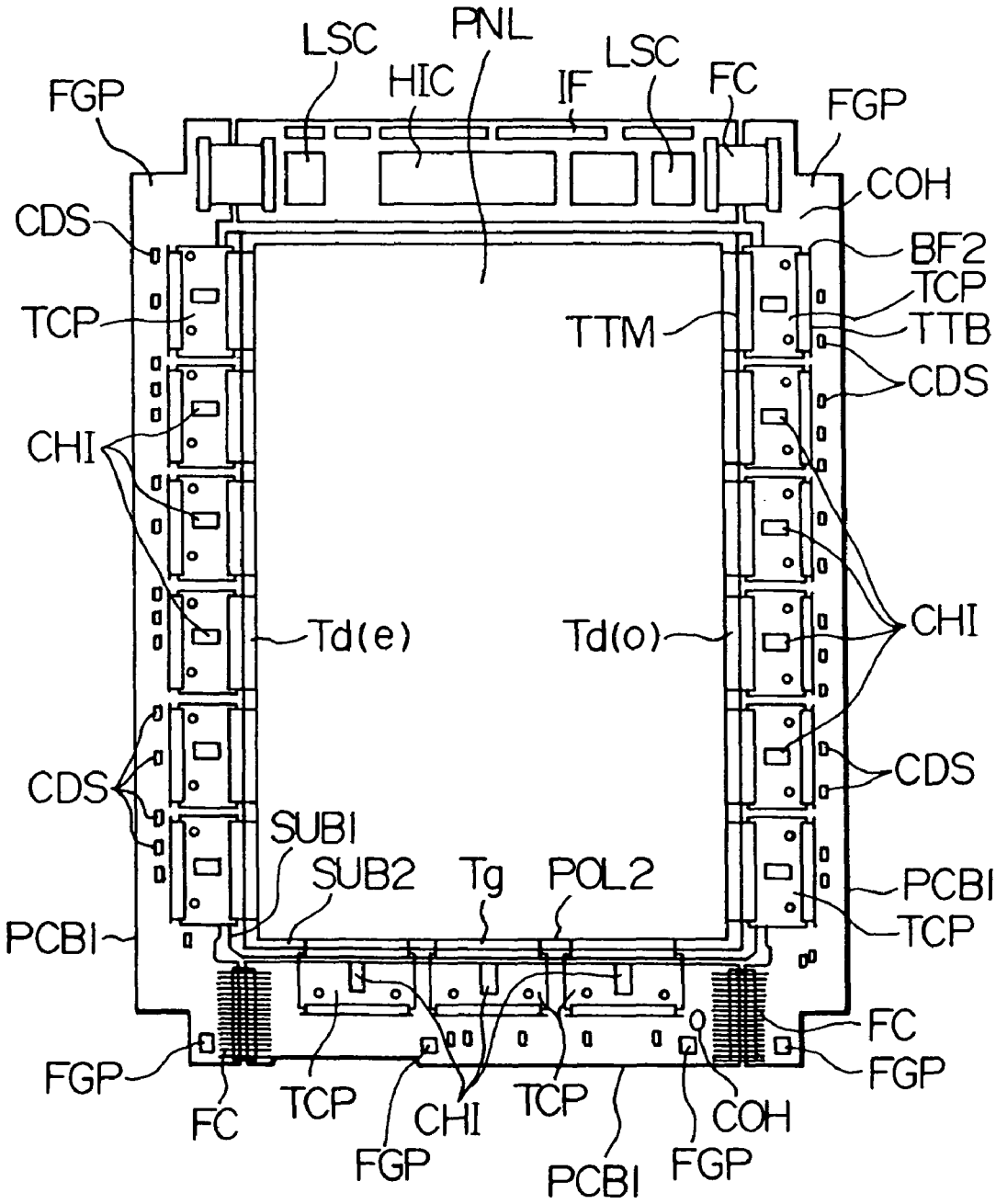
FIG. 46 is a top view for representing such a condition that a peripheral drive circuit is actually mounted on the LCD display panel.

FIG. 46 is a top view for showing such a condition that the picture signal drive circuits He, Ho, the vertical scanning circuit V, and the power source circuit are connected to the display panel PNL shown in FIG. 37.

Symbol CHI indicates a drive IC chip for driving the display panel PNL (3 lower-sided chips are the drive IC chips for the vertical scanning circuit, and left/right-sided 6 and 6 IC chips are the drive IC chips for the picture signal drive circuits). As will be discussed with reference to FIGS. 47 and 48, symbol TCP denotes a tape carrier package in which the drive IC chips CHI are packaged by the tape automated ending method (TAB). Symbol PCB1 is a drive circuit board on which TCP and capacitors CDS are packaged, and is subdivided into 4 sub boards. Symbol FGP is a frame ground pad, to which a spring-shaped strip FC formed in a notch of the shield case SHD is soldered. Symbol FC denotes flat cables used to electrically connect the lower-sided drive circuit board PCB1 with the left-sided drive circuit board PCB1, to connect the lower-sided drive circuit board PCB1 with the right-sided drive circuit board PCB1, to connect the upper-sided drive circuit board PCB1 with the left-sided drive circuit board PCB1, and to connect the upper-sided drive circuit board PCB1 with the right-sided drive circuit board PCB1. As the flat cable FC, a plurality of lead wires are sandwiched with a stripe-shaped polyethylene layer and a polyvinyl alcohol layer.

Electronic components such as the control IC, the level shifter IC, the capacitors and the resistors are mounted on the upper-sided drive circuit board held/supported by the intermediate frame MFR. In this drive circuit board PCB1, such a circuit SUP is mounted which includes the power supply circuit for obtaining a plurality of subdivided/stabilized voltage sources from a single voltage source, and the circuit for converting the CRT information from the host unit to the information about the TFT LCD display apparatus. Symbol CJ is a connector connecting unit to which a connector (not shown) connected to an external unit is connected.

Connection Structure of TCP

Figure 47:
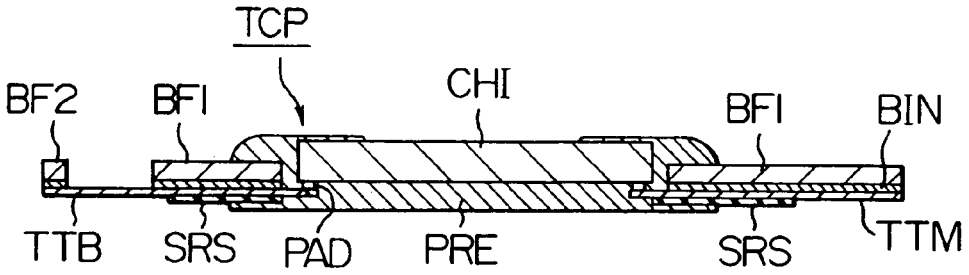
FIG. 47 schematically shows a sectional structure of a tape carrier package TCP where an integrated circuit chip CH1 for constituting the drive circuit is mounted on a flexible wiring substrate.
Figure 48:
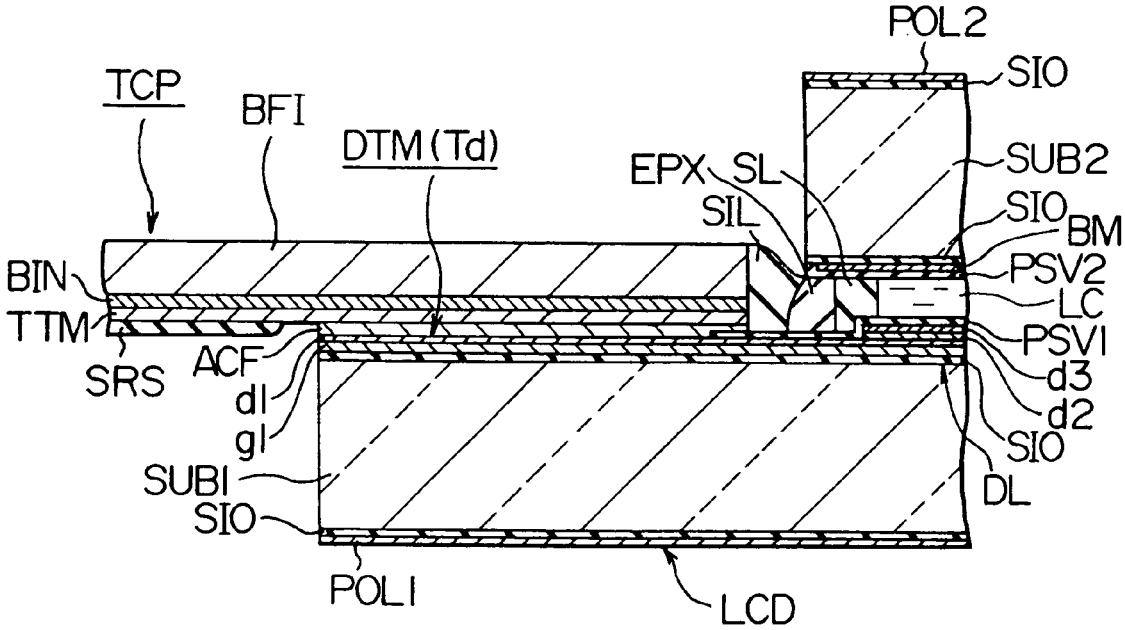
FIG. 48 is a sectional view for indicating a major portion of such a condition that the tape carrier package TCP is connected to the video signal circuit terminal DTM of the LCD panel PNL.

FIG. 47 is a sectional view for showing a structure of the tape carrier package in which the integrated circuit chip CHI for constituting the scanning signal drive circuit V and the video signal drive circuits He, Ho is mounted on a flexible wiring board. FIG. 48 is a sectional view for showing a major portion of such a state that the tape carrier package is connected to the picture signal circuit terminal DTM of the LCD panel in this example.

In FIG. 47, symbol TTB is an input terminal/wiring unit of the integrated circuit CHI. Symbol TTM denotes an output terminal/wiring unit of the integrated circuit CHI, which is made of, e.g., Cu. The bonding pad PAD of the IC circuit CHI is connected to a tip portion (normally, so-called "inner lead") inside the TTM by way of a so-termed "face down bonding method". The terminal TTB, and an outside tip portion (usually so-called "outer lead") of TTM are connected to the LCD panel PNL by an anisotropy conducting film ACF and also to the CRTTFT converting circuit and the power supply circuit SUP by way of soldering, corresponding to the input/output of the semiconductor IC chip. The package TCP is connected to the panel in order to cover the protection film PSV1 for exposing the connection terminal DTM at the panel PNL side. Therefore, since the external connection terminal DTM (GTM) is covered by at least one of the protection film PSV1 or the package TCP, it may withstand the electrolytic corrosion.

Symbol BF1 is a base film made of polyimid. Symbol SRS indicates a solder resist film for masking a component from extra soldering. A space between the upper glass substrate and the lower glass substrate provided outside the seal pattern SL is cleaned, and thereafter is protected by an epoxy resin EPX. A space defined between the package TCP and the upper side substrate SUB2 is filled with a silicone resin for multiple protection purposes.

In accordance with the present invention, even when the drain drivers are such low-withstanding-voltage drain drivers having no drive withstanding voltage capable of simultaneously driving the positive-polarity voltage and the negative-polarity voltage with respective common electrode voltage, both of the positive-polarity voltage and the negative-polarity voltage can be equally applied to the respective pixel unit on the 1 horizontal line. As a result, it is possible to prevent that currents flown to the common electrodes are concentrated. Since the voltage distortions of the common electrode voltage and the voltage distortions of the preceding scanning lines can be reduced, there is a merit that a high image quality LCD representation is realized.

Even when the signal lines of the LCD panel are conducted only from one direction, i.t., upwardly or downwardly, since the positive-polarity voltage and the negative-polarity voltage can be equally applied to the respective pixel units on the 1 horizontal line, it is possible to prevent that currents flown into the common electrodes are concentrated, whereby a high image quality LCD representation is available.

Also in accordance with the present invention, even when the drain drivers are such low-withstanding-voltage drain drivers having no drive withstanding voltage capable of simultaneously driving the positive-polarity voltage and the negative-polarity voltage with respective common electrode voltage, both of the positive-polarity voltage and the negative-polarity voltage can be equally applied to the respective pixel unit on the 1 horizontal line. This drain driver has the signal drive circuit for receiving the analog image data.

Furthermore, while realizing such a high image quality representation, since the low-withstanding-voltage drain drivers can be utilized, the chip sizes of the drain drivers can be made small. There are advantages that the drive circuits of the LCD display apparatus and the LCD display apparatus can be manufactured at low cost.

Moreover, since the drain drivers are arranged under low withstanding voltage, even when the total number of circuits for performing multi-color is increased, there is another merit to suppress a ratio of cost increase.

Since the LCD drive voltage functioning as the reference LCD apply voltage is inputted from the external power source to the drain drivers according to the present invention, the LCD apply voltages suitable for the voltage-luminance characteristic of the liquid crystal may be produced, so that such an LCD display apparatus having a better gradation characteristic can be obtained.

In addition, as the drain drivers of the present invention own the function to produce the LCD apply voltage having a high current drive ability, the LCD panel with high precision and a large screen size can be readily manufactured.

There is a further merit to manufacture a low-cost information processing apparatus with employment of the LCD display apparatus according to the present invention.

What we claim is:

1. A display apparatus comprising:

a display panel including a plurality of pixels in a matrix arrangement;

a controlling circuit configured to receive an input analog display data signal having luminance information with a positive-polarity voltage and to output an alternating signal;

a polarity inverting circuit coupled to receive the input analog display data signal from the controlling circuit and to receive the alternating signal, and configured to output an inverted polarity analog image data signal by inverting a polarity of the input analog display data signal in correspondence with the alternating signal;

an AC circuit coupled to receive the alternating signal and configured to output a high-level reference voltage and a low-level reference voltage, wherein a polarity of both of the high-level reference voltage and the low-level reference voltage is reversed with respect to a common electrode voltage according to the alternating signal;

a level shifter circuit coupled to the polarity inverting circuit to receive the inverted polarity analog image data signal and coupled to receive the low-level reference voltage, and configured to shift voltage levels of the inverted analog image data signal according to the low-level reference voltage; and a signal driver circuit coupled to receive the high-level reference voltage and the low-level reference voltage from the AC circuit and coupled to receive the inverted analog image data signal with shifted voltage levels from the level shifter circuit, and configured to convert the inverted analog image data signal received from the level shifter circuit into a voltage applied to the display panel corresponding to the inverted analog image data signal with shifted voltage levels received from the level shifter circuit.

2. The display apparatus according to claim 1, wherein the signal driver circuit comprises a low voltage resistant driver circuit.

3. The display apparatus according to claim 1, wherein the display panel comprises an LCD.

4. A display apparatus comprising:

a display panel including a plurality of pixels in a matrix arrangement;

a controlling circuit configured to receive an input analog display data signal having luminance information which has only a positive-polarity voltage and to output an alternating signal; and means for driving the display panel based on the input analog display data signal having luminance information which has only a positive-polarity voltage received by the controlling circuit without deterioration of a display image on the display panel based on the input analog display data signal and without analog/digital conversion of the input analog display data signal, said means comprising:

a polarity inverting circuit coupled to receive the input analog display data signal from the controlling circuit and to receive the alternating signal, and configured to output an inverted polarity analog image data signal by inverting a polarity of the input analog display data signal in correspondence with the alternating signal;

an AC circuit coupled to receive the alternating signal and configured to output a high-level reference voltage and a low-level reference voltage, wherein a polarity of both of the high-level reference voltage and the low-level reference voltage is reversed with respect to a common electrode voltage according to the alternating signal;

a level shifter circuit coupled to the polarity inverting circuit to receive the inverted polarity analog image data signal and coupled to receive the low-level reference voltage, and configured to shift voltage levels of the inverted analog image data signal according to the low-level reference voltage; and a signal driver circuit coupled to receive the high-level reference voltage and the low-level reference voltage from the AC circuit and coupled to receive the inverted analog image data signal with shifted voltage levels from the level shifter circuit, and configured to convert the inverted analog image data signal received from the level shifter circuit into a voltage applied to the display panel corresponding to the inverted analog image data signal with shifted voltage levels received from the level shifter circuit.

5. The display apparatus according to claim 4, wherein the signal driver circuit comprises a low voltage resistant driver circuit.

6. The display apparatus according to claim 4, wherein the display panel comprises an LCD.

* * * * *